US008310404B2

(12) United States Patent
Kishimoto et al.

(10) Patent No.: US 8,310,404 B2
(45) Date of Patent: Nov. 13, 2012

(54) LAMP APPARATUS, ANTENNA UNIT FOR LAMP APPARATUS, COMMUNICATION SYSTEM, AND TRAFFIC SIGNAL CONTROLLER

(75) Inventors: Kengo Kishimoto, Osaka (JP); Suguru Yamagishi, Osaka (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 318 days.

(21) Appl. No.: 12/669,417

(22) PCT Filed: Jun. 30, 2008

(86) PCT No.: PCT/JP2008/061841

§ 371 (c)(1), (2), (4) Date: Jan. 15, 2010

(87) PCT Pub. No.: WO2009/011218

PCT Pub. Date: Jan. 22, 2009

(65) Prior Publication Data

US 2010/0188301 A1 Jul. 29, 2010

(30) Foreign Application Priority Data

| | | |
|---|---|---|
| Jul. 17, 2007 | (JP) | 2007-186019 |
| Jul. 17, 2007 | (JP) | 2007-186046 |
| Jul. 17, 2007 | (JP) | 2007-186082 |
| Jul. 23, 2007 | (JP) | 2007-191044 |
| Dec. 26, 2007 | (JP) | 2007-334830 |
| Dec. 28, 2007 | (JP) | 2007-338429 |

(51) Int. Cl.
*H01Q 1/06* (2006.01)

(52) U.S. Cl. ..... 343/721; 343/720

(58) Field of Classification Search ..... 343/720, 343/721, 711, 713, 700 MS
See application file for complete search history.

(56) References Cited

U.S. PATENT DOCUMENTS

| | | | | |
|---|---|---|---|---|
| 4,908,615 | A | 3/1990 | Bayraktaroglu | |
| 5,446,470 | A | 8/1995 | Avignon et al. | |
| 6,850,169 | B2 * | 2/2005 | Manavi et al. | 340/902 |
| 7,471,213 | B2 * | 12/2008 | Ellison | 340/907 |
| 2005/0094404 | A1 | 5/2005 | Sinesi et al. | |

FOREIGN PATENT DOCUMENTS

| | | |
|---|---|---|
| EP | 0 726 554 A1 | 8/1996 |
| JP | 63-287103 A | 11/1988 |
| JP | 06-069708 | 3/1994 |

(Continued)

OTHER PUBLICATIONS

European Search Report issued in European Patent Application No. 08790754.9-1232, mailed Oct. 6, 2010.

(Continued)

*Primary Examiner* — Hoang V Nguyen
(74) *Attorney, Agent, or Firm* — McDermott Will & Emery LLP

(57) ABSTRACT

A lamp apparatus 1 includes an optical unit 2 and a patch antenna 4. The optical unit 2 includes an LED 7 and a substrate 8 having the LED 7 mounted at the front face, and a cover member 9 having visible-light transmittance, spread over the LED 7 at the front. In this optical unit 2 are stored the patch antenna 4 including a patch element 11 and a ground element 12 located at the rear of the patch element 11.

18 Claims, 49 Drawing Sheets

FOREIGN PATENT DOCUMENTS

| | | | |
|---|---|---|---|
| JP | 8-002285 | | 1/1996 |
| JP | 09-180091 | | 7/1997 |
| JP | 11-112035 | * | 4/1999 |
| JP | 2000-128091 A | | 5/2000 |
| JP | 2000-194992 | | 7/2000 |
| JP | 2001-043488 | | 2/2001 |
| JP | 2004-326608 | | 11/2004 |
| JP | 2005-099889 | | 4/2005 |
| JP | 2005-135904 A | | 5/2005 |
| JP | 2005-5135904 A | | 5/2005 |
| WO | WO 98/37529 | | 8/1998 |

OTHER PUBLICATIONS

Japanese Office Action, w/ English translation thereof, issued in Japanese Patent Application No. 2010-186994, dated Mar. 27, 2012.
Japanese Office Actions with English translations issued in application No. 2007-186019 issued on Jun. 12, 2012.
Japanese Office Actions with English translations issued in application No. 2007-338429 issued on Apr. 24, 2012.
Japanese Office Actions with English translations issued in application No. 2007-334830 issued on Apr. 24, 2012.

* cited by examiner

LAMP APPARATUS, ANTENNA UNIT FOR LAMP APPARATUS, COMMUNICATION SYSTEM, AND TRAFFIC SIGNAL CONTROLLER

RELATED APPLICATIONS

This application is the U.S. National Phase under 35 U.S.C. §371 of International Application No. PCT/JP2008/061841, filed on Jun. 30, 2008, which in turn claims the benefit of Japanese Application Nos. 2007-186082, filed on Jul. 17, 2007, 2007-186019, filed on Jul. 17, 2007, 2007-186046, filed on Jul. 17, 2007, 2007-191044, filed on Jul. 23, 2007, 2007-334830, filed on Dec. 26, 2007 and 2007-338429, filed on Dec. 28, 2007, the disclosures of which Applications are incorporated by reference herein.

TECHNICAL FIELD

The present invention relates to a lamp apparatus, particularly installed on roads, and an antenna unit provided in the lamp apparatus. Furthermore, the present invention relates to a communication system including the lamp apparatus, and a traffic signal controller connected to the lamp apparatus.

BACKGROUND ART

For the purpose of promoting traffic safety and preventing traffic accidents, the Intelligent Transport System (ITS) has now been proposed. According to the ITS, a communication device is installed on the roads. Information sent out through the antenna of the communication device is received at an in-vehicle device mounted on a running vehicle. Usage of such information by the in-vehicle device allows the safety in association with the drive of the vehicle to be improved (refer to Japanese Patent No. 2806801).

For a road-vehicle wireless communication, an arm is extended towards the roadway from a pole installed on the sideway or the like, and an antenna of the communication device is attached on the arm from the standpoint of ensuring the line of sight in wireless communication. In the case where the line of sight can be ensured in the absence of an arm, the antenna is attached directly to the aforementioned pole.

For the purpose of installing the antenna of the communication device at the road, it is not economical to newly install a pole just for the antenna. It is also not preferable from the standpoint of the aesthetic view of the street.

Since vehicle sensors, heads of optical beacon and the like are installed along the road, it may be possible to install the antenna at the poles and arms to which the sensors and heads are attached. However, this is not preferable from the standpoint of aesthetic purpose.

DISCLOSURE OF THE INVENTION

In view of the foregoing, an object of the present invention is to provide technical measures to dispense with a pole dedicated to installing an antenna, avoiding spoiling the aesthetic preference of the road.

A lamp apparatus of the present invention includes an optical unit having a light emitter and a cover member of visible-light transmittance, spread over the light emitter at the front, and a patch antenna stored in the optical unit. According to the lamp apparatus, the patch antenna is incorporated into the optical unit of the lamp apparatus to be rendered inconspicuous. Moreover, a pole dedicated to installing the antenna can be dispensed with by incorporating the patch antenna into the optical unit of the lamp apparatus.

As a first lamp apparatus of the present invention, the patch antenna includes a patch element situated in a range from the cover member up to a leading end of the light emitter, and a ground element located at the rear of the patch element. The patch element has visible-light transmittance. Although the patch element is provided frontward of the leading end of the light emitter in the light apparatus, the forward light emittance (lightening) by the light emitter will not be impeded since the patch element has visible-light transmittance.

As used herein, "visible-light transmittance" of the patch element includes the state where the conductive body of the patch element (conductor portion) is transparent or semi-transparent, and also the state where visible light is blocked by the conductive body portion constituting the patch element, but passes through a portion of the patch element where the conductive body is not provided so that the visible light emitted at the rear of the patch element reaches ahead of the patch element.

In the first lamp apparatus, the ground element can be configured having visible-light transmittance, located at the rear of the patch element and frontward of the leading end of the light emitter. Although the ground element is located ahead of the leading end of the light emitter, frontward light emittance (lightening) by the light emitter is not impeded since the ground element has visible-light transmittance.

In the first lamp apparatus, the optical unit includes a substrate having the light emitter mounted at the front face. The ground element may be provided at the rear of the patch element, and between the substrate and the leading end of the light emitter in the front-back direction. Since the ground element is located at the rear of the leading end of the light emitter in this case, the ground element will not impede the forward light emittance (lightening) by the light emitter.

In this case, the optical unit preferably includes a plurality of light emitters each constituted of a light emitting diode, and the ground element is planar, having an opening formed into which a light emitting diode is inserted. Accordingly, a light emitting diode can be inserted into an opening of the ground element, and the ground element can be situated at a predetermined position to avoid the event of the ground element interfering with the light emitting diode.

As a configuration of the opening, a hole may be formed in the ground element to arrange the light emitting diode so as to avoid interference with the ground element. Further, in the absence of a hole, the conductive body (conductor portion) of the ground element, for example, may be arranged in a meandering manner (arranging the conductive body as one continuous stroke) to position the light emitting diode so as to avoid interference with the ground element.

In the first lamp apparatus, the patch element can be configured as a conductor having an opening formed for transmitting visible light. For example, the patch element may take a mesh configuration or frame configuration to have visible-light transmittance.

Alternatively, the patch element can be configured as a conductor membrane that has visible-light transmittance. Accordingly, the patch element exhibits visible-light transmittance.

The first lamp apparatus preferably includes a sheet member of visible-light transmittance, provided between the cover member and the leading end of the light emitter. The patch element is formed at the sheet member. This facilitates the formation of a thin patch element in a predetermined configuration.

Alternatively, the patch element is preferably formed at the cover member. This facilitates formation of a thin patch element in a predetermined configuration. Moreover, this eliminates the need of another member to form a patch element.

According to a second lamp apparatus, the patch antenna includes a patch element situated at the rear of the leading end of the light emitter, and a ground element located at the rear of the patch element. The patch element and ground element are stored in the optical unit. According to this lamp apparatus having the antenna stored in the optical unit, the event of the patch element and ground element impeding forward light emittance (lightening) by the light emitter can be prevented since the patch element and rear-located ground element are situated at the rear side of the leading end of the light emitter.

According to the second lamp apparatus, the optical unit preferably includes a substrate having the light emitter mounted at the front face, and the patch element is provided in front of the substrate and at the rear of the leading end of the light emitter. Since the patch element is located ahead of the substrate according to the lamp apparatus, the event of the substrate impeding communication through the antenna can be prevented.

Further, the ground element is preferably provided at the rear of the patch element and in front of the substrate. In this case, the ground element is located between the substrate and the patch element.

According to the second lamp apparatus, the optical unit further includes a storage member having the cover member attached at the front and storing the light emitter. The patch element and the ground element are stored in a storage cavity defined between the cover member and the storage member. The patch element is situated at a rear side of the leading end of the light emitter, and the ground element is located at the rear of the patch element. The patch element is preferably provided at the rear side of the leading end of the light emitter, and the ground element is located at a rear of the patch element. Since the antenna is stored in the optical unit under a state where the patch element and the ground element are stored in the storage cavity between the cover member and storage member, the antenna can be rendered inconspicuous.

In the second lamp apparatus, the optical unit preferably includes a plurality of light emitters each constituted of a light emitting diode, and the patch element is planar, having an opening formed into which a light emitting diode is inserted. Accordingly, a light emitting diode can be inserted into an opening in the patch element, and the patch element can be situated at a predetermined position to avoid the event of the patch element interfering with the light emitting diode.

As a configuration of the opening, a hole may be formed in the patch element to arrange a light emitting diode so as to avoid interference with the patch element. Further, in the absence of a hole, the conductive body (conductor portion) of the patch element, for example, may be arranged in a meandering manner (arranging the conductive body as one continuous stroke) to position the light emitting diode so as to avoid interference with the patch element.

In the case where the first lamp apparatus and the second lamp apparatus each are traffic signal lamps, the traffic signal lamp is installed on the road in consideration of the visibility by the vehicle driver. By installing the traffic signal lamp at a predetermined position of the road, a favorable line of sight state is obtained for executing wireless communication between the antenna and the in-vehicle device of a vehicle.

An antenna unit for a lamp apparatus of the present invention is incorporated into an optical unit including a light emitter and a cover member of visible-light transmittance, spread over the light emitter at the front. The antenna unit for a lamp apparatus includes a patch element situated in a range from the cover member up to the leading end of the light emitter, and a ground element located at the rear of the patch element.

By incorporating the antenna unit including a patch element and ground element into the optical unit of the light apparatus in the present invention, the antenna unit (patch element and ground element) can be rendered inconspicuous. Further, incorporation of the antenna into the optical unit of the lamp apparatus eliminates the need of a pole dedicated to installing an antenna. Although the patch element is situated frontward of the leading end of the light emitter when the antenna is incorporated into the optical unit, the event of impeding forward light emittance (lightening) by the light emitter can be prevented since the patch element has visible-light transmittance.

Another antenna unit for a lamp apparatus is stored in an optical unit including a light emitter and a cover member of visible-light transmittance, spread over the light emitter at the front. The antenna unit includes a patch element situated at a rear side of the leading end of the light emitter, and a ground element located at a rear of the patch element.

By storing the antenna unit in the optical unit of the lamp apparatus according to the present invention, the antenna (patch element and ground element) can be rendered inconspicuous. Further, since the antenna is stored in the optical unit of the lamp apparatus, the pole dedicated to installing an antenna can be dispensed with. Furthermore, even if the antenna is stored in the optical unit, the event of the patch element and ground element impeding forward light emittance (lightening) by the light emitter can be prevented since the patch element and rear ground element are provided at the rear side of the leading end of the light emitter.

In addition, a communication system of the present invention includes a traffic signal lamp apparatus including a plurality of optical units each having a light emitter, a plurality of antennas incorporated in the traffic signal lamp apparatus, and a control unit for control of wireless communication by the antenna. The plurality of antennas are incorporated in a separated manner among the plurality of optical units.

By incorporating the antenna into the traffic signal lamp apparatus of the present invention, the antenna can be rendered inconspicuous. Further, a pole dedicated to installing an antenna can be dispensed with.

Moreover, since a plurality of antennas are provided at the traffic signal lamp apparatus, the control unit is preferably configured to carry out diversity control.

The traffic signal lamp apparatus is installed on the road in consideration of visibility by the driver of a vehicle. By installing the signal lamp apparatus at a predetermined position of the road, a favorable line of sight state can be achieved for wireless communication between the antenna and an in-vehicle device mounted on the vehicle.

The traffic signal controller of the present invention for turning on and off a traffic signal lamp apparatus is connected to the traffic signal lamp apparatus including an optical unit having a light emitter and a cover member of visible-light transmittance, spread over the light emitter at the front, and a patch antenna stored in the optical unit. The traffic signal controller is configured to transmit, through the antenna, signal information related to display of current and future traffic signal lights for vehicles running on a road on which the traffic signal lamp apparatus is installed.

BEST MODE FOR CARRYING OUT THE INVENTION

[First Lamp Apparatus]

Figure 1:
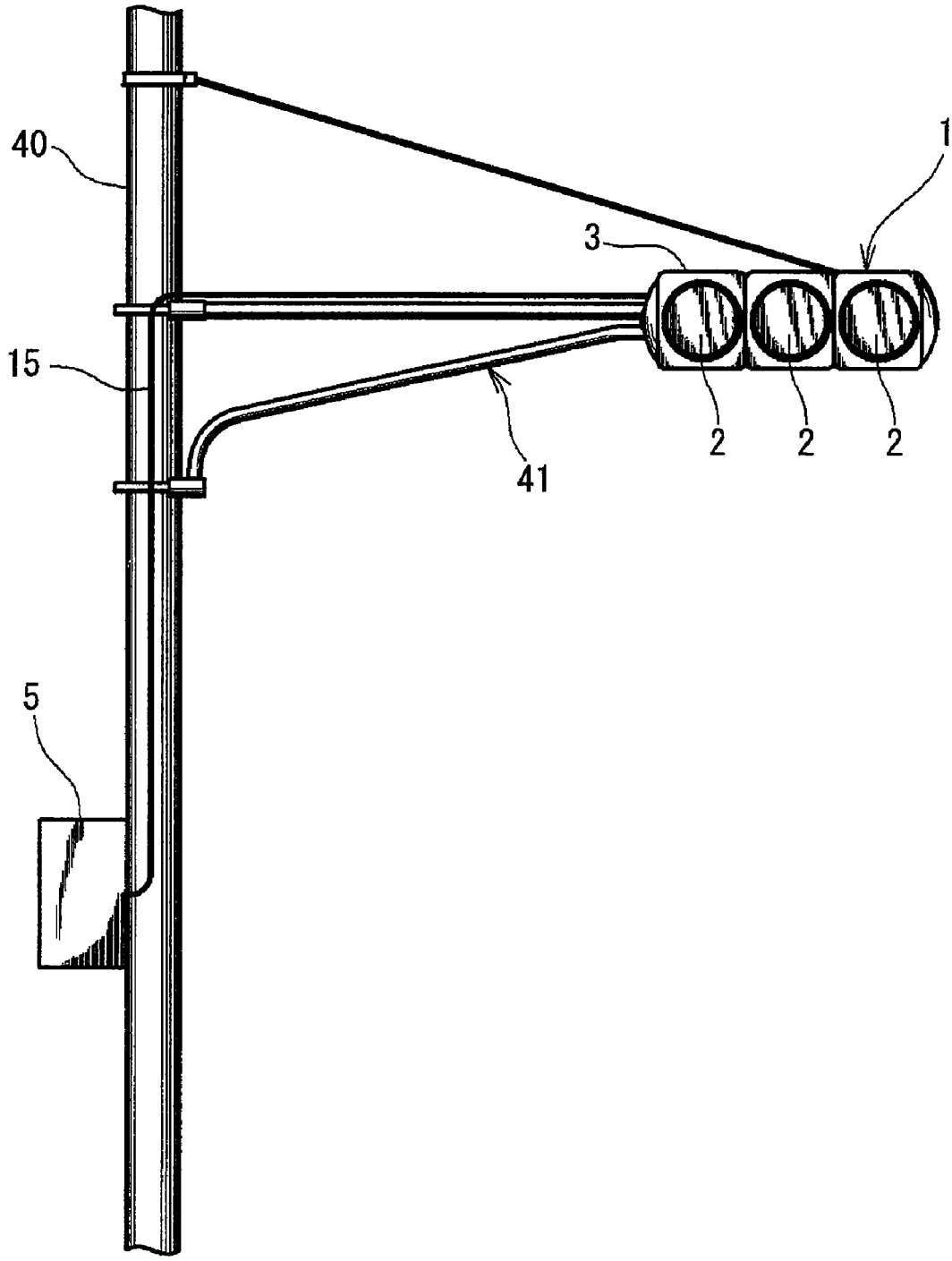
FIG. 1 is a front view of an embodiment of a lamp apparatus of the present invention.

FIG. 1 is a front view representing an embodiment of a lamp apparatus of the present invention. The lamp apparatus of FIG. 1 is for a vehicle, specifically a traffic signal lamp apparatus 1 installed at a road (hereinafter, also simply referred to as signal lamp apparatus 1 or lamp apparatus 1). A pole 40 is installed at the side of the road such as on a sidewalk. An arm 41 extends towards the roadway from pole 40. Signal lamp apparatus 1 is attached to arm 41.

Signal lamp apparatus 1 includes a plurality of optical units 2 (three in the drawing), and an enclosure 3 incorporating optical units 2. The three optical units 2 include red, yellow, and blue lightening colors. A visor (not shown) is attached to each optical unit 2.

A control device (control unit) 5 controlling signal lamp apparatus 1 is attached to pole 40. The configuration of installation of signal lamp apparatus 1 is arbitrary, and may be other than that shown in the drawings. For example, although not shown, the form of pole 40 and arm 41 may differ. Alternatively, signal lamp apparatus 1 may be installed at a pedestrian bridge. Further, control device 5 may be provided in enclosure 3 of signal lamp apparatus 1.

Control device 5 controlling the lighting of signal lamp apparatus 1 can conduct wireless communication control through antenna 4 that will be described afterwards. Alternatively, control device 5 controlling the lighting or the like and the control device for wireless communication through antenna 4 may be different units. In the case where control devices are provided individually, the control devices can be incorporated into one same enclosure 3. Alternatively, the control device for wireless communication can be installed in the proximity (same pole 40) of the control device that controls the lighting or the like of signal lamp apparatus 1.

Figure 2:
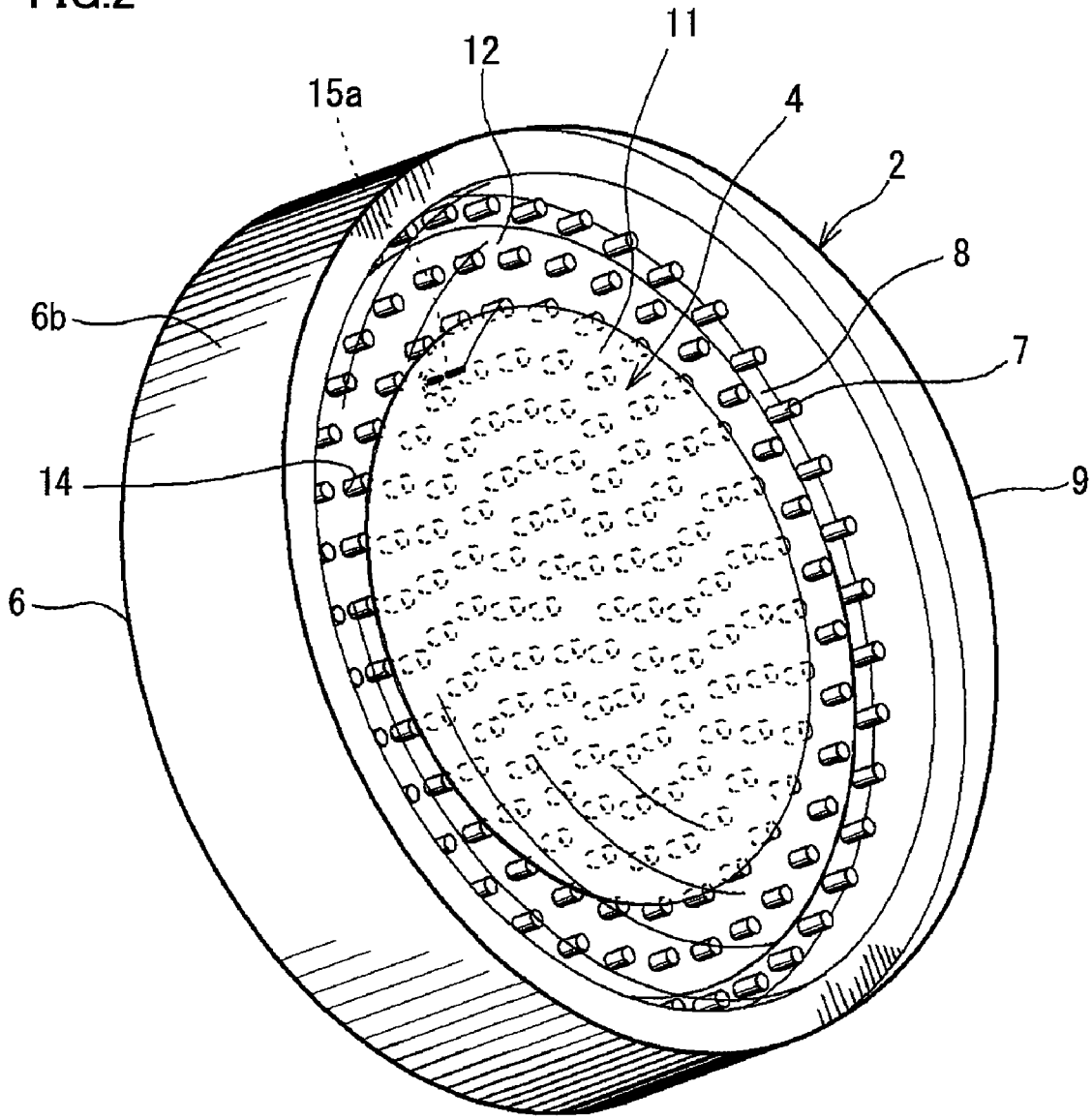
FIG. 2 is a perspective view of an optical unit.
Figure 3:
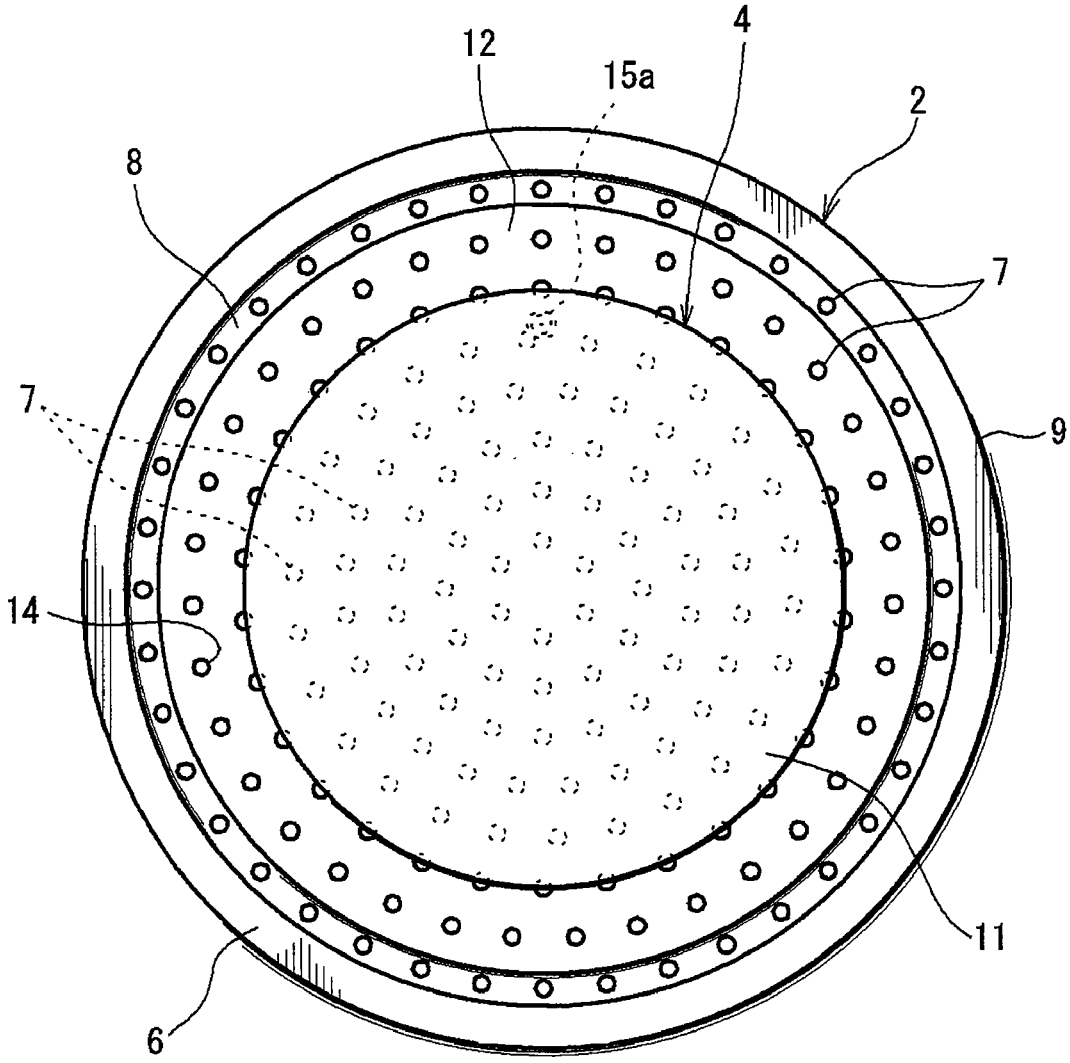
FIG. 3 is a front view of the optical unit.
Figure 4:
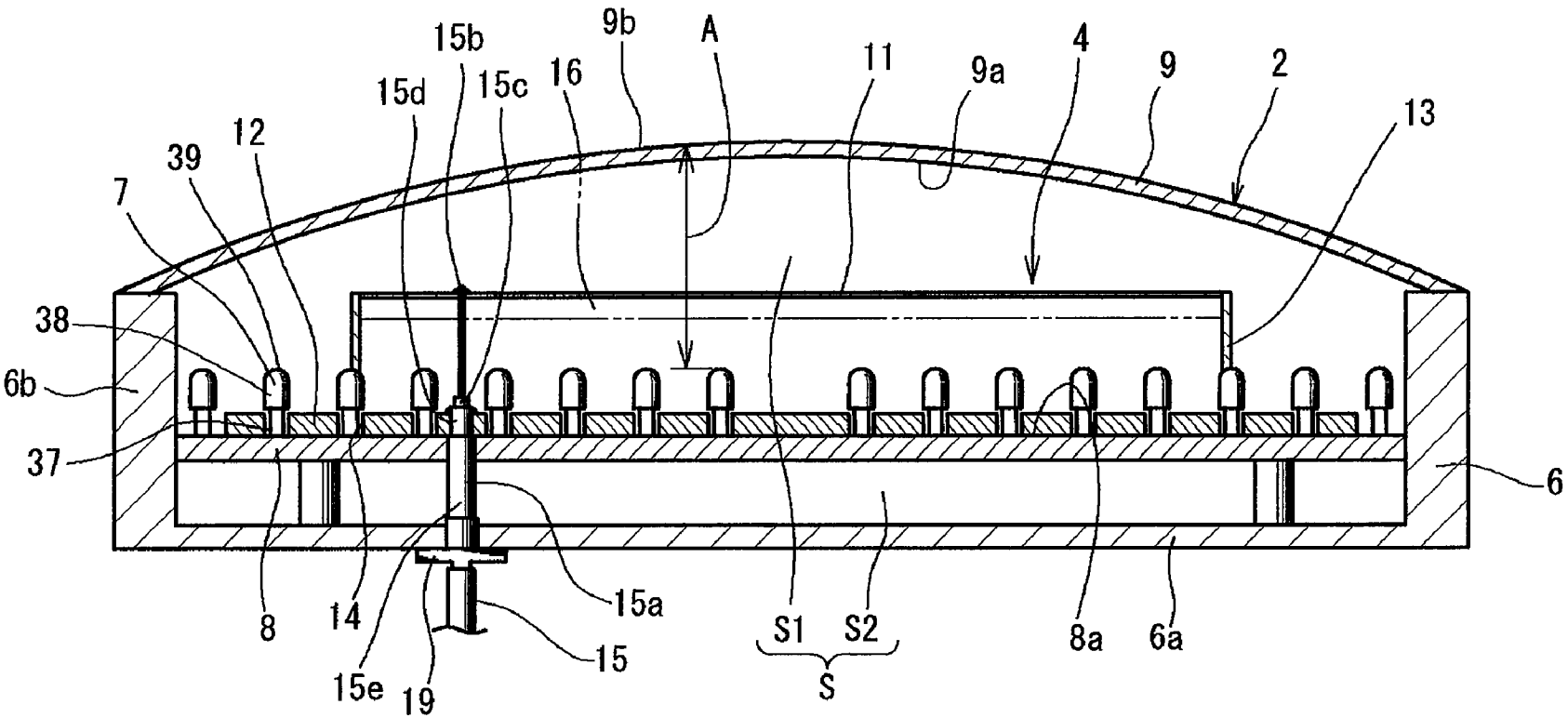
FIG. 4 is a sectional view of the optical unit.

FIGS. 2, 3 and 4 are a perspective view, front view, and cross sectional view, respectively, of one optical unit 2 (First Embodiment). Optical unit 2 includes a light emitting diode 7 (hereinafter, LED) as the light emitter, a substrate 8 having a plurality of LEDs 7 mounted on a front face 8*a*, a storage member 6, and a cover member 9. Substrate 8 has a wiring pattern formed at the backside, and is connected to a terminal 37 of LED 7. A plurality of LEDs 7 are arranged on substrate 8, spread in planar manner. LED 7 includes a lens unit 38 in which an LED element (not shown) is provided.

Storage member 6 is dish-shaped, and opened facing the front side, including a bottom (bottom wall) 6*a*, and a side (sidewall) 6*b* upright from the circumferential edge of bottom 6*a*. Cover member 9 is attached at the front of storage member 6 corresponding to the opening side. A storage cavity S is defined between storage member 6 and cover member 9. LED 7 and substrate 8 are accommodated in storage cavity S. Substrate 8 is secured to storage member 6. In storage cavity S, the section at the front of substrate 8 is a front cavity S, and the section at the rear of substrate 8 is a rear cavity S2.

Cover member 9 has visible-light transmittance (transparent to visible light), and covers a plurality of LEDs 7 at the front side. In optical unit 2, the front side is the light projecting side (the side corresponding to cover member 9), and the rear side is the bottom 6*a* side of storage member 6.

Antenna 4 is incorporated in optical unit 2. Antenna 4 is a patch antenna, including a patch element 11 and a ground element 12. FIG. 4 shows that patch element 11 and ground element 12 are stored in optical unit 2, i.e. storage cavity S.

Patch element 11 is formed as a circular plane, supported and secured by a support member 13 standing upright from substrate 8 towards the front side. Support member 13 is formed of an insulation member. Patch element 11 is situated in a range A from cover member 9 up to a leading end 39 of LED 7. In FIG. 4, cover member 9 has a rear face (back face) 9*a* corresponding to a concave-curved plane and a front face 9*b* corresponding to a convex-curved plane. Patch element 11 is provided apart from and behind rear face 9*a* of cover member 9. The outline of patch element 11 may be a rectangle instead of a circle (refer to FIG. 5). Although cover member 9 is represented having concave and convex curved faces, cover member 9 may be planar if signal lamp apparatus 1 is an LED lamp apparatus.

Ground element 12 is formed in a circular flat shape (sheet shape), and is attached to substrate 8 at the front face 8*a* side of substrate 8. For example, ground element 12 is secured to storage member 6 together with substrate 8 by a screw. Alternatively, ground element 12 may be supported and secured by support member 13 standing upright from substrate 8. Ground element 12 is located at the rear of patch element 11, and between substrate 8 and leading end 39 of LED 7 in the front-back direction. The outline form of ground element 12 is larger than the outline form of patch element 11.

Ground element 12 and patch element 11 are located in front cavity S1. Patch element 11 is situated in the range A from cover member 9 up to leading end 39 of LED 7. Ground element 12 is provided at the rear of patch element 11. Ground element 12 and patch element 11 are arranged facing each other in the front-back direction. The directivity of antenna 4 corresponds to the direction from signal lamp apparatus 1 towards the front side. The light projecting direction by optical unit 2 can be made to substantially match the directivity of antenna 4. Since signal lamp apparatus 1 is installed at a position of good visibility from the vehicle, a favorable communication state can be achieved with the in-vehicle device (not shown) by the directivity of antenna 4.

In order to utilize signal lamp apparatus 1 incorporating antenna 4 in the Intelligent Transport System (ITS) for road-vehicle wireless communication, the distance between ground element 12 and patch element 11 in the front-back direction is set to 10 to 40 mm when the working frequency is set at 715 MHz to 725 MHz. These values apply to the case where there is air between ground element 12 and patch element 11.

The distance between ground element 12 and patch element 11 in the front-back direction is preferably 20 to 30 mm when the diameter of the outer circumference of patch element 11 is 170 mm to 230 mm, and the hole size is 10 mm to 25 mm. When the hole size is 25 to 35 mm, the distance is preferably 25 to 35 mm. In other words, the distance between patch element 11 and ground element 12 is preferably increased and decreased in the front-back direction as the surface area of patch element 11 becomes smaller and larger, respectively.

Since patch element 11 can be arranged ahead of leading end 39 even if the distance from front face 8*a* of substrate 8 up to leading end 39 of LED 7 is small in the embodiment of FIG. 4, the distance between ground element 12 and patch element 11 in the front-back direction can readily be set to a desired value.

In the case where insulation between ground element 12 and patch element 11 is based on air alone, the distance therebetween is approximately 20 to 30 mm. A resin sheet (not shown) may be provided as an insulation member between ground element 12 and patch element 11. In this case, the surface area of patch element 11 and/or ground element 12 can be reduced although the distance therebetween may become slightly larger than the aforementioned value due to change in the permittivity therebetween. For the insulation member, polyethylene, polyethylene terephthalate, fluorine resin, epoxy glass, FRP, and polyacetal sheet can be cited.

Ground element 12 and patch element 11 may be disposed in parallel. However, for the sake of adjusting the antenna directivity, one or both of patch element 11 and ground element 12 may be disposed inclined with respect to substrate 8.

Signal lamp apparatus 1 is generally installed with substrate 8 per se tilted downwards in view of the visibility for the driver. Therefore, the directivity of antenna 4 will be in the downward direction by attaching patch element 11 and ground element parallel to substrate 8. Further, antenna 4 may be inclined further downwards than substrate 8 for the purpose of restricting the wireless communication area across the road and vehicle and/or increasing communication reliability.

Since ground element 12 and LED 7 are overlapping in position in the front-back direction, a plurality of holes 14 are formed at ground element 12 as the openings into which LEDs 7 (lead line of LED 7) are inserted. The arrangement of holes 14 matches the arrangement of LEDs 7, resulting in ground element 12 taking a mesh structure.

Therefore, LED 7 can be inserted into hole 14 of ground element 12 and allow ground element 12 to be situated at predetermined position to avoid interference of ground element 12 with LED 7. By this configuration, ground element 12 will be located behind leading end 39 of LED 7 to prevent the event of ground element 12 impeding forward light emittance (lightening) by LED 7.

In the case where a hole 14 is formed in the element as the opening, as illustrated, LED 7 can be arranged to avoid interference with the element. Alternatively, in the absence of a hole, the conductive body (conductor portion) of the element, for example, may be arranged in a meandering manner (arranging the conductive body as one continuous stroke) to position LED 7 so as to avoid interference with the element.

At storage member 6 (bottom 6*a*), a terminal 19 to connect a coaxial cable 15 for antenna 4 is attached. Coaxial cable 15 extending from control device 5 of FIG. 1 is connected to terminal 19. Coaxial cable 15*a* extending from terminal 19 towards rear cavity S2 is connected to antenna 4. Coaxial cable 15*a* includes an inner conductor 15*b*, an insulator 15*c*, an outer conductor 15*d*, and a cover 15*e*. Inner conductor 15*b* of coaxial cable 15*a* is connected to patch element 11. Outer conductor 15*d* is connected to ground element 12. Inner and outer conductors 15*b* and 15*d* can be connected and secured to each of elements 11 and 12 (conductive body of each element) by, but not limited to, solder.

A power supply cable (not shown) for LED 7 extending from control device 5 of FIG. 1 is connected to LED substrate 8 via a terminal (not shown) attached to bottom 6*a* of storage member 6.

Thus, patch element 11, ground element 12, and support member (attachment) 13 to situate patch element 11 in the range from cover member 9 up to leading end 39 of LED 7 constitute an antenna unit. This antenna unit is incorporated into signal lamp apparatus 1.

Figure 5:
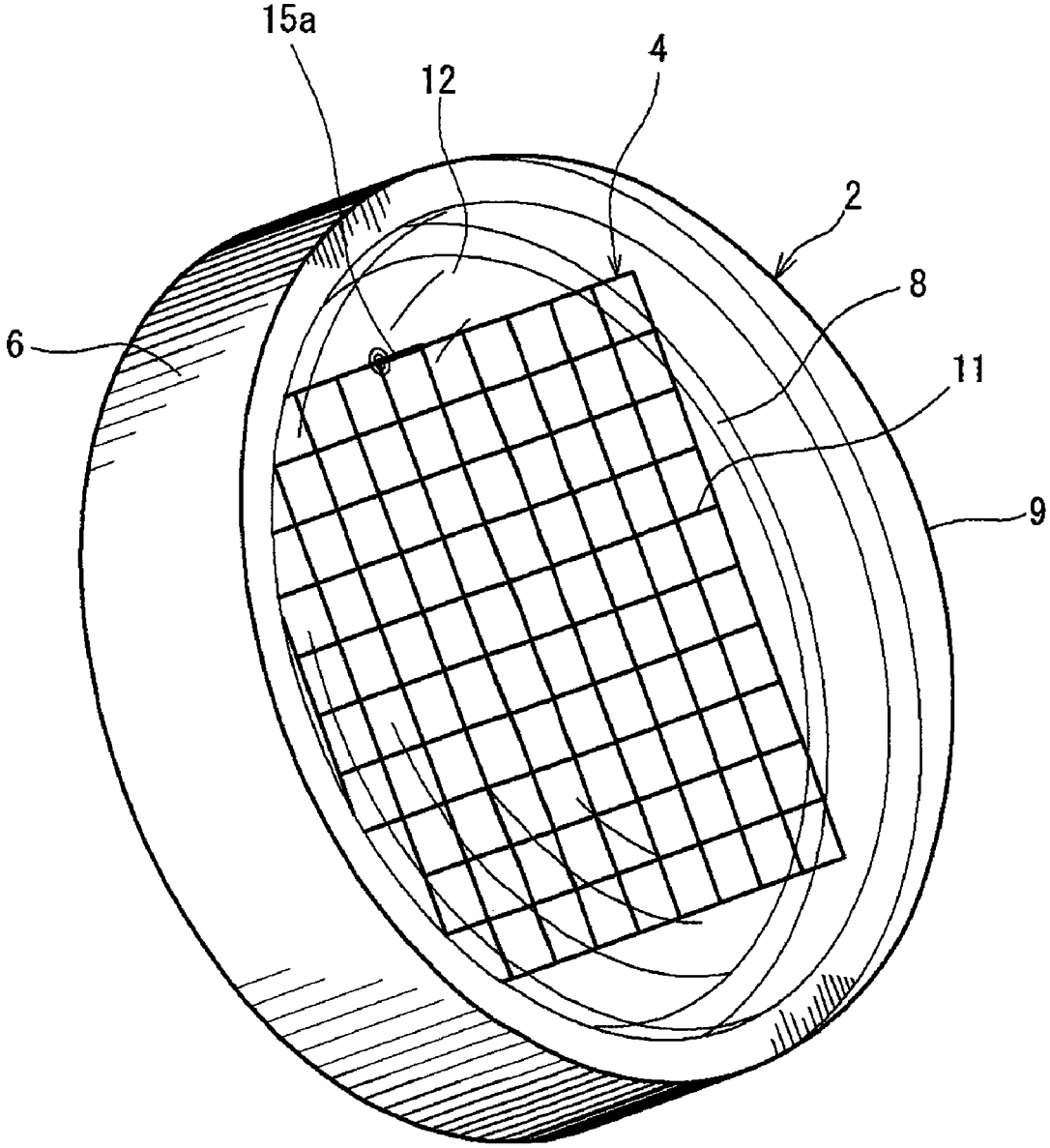
FIG. 5 is a perspective view of an optical unit in which an antenna is incorporated.

FIG. 5 is a perspective view of optical unit 2 incorporating antenna 4. For the sake of simplification, LED 7 is not illustrated. Patch element 11 of antenna 4 has a rectangular outline form.

Patch element 11 located frontward of leading end 39 of LED 7 has visible-light transmittance (transparent to visible light) in the thickness direction (front-back direction) of patch element 11 to avoid impeding the forward light projection of LED 7. Specifically, patch element 11 is formed of a conductive body with an opening formed for visible-light transmittance. As shown in FIG. 5, patch element 11 can exhibit visible-light transmittance by virtue of being formed as a conductive body of a mesh structure. The mesh structure of patch element 11 is achieved by electrical leads (weaving electrical leads).

In the case where patch element 11 is to take a mesh structure by electrical leads of 1 mm in diameter (width), for example, the electrical leads are woven vertically and horizontally at the pitch (mesh distance) of a predetermined value (for example, 20 mm) into a mesh metal element. The pitch of 20 mm corresponds to approximately 1/20 the wavelength. The working frequency is approximately 720 MHz and the wavelength is approximately 420 mm.

Figure 6:
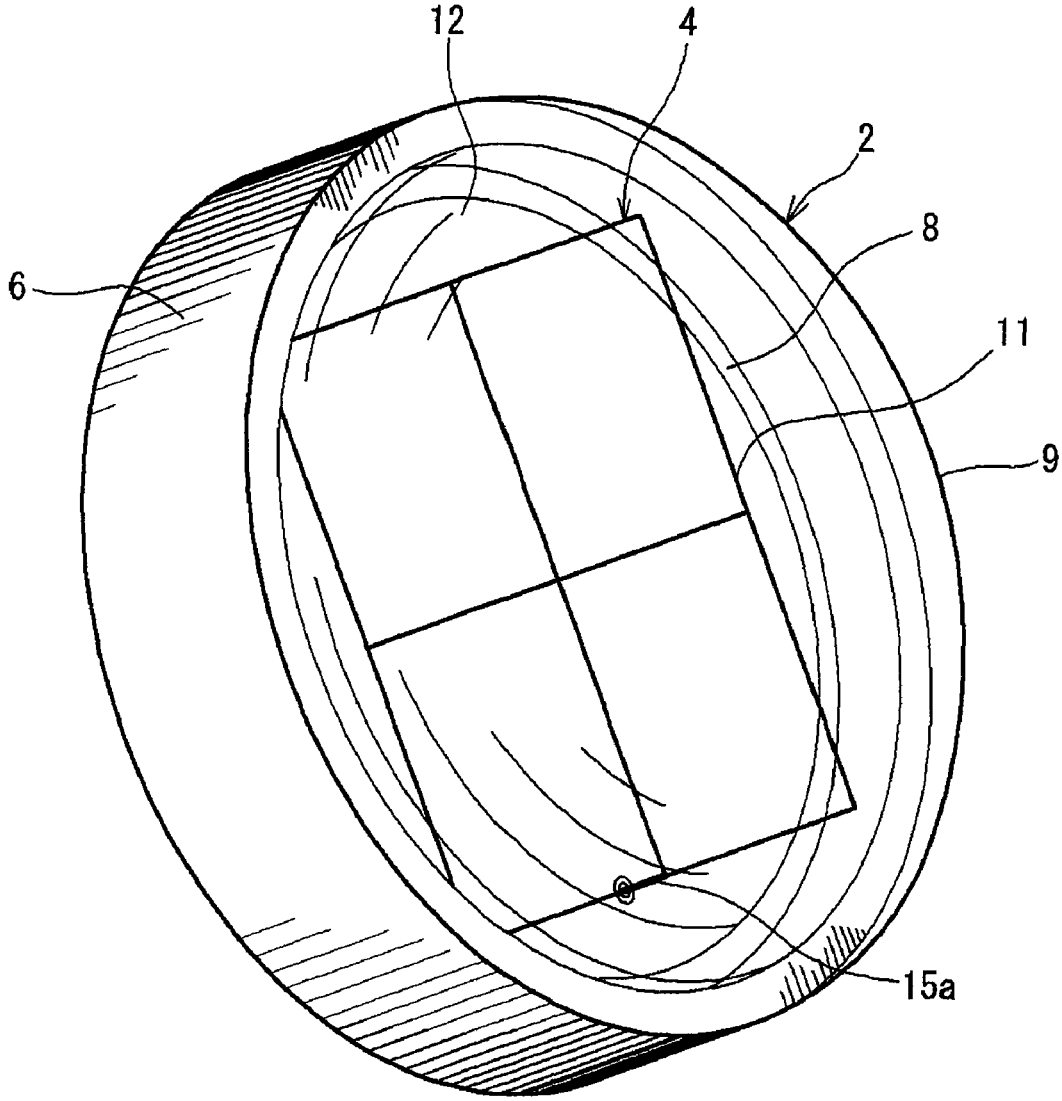
FIG. 6 is a perspective view of an optical unit in which an antenna of coarse mesh is incorporated.
Figure 7:
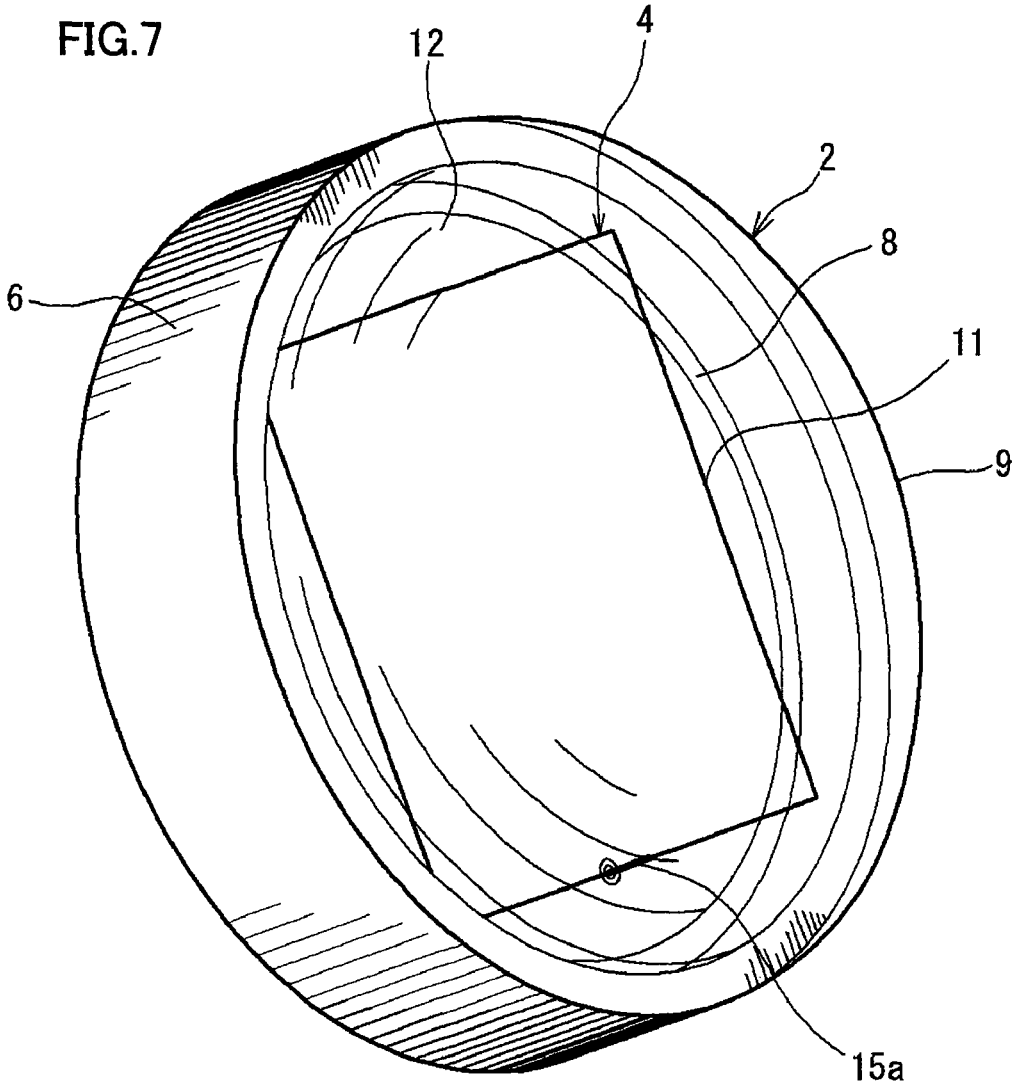
FIG. 7 is a perspective view of an optical unit in which an antenna with a patch element of a contour frame structure is incorporated.

The number of meshes of the patch element 11 (mesh roughness) is variable. FIG. 6 represents a rough mesh. Patch element 11 corresponds to a mesh metal element having the face divided into four. Alternatively, although not shown, a mesh metal element having the face divided into two, divided into three, and the like may be employed.

The mesh distance is preferably, but not particularly limited to, less than or equal to 1/5 the wavelength, particularly less than or equal to 1/10 the wavelength. A smaller mesh distance can accommodate higher frequency.

In order to ensure the strength of the electrical leads, the diameter (width) of the electrical lead is preferably greater than or equal to 0.5 mm, and preferably less than or equal to 2 mm to improve the light transmittance. In the case where the electrical lead is produced by deposition on a resin plate sheet, the width of the electrical lead may be less than 0.5 mm since the necessity to take strength into account is low.

Alternatively, patch element 11 may exhibit visible-light transmittance based on a conductive body taking a contour frame structure (frame configuration). This contour frame structure has an electrical lead provided only at the outline region of planar patch element 11.

In the case where patch element 11 takes a mesh structure or contour frame structure, meshes may be formed by a metal film (metal membrane) at the surface of the sheet member instead of utilizing the above-described electrical leads. In this case, sheet member 16 of visible-light transmittance is provided between cover member 9 and leading end 39 of LED 7, as indicated by alternate long and two-short dash lines in FIG. 4. Patch element 11 of a mesh structure or contour frame structure is formed at the top surface or back side (the surface in the drawing) of sheet member 16. Sheet member 16 is attached to support member 13.

Sheet member 16 is, for example, a transparent resin sheet. Sheet member 16 is preferably formed of a material that transmits visible light sufficiently. For example, polycarbonate, acryl, polyethylene terephthalate, glass, and the like can be cited from the standpoint of superior strength, even if thin, and an economical aspect.

As a specific example of employing sheet member 16, a fine mesh based on electrical leads having a line width of 10 provided at the pitch (mesh distance) of 100 μm, is provided at the face of sheet member 16. In the case where sheet member 16 is formed in fine meshes, the line width is preferably at least 1 μm and not more than 50 μm, and the pitch is preferably at least 50 μm and not more than 1000 μm.

The mesh shape is not limited to a rectangle, as shown, and may be a triangle or a honeycomb shape. Alternatively, the form of radials (the shape of a spider web) or the like may be employed as a whole.

Patch element 11 can be formed from a conductor membrane (metal membrane) having visible-light transmittance for patch element 11 to exhibit visible-light transmittance. Formation of this conductor membrane at sheet member 16 allows patch element 11 to be formed thin and in a predetermined shape. In this case, the thickness of the conductor membrane is preferably set to at least 1 μm and not more than 100 μm. Accordingly, patch element 11 can exhibit visible-light transmittance.

There are many methods to form patch element 11 at sheet member 16, as set forth below. Patch element 11 may be formed individually, which is attached to sheet member 16. In this case, patch element 11 is attached to sheet member 16 by an adhesive member (an adhesive tape). Alternatively, patch element 11 may be formed by applying metal deposition to sheet member 16. Alternatively, patch element 11 may be formed by printing onto sheet member 16. Further alternatively, a metal coat may be applied on sheet member 16 to form patch element 11.

Ground element 12 is formed of a metal sheet. Patch element 11 and ground element 12 are preferably formed of a conductive material having high conductivity. For example, copper, a copper alloy such as brass, and aluminium are preferable. Steel, nickel, or other metals may also be employed. Since a current of high frequency flows at the surface, an element formed by metal deposition or applying a metal coat (a gold or silver coat) on sheet member 16 may be employed (not shown).

Storage member 6 of optical unit 2 is formed of a steel sheet, or made of aluminium or resin. Cover member 9 is a lens made of glass or resin.

Although cover member 9 is formed of concave and convex curved planes in the present embodiment, cover member 9 may be formed as a flat sheet such as flat glass instead of a lens if signal lamp apparatus 1 is an LED lamp apparatus.

Figure 8:
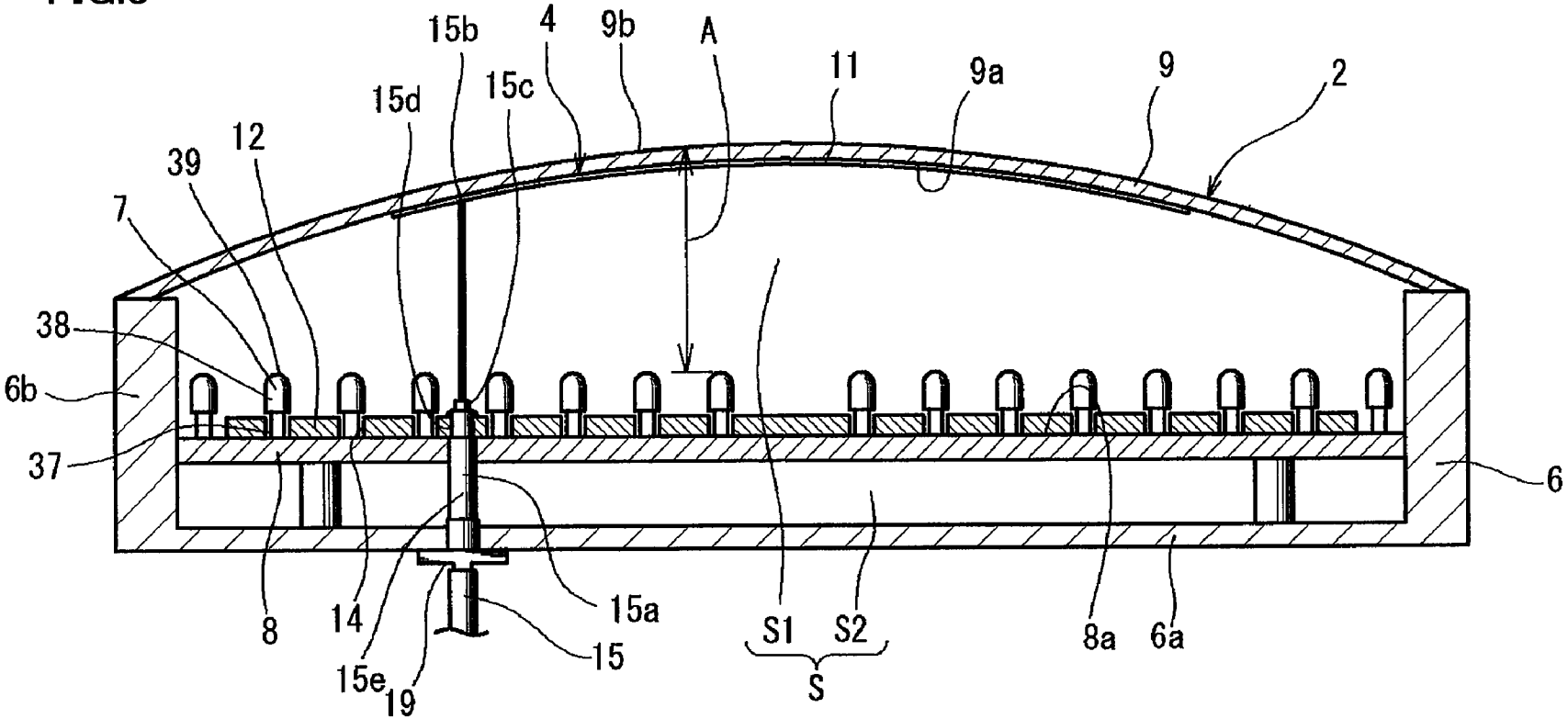
FIG. 8 is a sectional view of an optical unit and antenna in a lamp apparatus according to another embodiment.

Another embodiment (Second Embodiment) of an antenna-embedded signal lamp apparatus having antenna 4 incorporated in an optical unit 2 will be described. FIG. 8 is a sectional view of optical unit 2 and antenna 4 incorporated in the signal lamp apparatus. Likewise with the previous embodiment, the signal lamp apparatus includes optical unit 2 and antenna 4. Optical unit 2 includes substrate 8 having LEDs 7 mounted, and a cover member 9 of visible-light transmittance, spread over LEDs 7 at the front. Antenna 4 includes patch element 11 situated in a range A from cover member 9 up to leading end 39 of LED 7, and ground element 12 at the rear of patch element 11. Patch element 11 has visible-light transmittance.

The difference between the embodiment of FIG. 8 and the previous embodiment (FIG. 4) lies in the attachment of patch element 11. The remaining configuration is similar. Patch element 11 is formed at a rear face 9*a* of cover member 9. In other words, patch element 11 is formed in contact with rear face 9*a* of cover member 9. In this case, patch element 11 takes a curved shape along the concave-curved face of cover member 9.

Figure 9:
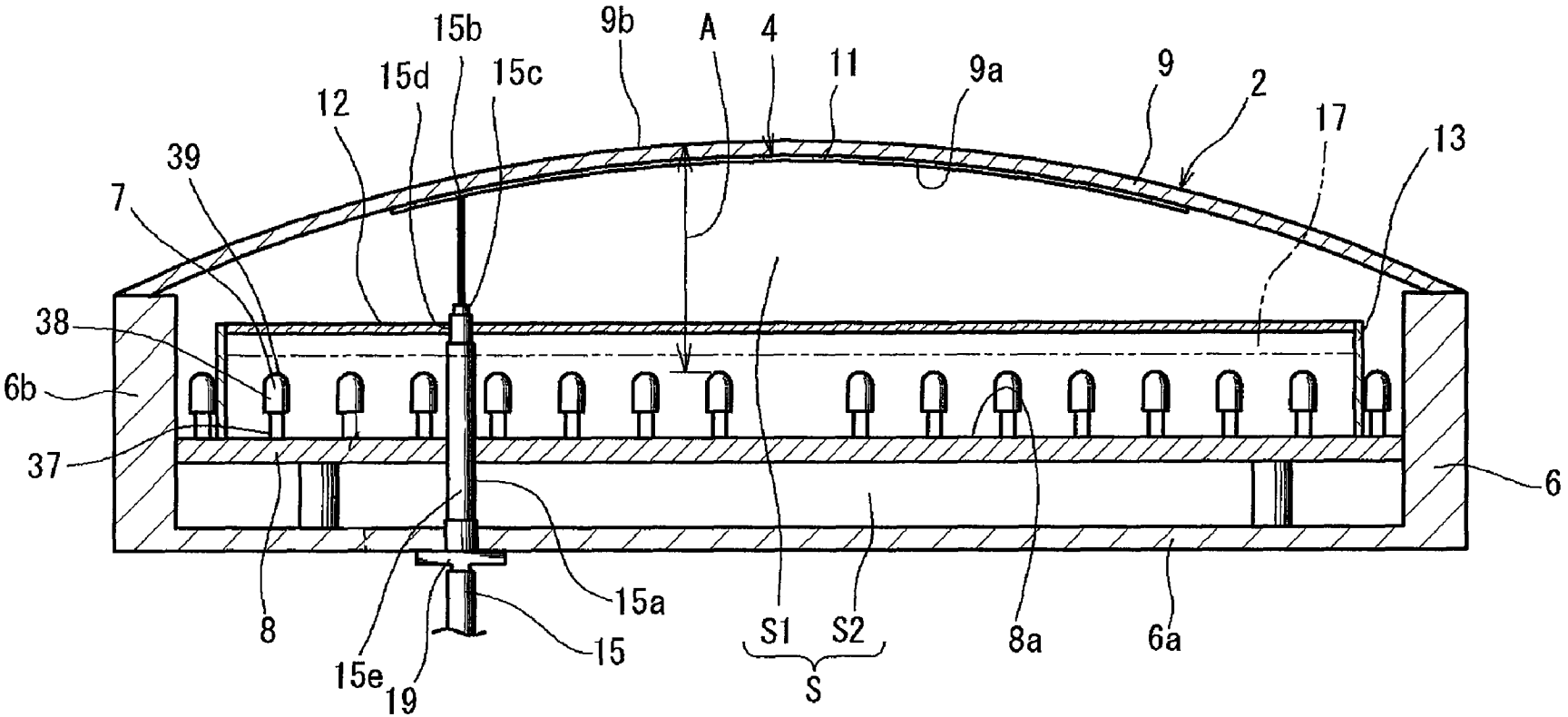
FIG. 9 is a sectional view of an optical unit and antenna in a lamp apparatus according to another embodiment.

Another embodiment (Third Embodiment) of an antenna-embedded signal lamp apparatus will be described. FIG. 9 is a sectional view of optical unit 2 and antenna 4 incorporated in the signal lamp apparatus. The difference between the embodiment of FIG. 9 and the prior embodiment (FIG. 4) lies in the attachment of patch element 11 and the location of ground element 12. The attachment of patch element 11 is identical to that shown in FIG. 8. Patch element 11 is formed at rear face 9*a* of cover member 9. Ground element 12 is provided frontward of leading end 39 of LED 7.

Ground element 12 has visible-light transmittance also in this case. Ground element 12 exhibits visible-light transmittance by taking a configuration similar to that of patch element 11. Namely, ground element 12 is constituted of a conductive body based on a mesh structure or contour frame structure. Ground element 12 is also constituted of a conductor membrane having visible-light transmittance.

Likewise with the case of FIG. 4 where patch element 11 is formed at sheet member 16, optical unit 2 of FIG. 9 includes a sheet member 17 of visible-light transmittance (the alternate long and two-short dash lines in FIG. 9). Ground element 12 is formed at the front face or back face of sheet member 17. The method of forming ground element 12 with respect to sheet member 17 is similar to that of patch element 11.

Although ground element 12 is provided frontward of leading end 39 of LED 7 in the embodiment of FIG. 9, the event of forward light emittance (lightening) from leading end 39 of LED 7 being impeded can be prevented since ground element 12 exhibits visible-light transmittance. This eliminates the need of hole 14 required for ground element 12 in FIG. 4.

As another embodiment, the circuit wiring (line pattern) formed at LED substrate 8 may also be used (commonly shared) as the ground element.

Figure 10:
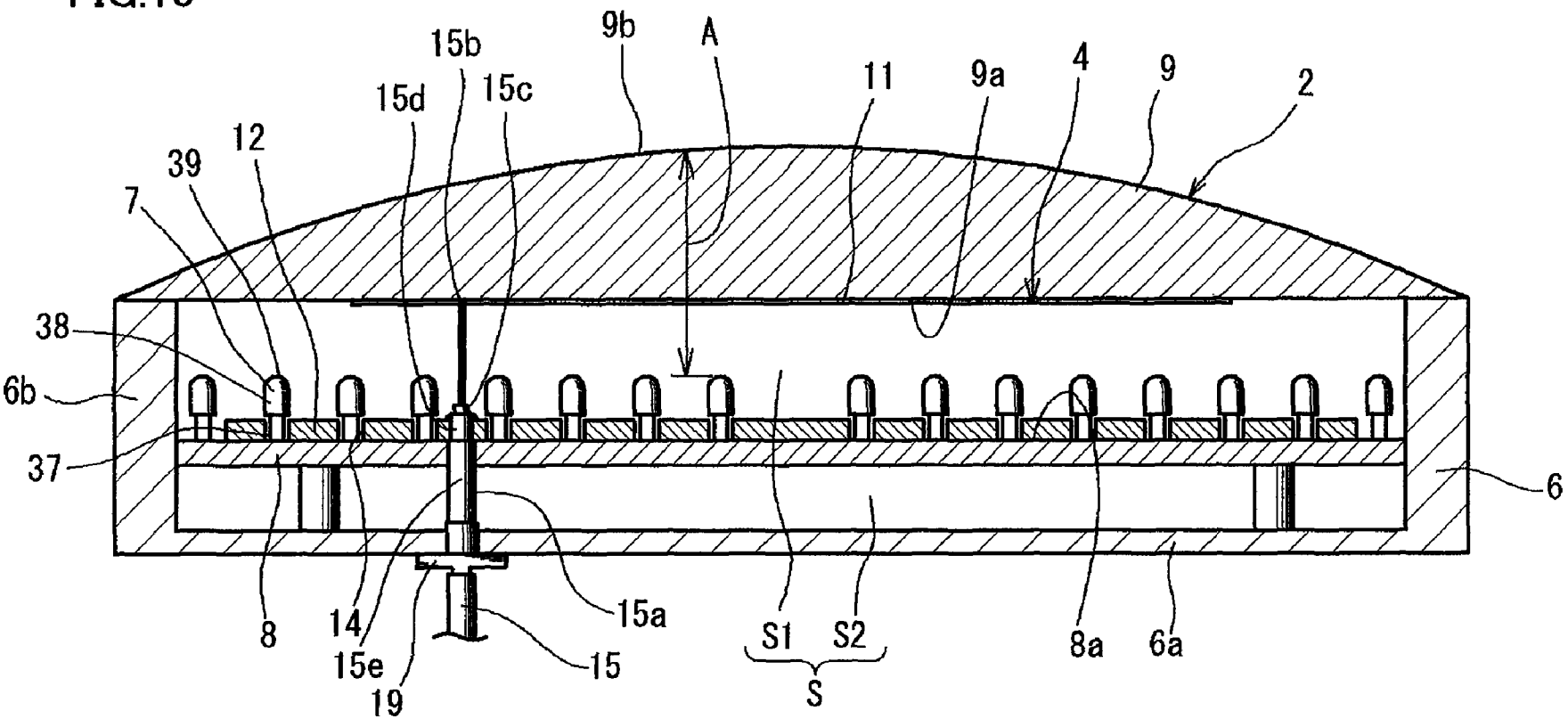
FIG. 10 is a sectional view of an optical unit and antenna in a lamp apparatus according to a further embodiment.

Still another embodiment (Fourth Embodiment) of an antenna-embedded signal lamp apparatus will be described. FIG. 10 is a sectional view of optical unit 2 and antenna 4 incorporated in the signal lamp apparatus.

The difference between the embodiment of FIG. 10 and the prior embodiment of FIG. 4 lies in the form of cover member 9 and the attachment of patch element 11. The remaining configuration is similar. Referring to FIG. 10, cover member 9 has a convex-curved front face 9*b* and a flat rear face 9*a*. Patch element 11 is formed at rear face 9*a* of cover member 9. Namely, patch element 11 is formed in contact with flat rear face 9*a* of cover member 9.

Although not shown, cover member 9 of FIG. 10 may take a double layer configuration including a front layer portion and a back layer portion located at the rear of the front layer portion with patch element 11 provided between the front layer portion and back layer portion, and ground element 12 provided at the rear side of the back layer portion.

In each of the embodiments set forth above, patch element 11 and ground element 12 are provided in front cavity S1 of cavity S.

Further, although patch element 11 is provided at rear face 9*a* of cover member 9 in the embodiments of FIGS. 8, 9 and 10, patch element 11 may be provided at front surface 9*b* instead (not shown). In this case, a cover sheet for protection (not shown), exhibiting visible-light transmittance, is preferably provided above patch element 11 formed at surface 9*b*.

In the case where patch element 11 is provided at rear face 9*a* (or front face 9*b*) of cover member 9 as set forth above, formation of a thin patch element 11 in a predetermined shape is facilitated, likewise with the formation of patch element 11 at sheet member 16 in the embodiment of FIG. 4. Further, an additional member for the purpose of forming patch element 11 is not required. The method of forming of patch element 11 and ground element 12 at the face of cover member 9 is similar to that of forming patch element 11 at sheet member 16.

Figure 11:
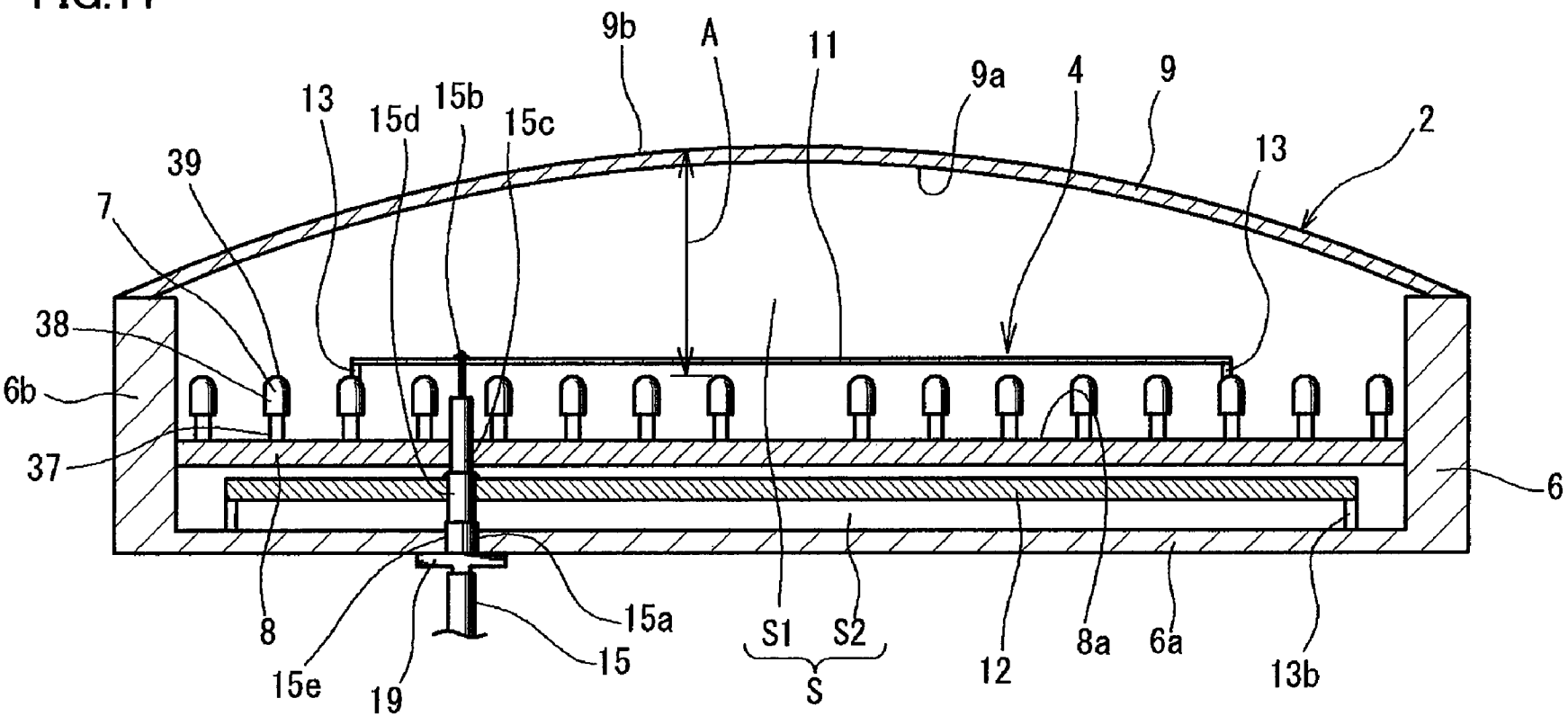
FIG. 11 is a sectional view of an optical unit and antenna in a lamp apparatus according to a further embodiment.

Still another embodiment (Fifth Embodiment) of an antenna-embedded signal lamp apparatus will be described. FIG. 11 is a sectional view of optical unit 2 and antenna 4 incorporated in the signal lamp apparatus. The difference between the embodiment of FIG. 11 and the embodiment of FIG. 4 lies in the position of ground element 12. The remaining configuration is similar. Ground element 12 is provided at the rear of substrate 8. Ground element 12 is supported by and secured to a second support member 13*b* provided at the rear of substrate 8.

Patch element 11 is provided in front cavity S1, frontward of leading end 39 of LED 7, whereas ground element 12 is provided in rear cavity S2. The present embodiment is advantageous in that a predetermined wide distance can be provided between patch element 11 and ground element 12 in the front-back direction to achieve patch antenna 4 having the desired performance. In other words, ensuring a distance of a predetermined value (10 to 40 mm) between ground element 12 and patch element 11 in the front-back direction for the purpose of achieving the usable frequency of 715 MHz-725 MHz is facilitated, as described above.

Figure 12:
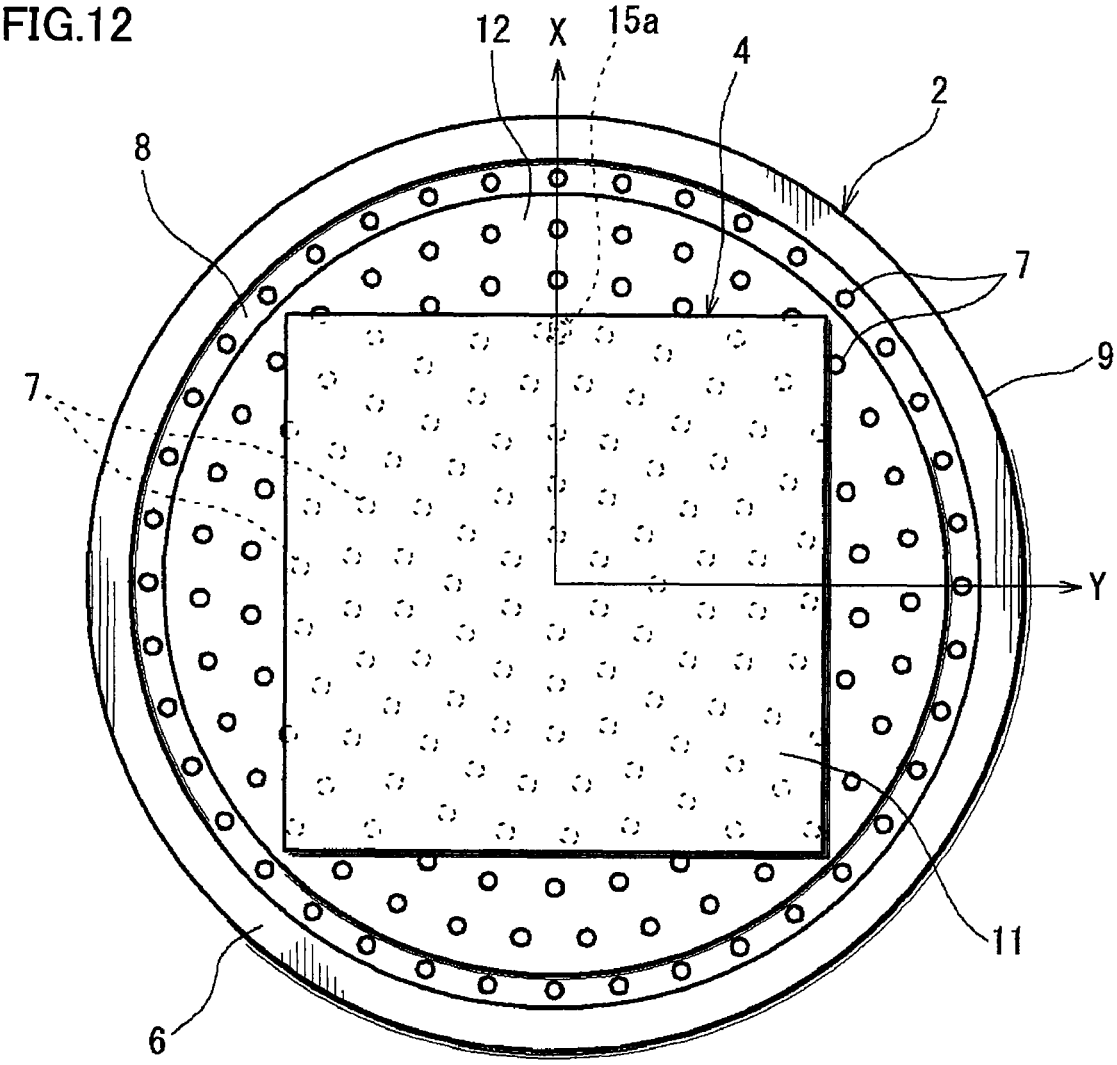
FIG. 12 is a front view of an optical unit and antenna in another lamp apparatus.

FIG. 12 is a front view of optical unit 2 and antenna 4 incorporated in another antenna-embedded signal lamp apparatus (Sixth Embodiment). FIG. 12 shows patch element 11 taking a rectangular outline form. Patch element 11 has one pair of opposite sides corresponding to the horizontal direction and the other pair of opposite sides corresponding to the vertical direction. Since the feeding point towards antenna 4 (patch element 11) through coaxial cable 15*a* is located at the center region in the horizontal direction at the top edge of antenna 4 (or at the center region in the horizontal direction at the bottom edge: on the X axis), the electric field plane is set as vertical polarization (polarization in the X-axis direction). Although not shown, the electric field plane can be set as horizontal polarization (polarization in the Y axis direction) by situating the feeding point of antenna 4 (patch element 11) through coaxial cable 15*a* at the right side edge (or left side edge) at the center region in the vertical direction (on the Y axis).

Figure 13:
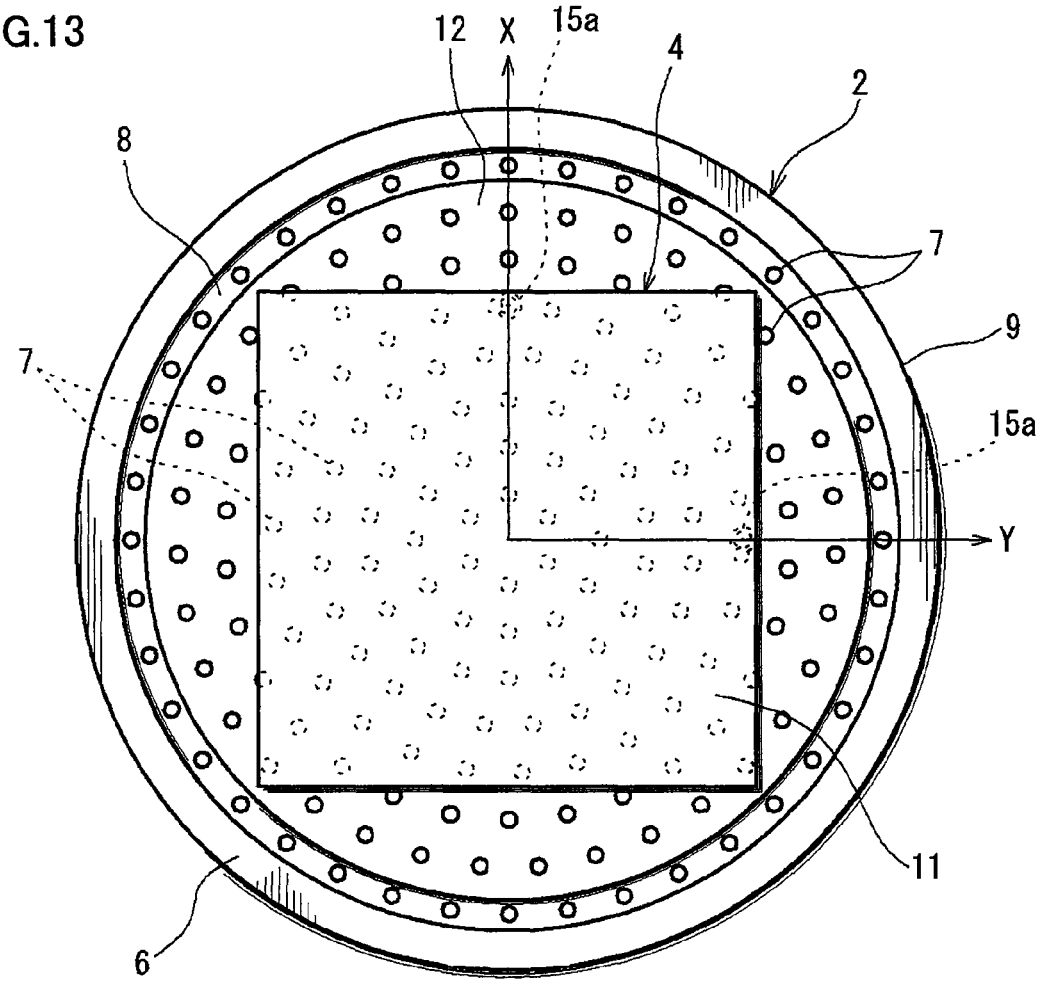
FIG. 13 is a front view of an optical unit and antenna according to still another embodiment.

FIG. 13 is a front view of another embodiment (Seventh Embodiment). Antenna 4 has a patch element 11 of a rectangular outline form, and includes two feeding points (coaxial cable 15*a*) on the X axis and Y axis. In this case, a dual polarization patch antenna of vertical polarization and horizontal polarization is established. Further, a circular polarized antenna can be established by applying a signal of equal amplitude and 90 degrees out of phase towards the two coaxial cables 15*a*. Alternatively, a configuration of dynamically switching between these antennas by a switch or the like may be employed.

Figure 14:
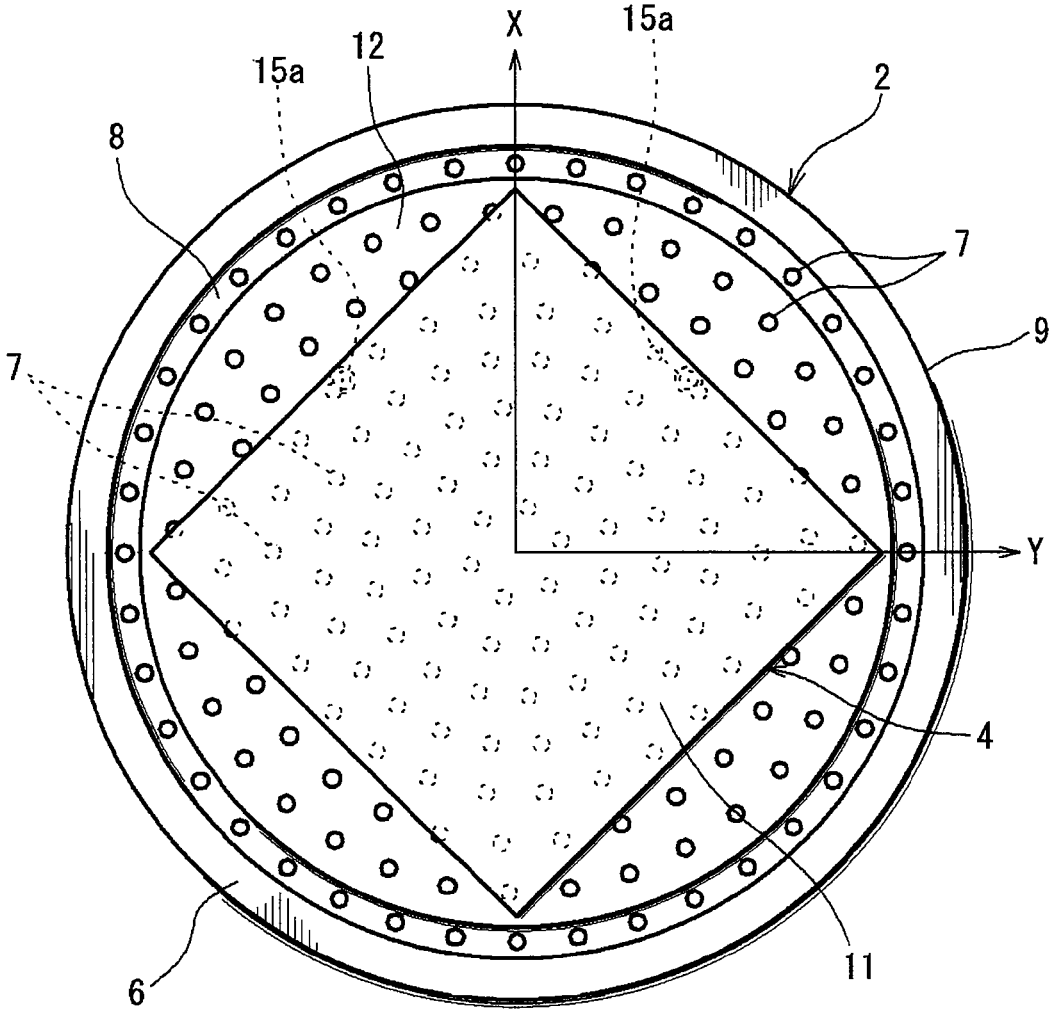
FIG. 14 is a front view of an optical unit and antenna according to still another embodiment.

FIG. 14 is a front view of still another embodiment (Eighth Embodiment). Antenna 4 has a patch element 11 of a rectangular outline form. Patch element 11 is provided with one pair of opposite sides and the other pair of opposite sides being inclined. A feeding point (coaxial cable 15*a*) is located at each center region of two adjacent sides. In this case, a dual polarization patch antenna of +45° polarization and −45° polarization is established. By applying a signal of equal amplitude and 90 degrees out of phase towards the two coaxial cables 15*a* in the present embodiment, a circular polarized antenna is established.

Figure 15:
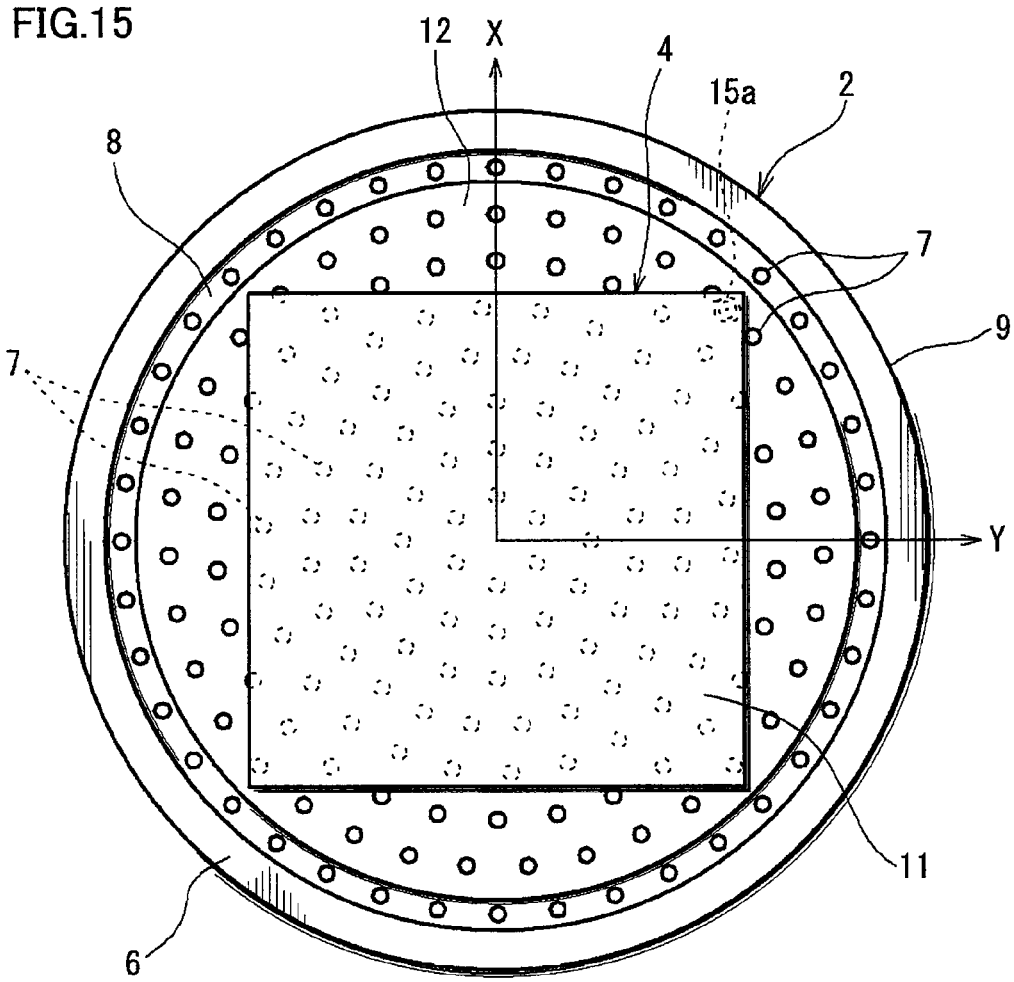
FIG. 15 is a front view of an optical unit and antenna according to still another embodiment.

FIG. 15 is a front view of still another embodiment (Ninth Embodiment). Patch element 11 of antenna 4 taking a rectangular outline form has one pair of opposite sides corresponding to the horizontal direction and the other pair of opposite sides corresponding to the vertical direction. One feeding point (coaxial cable 15*a*) is located at the corner of patch element 11 (on the diagonal). In this case, a circular polarized antenna is established.

Figure 16:
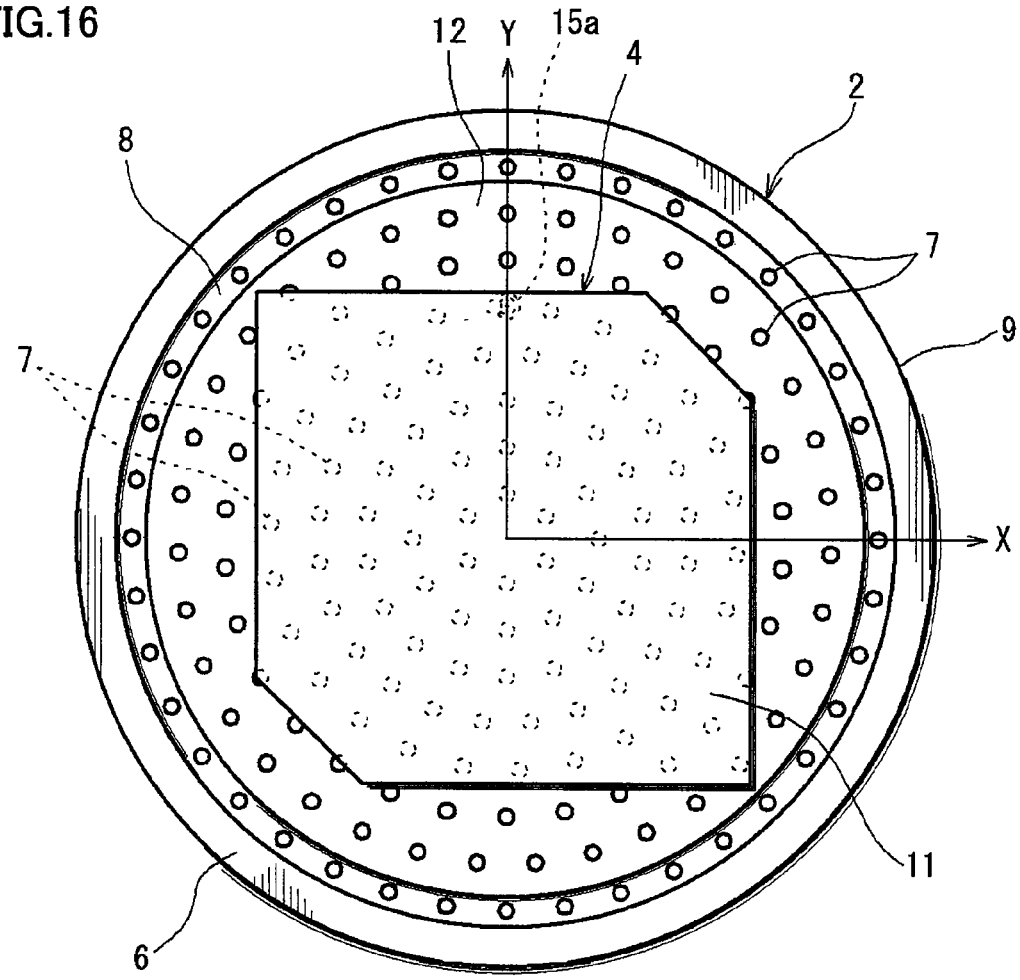
FIG. 16 is a front view of an optical unit and antenna according to still another embodiment.

FIG. 16 is a front view of still another embodiment (Tenth Embodiment). The outline form of patch element 11 in antenna 4 corresponds to a rectangle having a pair of diagonal corners cut away linearly (in a hexagonal shape). The feeding point towards patch element 11 through coaxial cable 15*a* is located on the Y axis. Accordingly, a circular polarized antenna is established.

Figure 17:
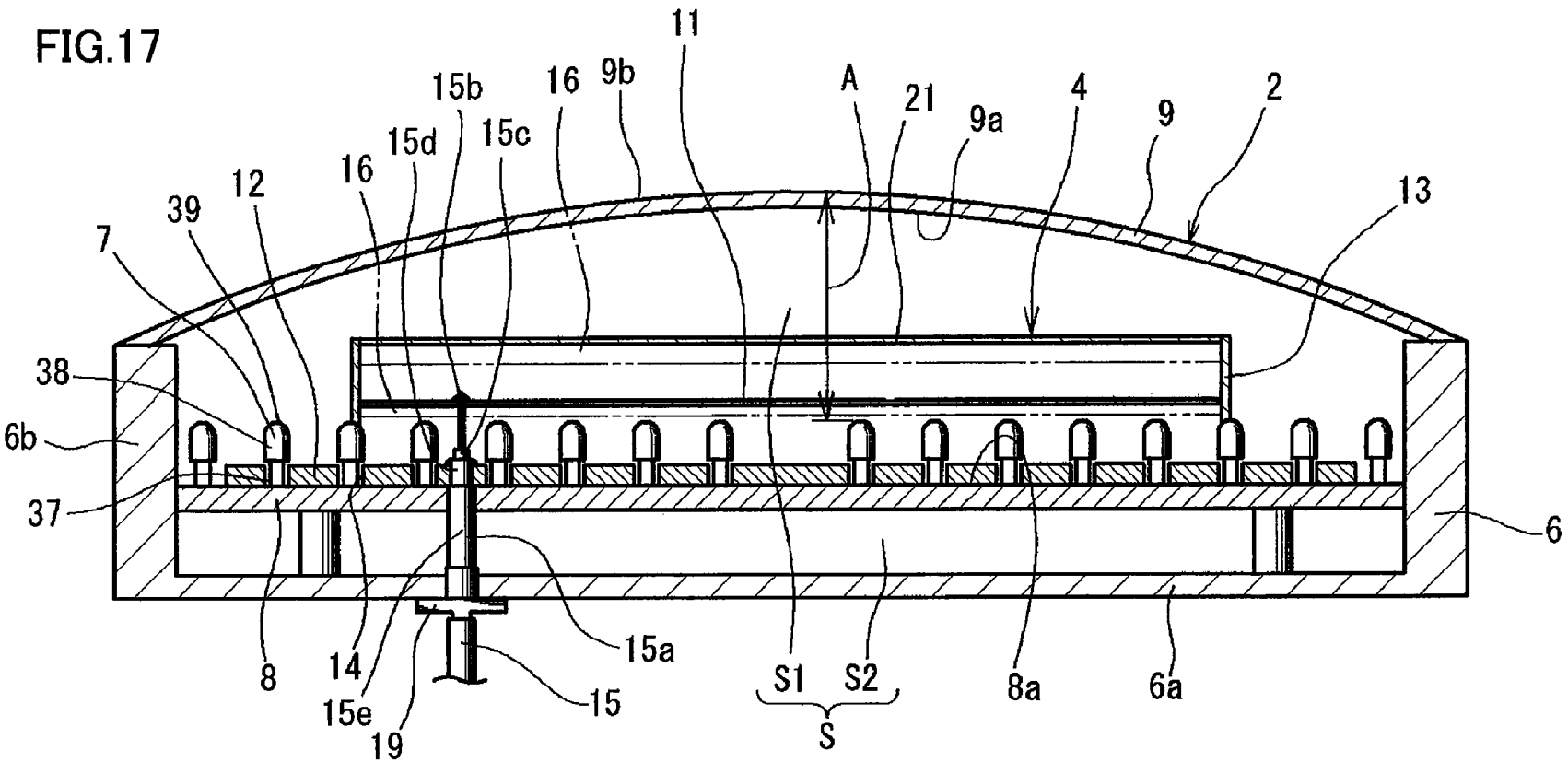
FIG. 17 is a front view of an optical unit and antenna according to still another embodiment.

FIG. 17 is a sectional view of optical unit 2 and antenna 4 according to still another embodiment (Eleventh Embodiment). In the embodiment of FIG. 17, antenna 4 includes, in addition to ground element 12 and patch element 11 (first patch element 11), a second patch element 21. Second patch element 21 is situated between first patch element 11 and cover member 9. Second patch element 21 is supported by and secured to support member 13 at a predetermined position. Second patch element 21 may be provided at a rear face 9*a* or front face 9*b* of cover member 9 (not shown). This second patch element 21 is incorporated in optical unit 2.

First and second patch elements 11 and 21 are provided facing each other in the front-back direction. First patch element 11 is a feed element fed by coaxial cable 15*a* whereas second patch element 21 is a non-feed element not fed by coaxial cable 15*a*. By forming patch elements in two layers, frequency characteristics of a wide band can be obtained.

As another embodiment, the circuit wiring (line pattern) formed at substrate 8 of LED 7 may be used as the ground element. In other words, substrate 8 may be commonly used as the line for LED 7 and as ground element 12.

According to each of the embodiments set forth above, antenna 4 including patch element 11 and ground element 12 are incorporated in optical unit 2. Signal lamp apparatus 1 of FIG. 1 includes three optical units 2. Each optical unit 2 has an antenna 4 incorporated. Accordingly, antenna 4 can be installed in signal lamp apparatus 1 inconspicuously to avoid spoiling the aesthetic view of the street.

Further, since antenna 4 is incorporated in optical unit 2 of signal lamp apparatus 1, a pole dedicated to installing an antenna is dispensable. Further, although patch element 11 is situated frontward of leading end 39 of LED 7, the event of impeding forward light emittance (lightening) by LED 7 can be prevented since patch element 11 exhibits visible-light transmittance.

Further, since antenna 4 is not exposed (protruding), the expected wind load on antenna 4 does not have to be taken into account in the design of pole 40 and arm 41 (FIG. 1) for the installation of signal lamp apparatus 1. Further, anti-rust and anti-dust measures for antenna 4 do not have to be taken into account.

Further, since traffic signal lamp apparatus 1 is installed on the road in consideration of the visibility by the driver of a vehicle, a favorable line of sight state for wireless communication between antenna 4 and an in-vehicle device can be obtained inherently by installing the signal lamp apparatus of each embodiment at a predetermined position on the road. Thus, antenna 4 incorporated in optical unit 2 of signal lamp apparatus 1 can be utilized in the Intelligent Transport System (ITS) for road-vehicle wireless communication. Accordingly, a favorable communication state can be achieved.

The VSWR property and directivity of an antenna-embedded optical unit 2 model with a rectangular patch element 11 (FIG. 5) corresponding to an entire configuration shown in FIGS. 2 to 4 will be described.

Figure 18:
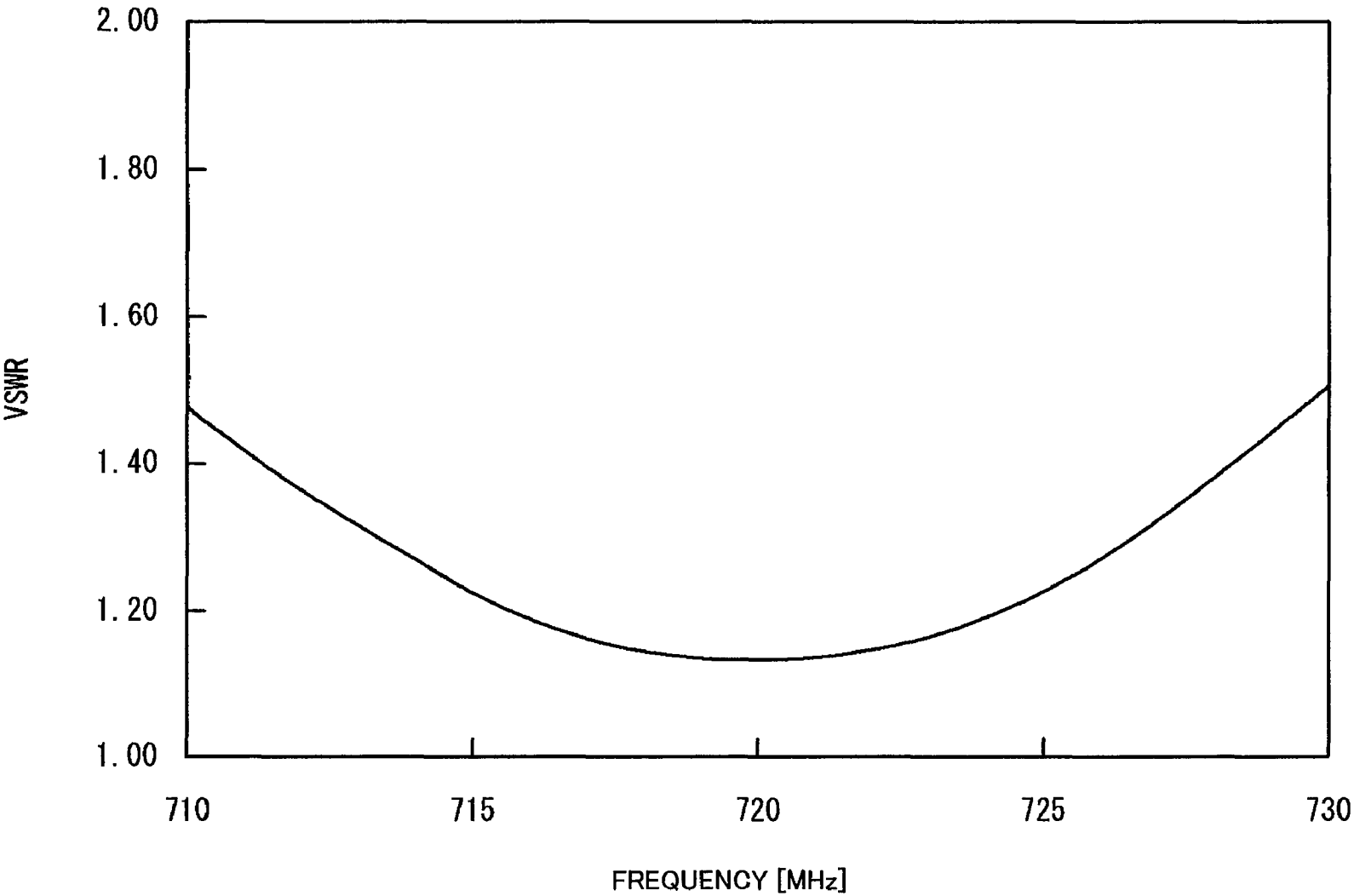
FIG. 18 is a graph representing the VSWR by an antenna with a patch element taking a mesh structure.

FIG. 18 is a graph representing the VSWR when the frequency is tuned to 720 MHz in the present model. The present model is based on the terms that an LED is not provided at substrate 8, and hole 14 is not formed in ground element 12. The VSWR property and directivity by the present model are equivalent to those of an antenna 4 having a hole 14 formed in ground element 12.

Description will be based on the reference to FIG. 5. In optical unit 2, patch element 11 corresponds to a rectangle having the length of 201 mm and 173 mm in the horizontal direction and vertical direction, respectively, and takes a mesh structure. The mesh structure is based on a copper wire having a diameter (width) of 1 mm, woven at the pitch (mesh distance) of 20 mm in the horizontal direction and 21.5 mm in the vertical direction. Patch element 11 is a mesh-like metal element. Ground element 12 is a circular copper plate (ϕ 295 mm), concentric with the centerline of optical unit 2 taking a circular shape when viewed from the front. The feeding point of coaxial cable 15*a* is located at the top edge and at the center region in the horizontal direction (the site 85 mm distant from the centerline in the upward direction). Ground element 12 is located on substrate 8. The distance between patch element 11 and ground element 12 in the front-back direction is 23.3 mm. Substrate 8 is formed of epoxy glass. Cover member 9 is formed of polycarbonate, having the thickness of 2 mm, and is a lens having the spherical shape of 500 mm in radius.

As shown in FIG. 18, in antenna-embedded optical unit 2, the VSWR with the frequency between 715 MHz to 725 MHz is less than 1.4, which is favorable.

Figure 19:
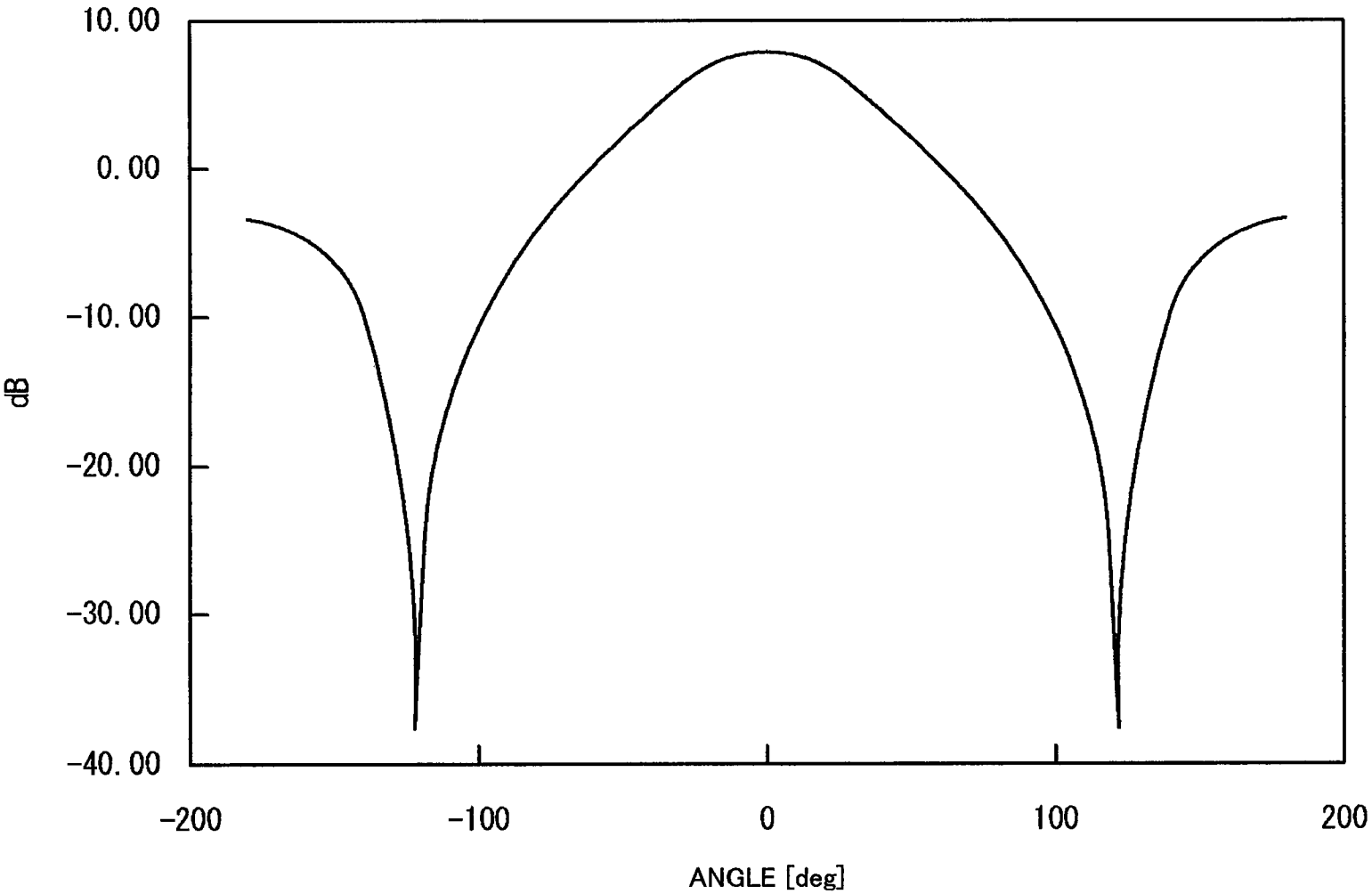
FIG. 19 is a graph representing the directivity of the horizontal plane.
Figure 20:
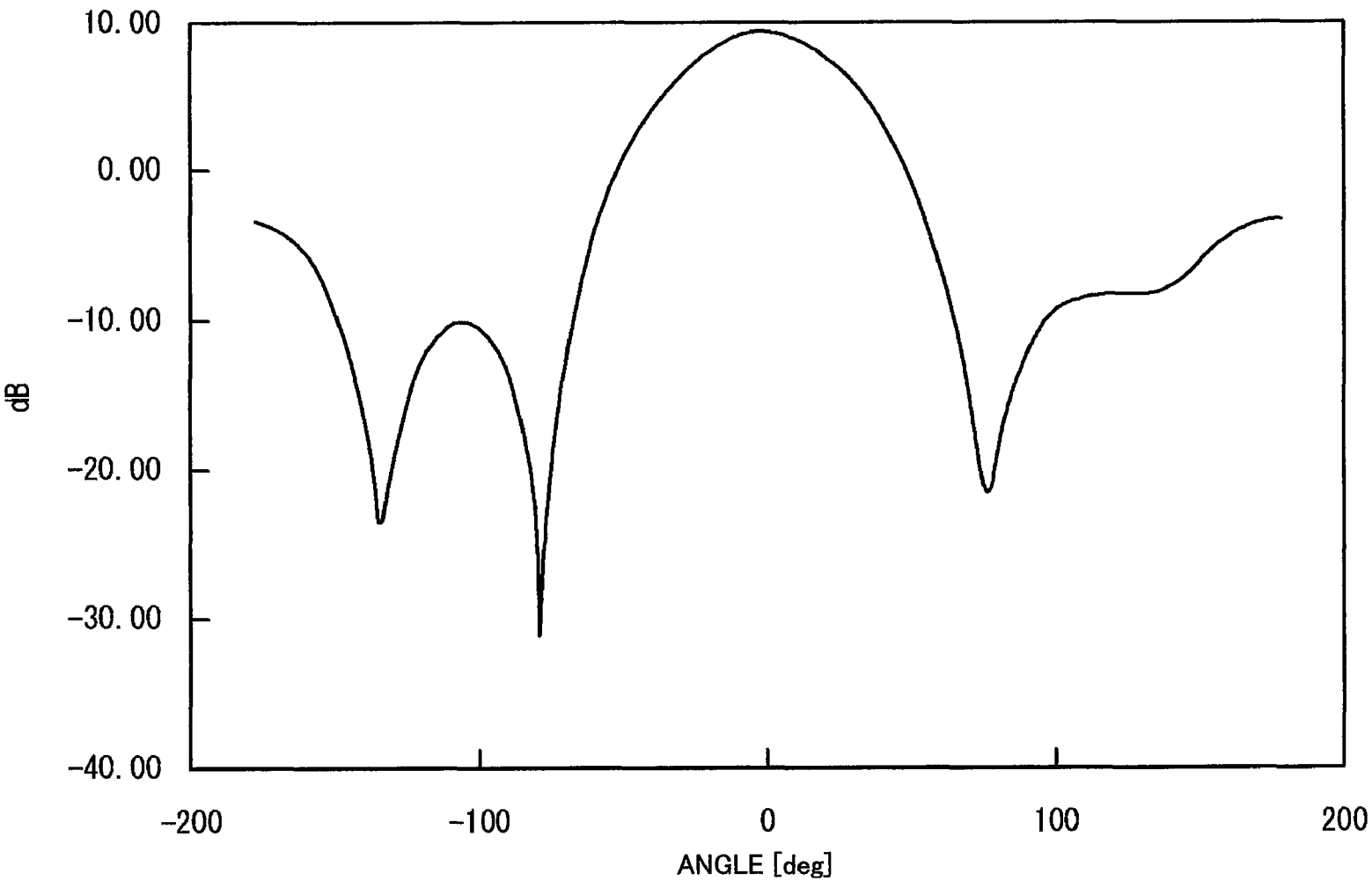
FIG. 20 is a graph representing the directivity of the vertical plane.

FIGS. 19 and 20 represent the directivity in the horizontal plane and vertical plane of antenna-embedded optical unit 2. The gain of approximately 9 dBi is obtained at the maximum point of the directivity. The range lower than this maximum point by 3 dBi has the angle of 76° in the horizontal plane (refer to FIG. 19) and 60° in the vertical plane (refer to FIG. 20). This antenna has a beam width sufficient for wireless communication with an in-vehicle device in the Intelligent Transport System (ITS).

For reference, the VSWR property and directivity for a model of antenna-embedded optical unit 2 having a circular patch element 11 shown in FIGS. 2-4 will be described.

Figure 21:
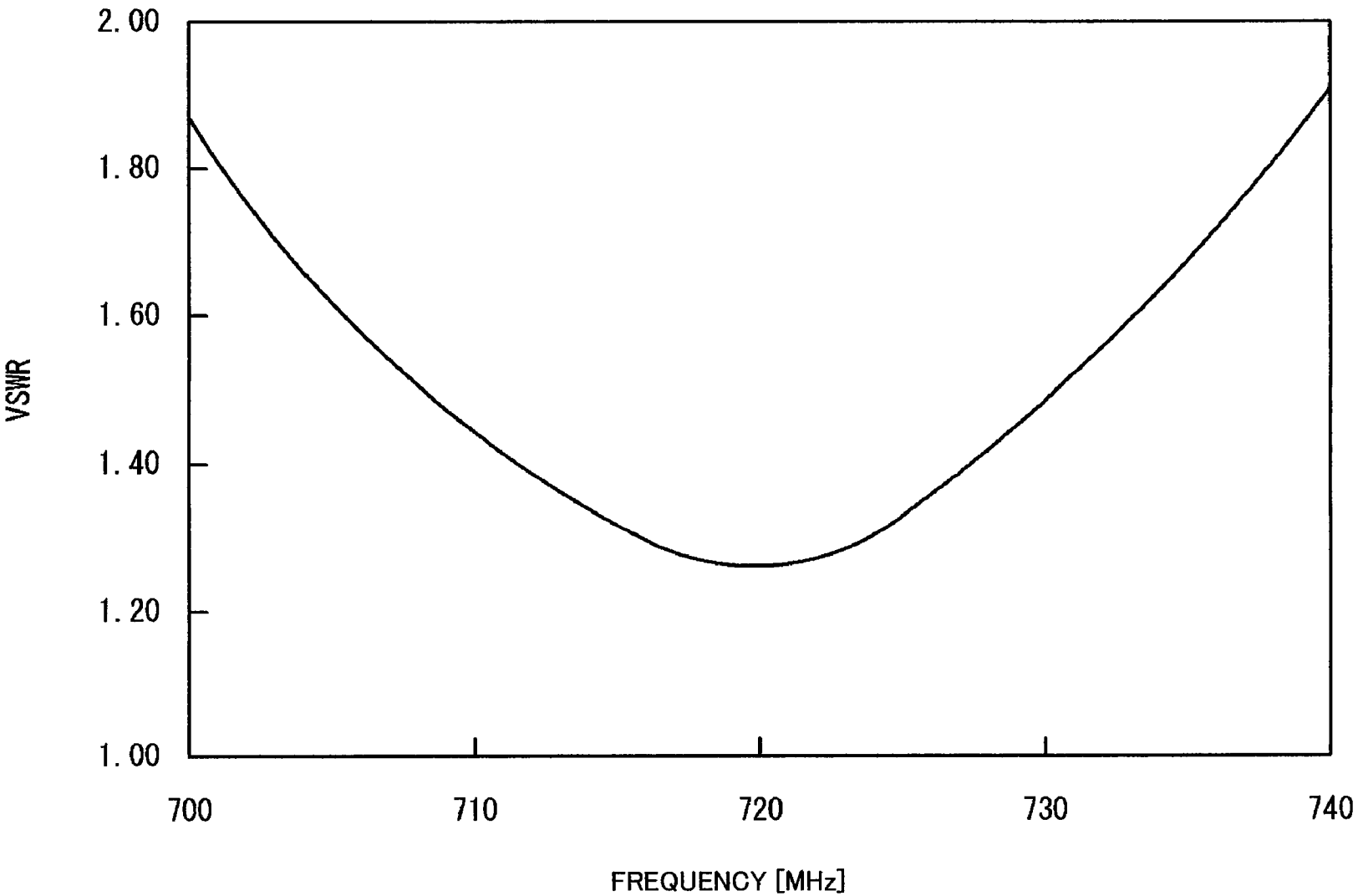
FIG. 21 is a graph representing the VSWR by an antenna with a circular patch element.

FIG. 21 is a graph representing the VSWR when the frequency is tuned to 720 MHz in the present model. FIG. 21 is based on a model of optical unit 2 including patch element 11 formed of a copper sheet (thickness 1 mm) absent of visible-light transmittance, without an LED provided at a substrate 8, and without a hole 14 formed in ground element 12. The VSWR property and directivity of antenna 4 according to this model are equivalent to those of antenna 4 including patch element 11 of visible-light transmittance and ground element 12 formed with holes 14.

In optical unit 2, patch element 11 is a circular (ϕ 215.5 mm) copper plate and ground element 12 is a circular (ϕ 295 mm) copper plate, which are arranged concentric with the centerline of optical unit 2 that is circular when viewed from the front. The feeding point of coaxial cable 15*a* is located at the top edge, 95.1 mm distant from the centerline. Ground element 12 is located on substrate 8. The distance between patch element 11 and ground element 12 in the front-back direction is 28.7 mm. Further, substrate 8 is formed of epoxy glass. Cover member 9 is a polycarbonate lens of 2 mm in thickness, having a spherical shape of 500 mm in radius.

As shown in FIG. 21, the VSWR with the frequency between 715 MHz to 725 MHz in antenna-embedded optical unit 2 is less than 1.4, which is favorable.

Figure 22:
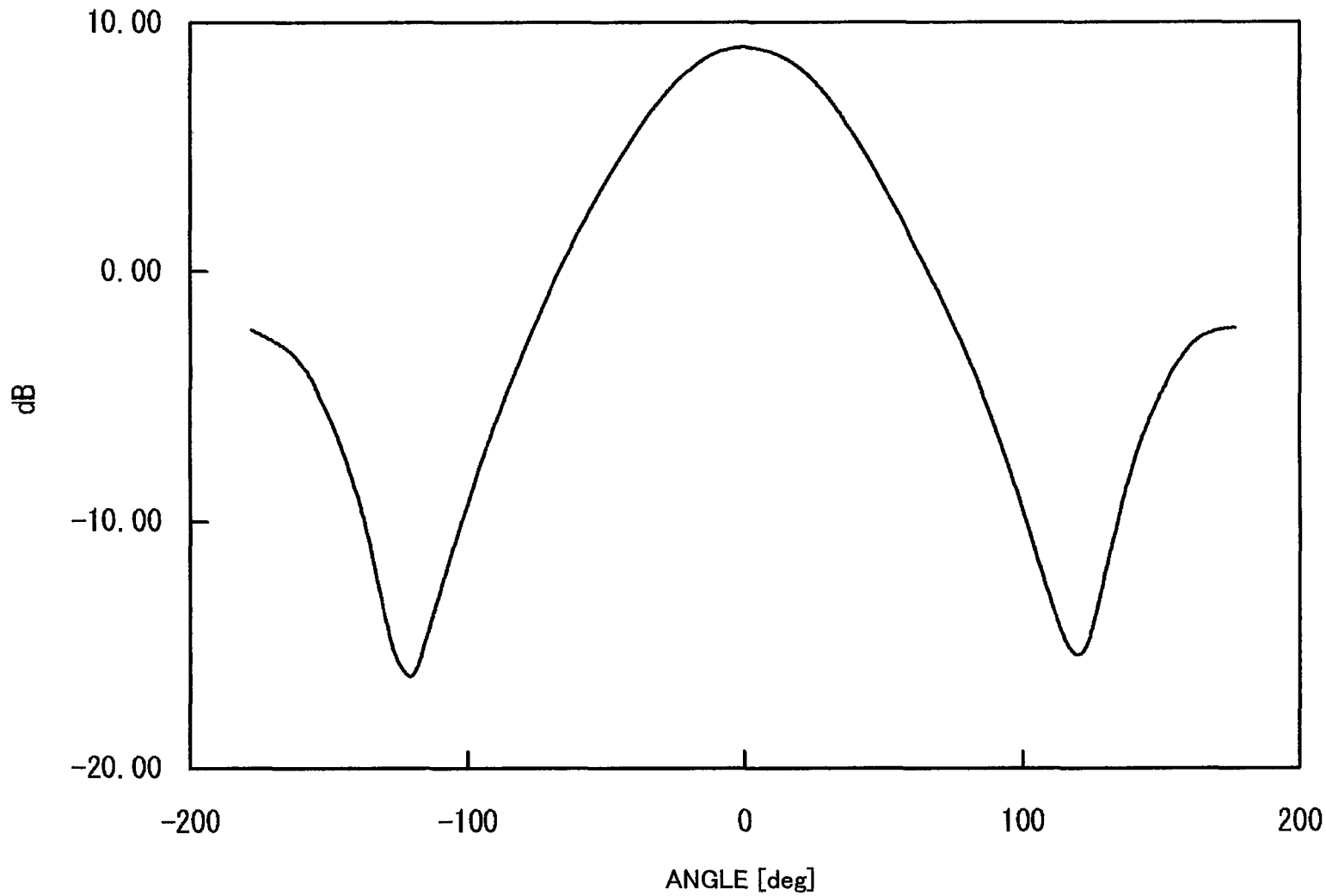
FIG. 22 is a graph representing the directivity of the horizontal plane.
Figure 23:
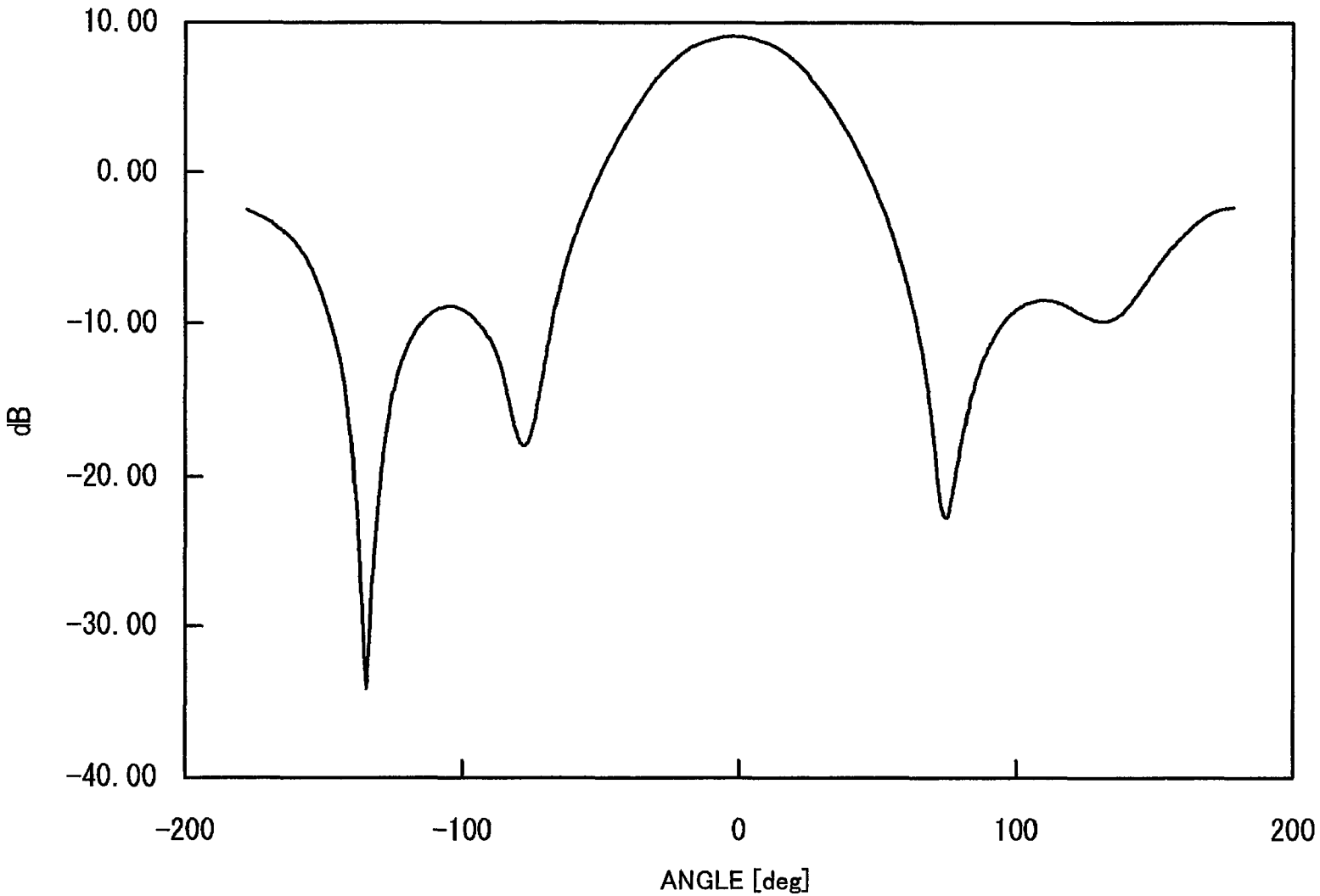
FIG. 23 is a graph representing the directivity of the vertical plane.

FIGS. 22 and 23 represent the directivity in the horizontal plane and vertical plane of antenna-embedded optical unit 2. The gain of approximately 9 dBi is obtained at the maximum point of the directivity. The range lower than this maximum point by 3 dBi has the angle of 80° in the horizontal plane (refer to FIG. 22) and 60° in the vertical plane (refer to FIG. 23). This antenna has a beam width sufficient for wireless communication with an in-vehicle device in the Intelligent Transport System (ITS).

[Traffic Signal Controller]

A control device 5 (traffic signal controller) controlling traffic signal lamp apparatus 1 according to each of the embodiments set forth above can provide via antenna 4 signal information related to the current and future display of traffic signal lamp apparatus 1 towards a vehicle running along or close to the road where traffic signal lamp apparatus 1 is installed.

Signal information refers to information related to the current or future signal light colors displayed by traffic signal lamp apparatus 1, and includes the planned continuous display period, the display sequence, and the like of each signal lamp color.

For example, information set forth below is presented in a predetermined format. The current light color displayed by signal lamp apparatus 1 is blue and the planned continuous period thereof is 5 seconds. The next light color to be displayed is the yellow signal having the planned continuous period of 8 seconds. The next light color to be displayed is a right-turn blue arrow sign having a planned continuous period of 5 to 10 seconds. The signal information to be presented may be just the current displayed light color and its continuous time, or the information of one cycle together. In addition to such information, parametric information related to spot-actuated control, at geometric spots where such control is implemented, as well as the time zone for executing control, may be included.

The in-vehicle computer at the vehicle receiving such signal information can estimate the time before arriving at the halt line from the distance to the halt line, the running speed of the vehicle, acceleration and the like, and then estimate the signal light color that will be displayed at the elapse of the estimated time. For example, in the case where the signal light color is expected to be red at the time of arriving at the halt line even if a green signal is displayed at the current point of time, the in-vehicle computer should execute drive control so as to safely stop before the halt line. In the case where determination is made that the vehicle can cross the intersection safely if the speed is not lowered, control is executed to maintain the speed.

The in-vehicle computer may execute control, governed mainly by the in-vehicle device, and also assisting the driving operation of the driver such as "brake assist".

The in-vehicle computer may notify a passenger in the vehicle about the result of the above-described determination through voice and/or image information. For example, a voice message of "Stop the vehicle since the signal will soon change" can be issued towards the driver, or an appropriate text or graphic image can be displayed on the screen of the head-up display or navigation device.

The lamp apparatus of the present invention is not limited to that set forth in the above embodiments. For example, the signal lamp apparatus may be directed to a pedestrian other than to a vehicle. Further, the light emitter in the signal lamp apparatus may be a lamp bulb instead of an LED. Furthermore, although a circular ground element 12 is employed in each of the embodiments set forth above, a rectangle ground element 12 may be employed instead. Moreover, the present invention is applicable to a lighting lamp for illumination of a road in addition to a signal lamp apparatus. In this case, the light emitter includes a mercury lamp or sodium lamp.

Figure 24:
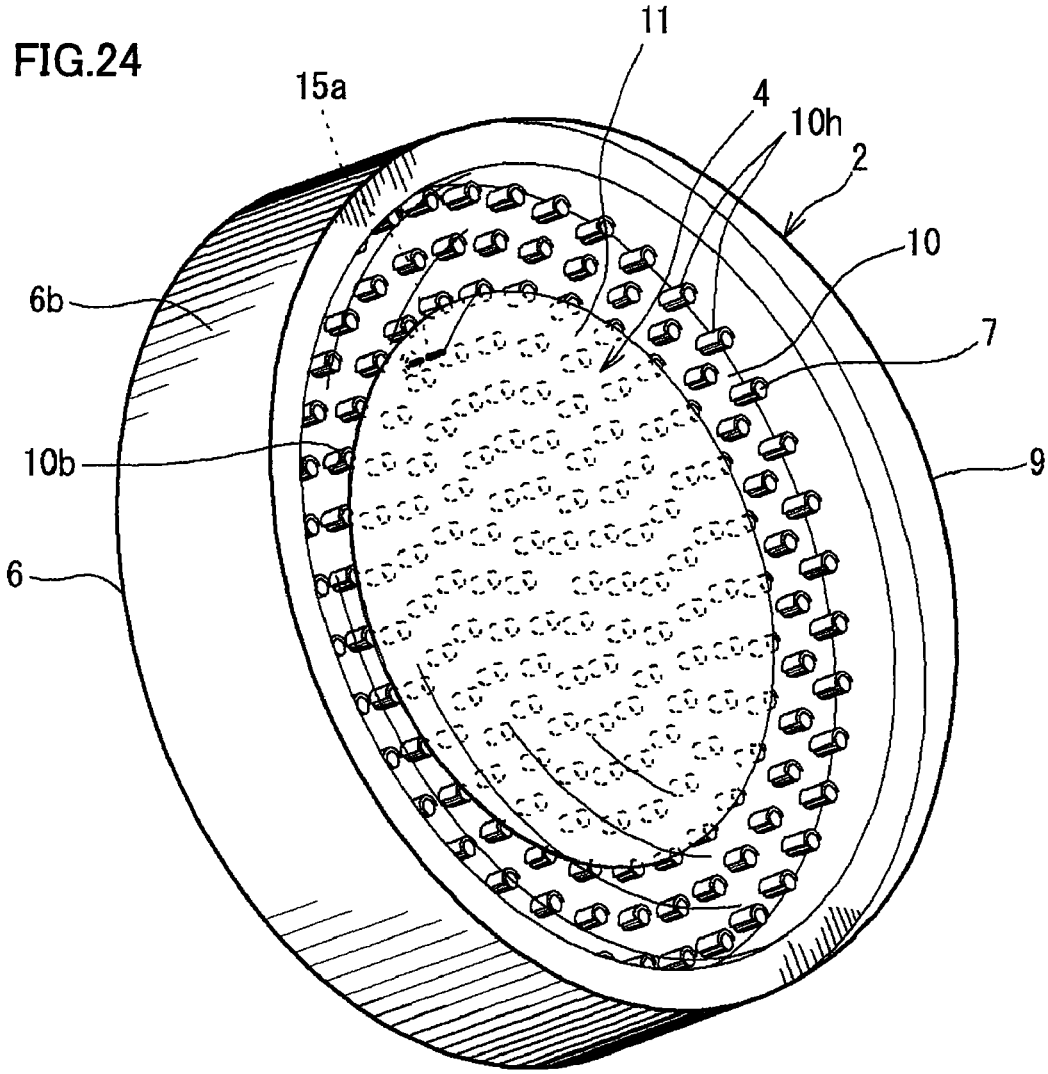
FIG. 24 is a perspective view of an optical unit including an anti-reflection member.
Figure 25:
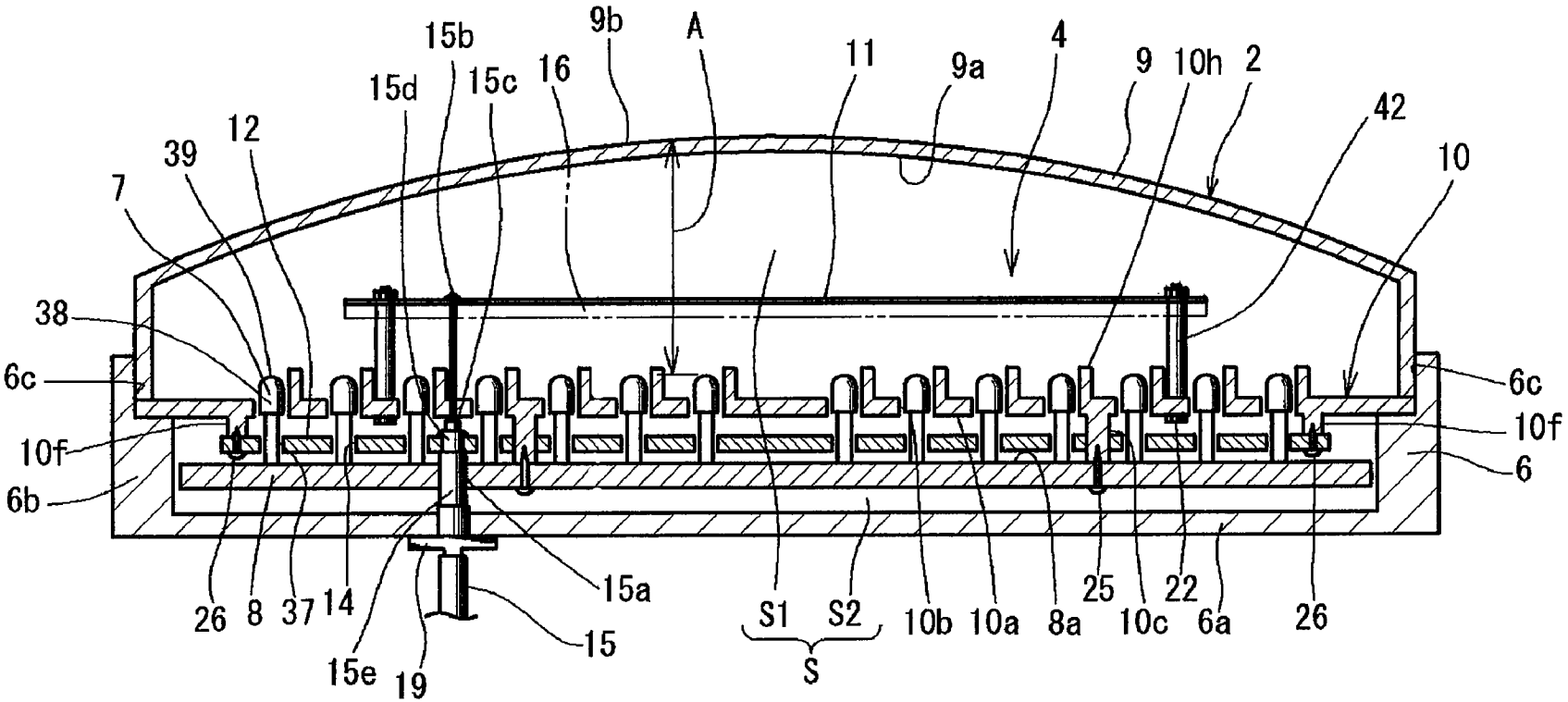
FIG. 25 is a sectional view of an optical unit including an anti-reflection member.

In each of the embodiments of the first lamp apparatus, the lamp apparatus may include an anti-reflection member. The anti-reflection member functions to prevent the externally incident light (sunlight) to optical unit 2 from being reflected by at least one of substrate 8 and LED 7. In the embodiment set forth above, the lamp apparatus includes support member 13, which supports one or both of patch element 11 and ground element 12. In this context, support member 13 may function as the anti-reflection member. FIGS. 24 and 25 are a perspective view and sectional view, respectively, of an optical unit 2 including an anti-reflection member 10. Referring to FIG. 25, anti-reflection member 10 supports ground element 12 at the rear side, and supports patch element 11 at the front side via spacer 42.

In the case where the above-described lamp apparatus is employed as a traffic signal lamp apparatus, the west sunlight or morning sunlight striking substrate 8 and/or LED 7 may be reflected towards the ground, and reflected light therefrom may render the light of the lamp apparatus imperceptible, or cause "pseudo lighting" giving a false appearance of being lit.

By causing support member 13 to include the function of preventing incident light directed from a predetermined direction external to optical unit 2 (oblique incident light from above such as the west sunlight or morning light) from being reflected by substrate 8 and/or LED 7, the event of the lamp apparatus being imperceptible or causing pseudo lighting can be prevented. Particularly in the case where anti-reflection member 10 is provided to prevent the incident light (sunlight) from being reflected at LED 7, direct irradiation of LED 7 with sunlight can be circumvented by virtue of anti-reflection member 10. Temperature increase at LED 7 can be suppressed to prevent reduction in the lifetime of LED 7. By supporting patch element 11 with a member that prevents light reflection, the configuration can be simplified and the fabrication cost reduced by the common usage of the component.

Anti-reflection member 10 is formed of a synthetic resin material that is an insulation member, and is arranged frontward of substrate 8. Anti-reflection member 10 includes a sheet portion 10*a* formed as a circular sheet (planar). Sheet portion 10*a* is arranged at the rear side of leading end 39 of LED 7. Sheet portion 10*a* has a plurality of through holes 10*b* formed corresponding to the arrangement of LEDs 7 for the purpose of inserting LEDs 7.

Sheet portion 10*a* prevents mainly the sunlight from directly striking substrate 8. Anti-reflection member 10 is formed of a black synthetic resin material, or at least the front face of sheet portion 10*a* is painted black to prevent reflection of sunlight. Anti-reflection member 10 is secured to storage member 6 by fitting the outer circumferential portion of sheet portion 10*a* with a step portion 6*c* of storage member 6, and engaging a claw not shown formed at step portion 6*c* with sheet portion 10*a*.

A boss 10*c* is formed protruding rearwards at the back face of sheet portion 10*a*. Substrate 8 is secured to sheet portion 10*a* by a screw 25 threaded with the screw hole formed at boss 10*c*. Front face 8*a* of substrate 8 abuts against the leading face of boss 10*c*. There is a distance between sheet portion 10*a* and substrate 8 corresponding to the height of boss 10*c*.

An eave 10*h* is formed protruding frontward at the upper end of through hole 10*b* of anti-reflection member 10. Eave 10*h* serves to prevent the sunlight directed obliquely from above such as the west sunlight or morning sunlight from entering the mirror reflector of LED 7. Thus, the sunlight can be prevented from being reflected by mirror reflector. The leading end of eave 10*h* protrudes outwards ahead of the leading end of LED 7. Anti-reflection member 10 may function only to prevent the sunlight from being reflected off substrate 8, or to only prevent the sunlight from being reflected off LED 7.

[Second Lamp Apparatus]

A second lamp app aratus of the present invention will now be described. Likewise with the first lamp apparatus, the front view of the second lamp apparatus is as shown in FIG. 1. The lamp apparatus is a traffic signal lamp apparatus 1 installed on the road (hereinafter, simply referred to as signal lamp apparatus or lamp apparatus) for a vehicle.

A pole 40 is installed at the side of the road such as on a sidewalk. An arm 41 extends towards the roadway from pole 40. Signal lamp apparatus 1 is attached to arm 41. Signal lamp apparatus 1 includes a plurality of optical units 2 (three in the drawing), and an enclosure 3 incorporating optical units 2. The three optical units 2 include red, yellow, and blue lightening colors. A visor (not shown) is attached to each optical unit 2.

Further, a control device 5 controlling signal lamp apparatus 1 is attached to pole 40. The configuration of installation of signal lamp apparatus 1 is arbitrary, and may be other than that shown in the drawings. Although not shown, the form of pole 40 and arm 41 may differ. Alternatively, signal lamp apparatus 1 may be installed at a pedestrian bridge. Further, control device 5 may be provided in enclosure 3 of signal lamp apparatus 1.

Control device 5 controlling the lighting of signal lamp apparatus 1 can conduct wireless communication control through antenna 4 that will be described afterwards. Alternatively, control device 5 controlling the lighting or the like and the control device for wireless communication through antenna 4 may be different units. In the case where control devices are provided individually, the control devices can be incorporated into one same enclosure 3. Alternatively, the control device for wireless communication can be installed in the proximity (same pole 40) of the control device that controls the lighting or the like of signal lamp apparatus 1.

Figure 26:
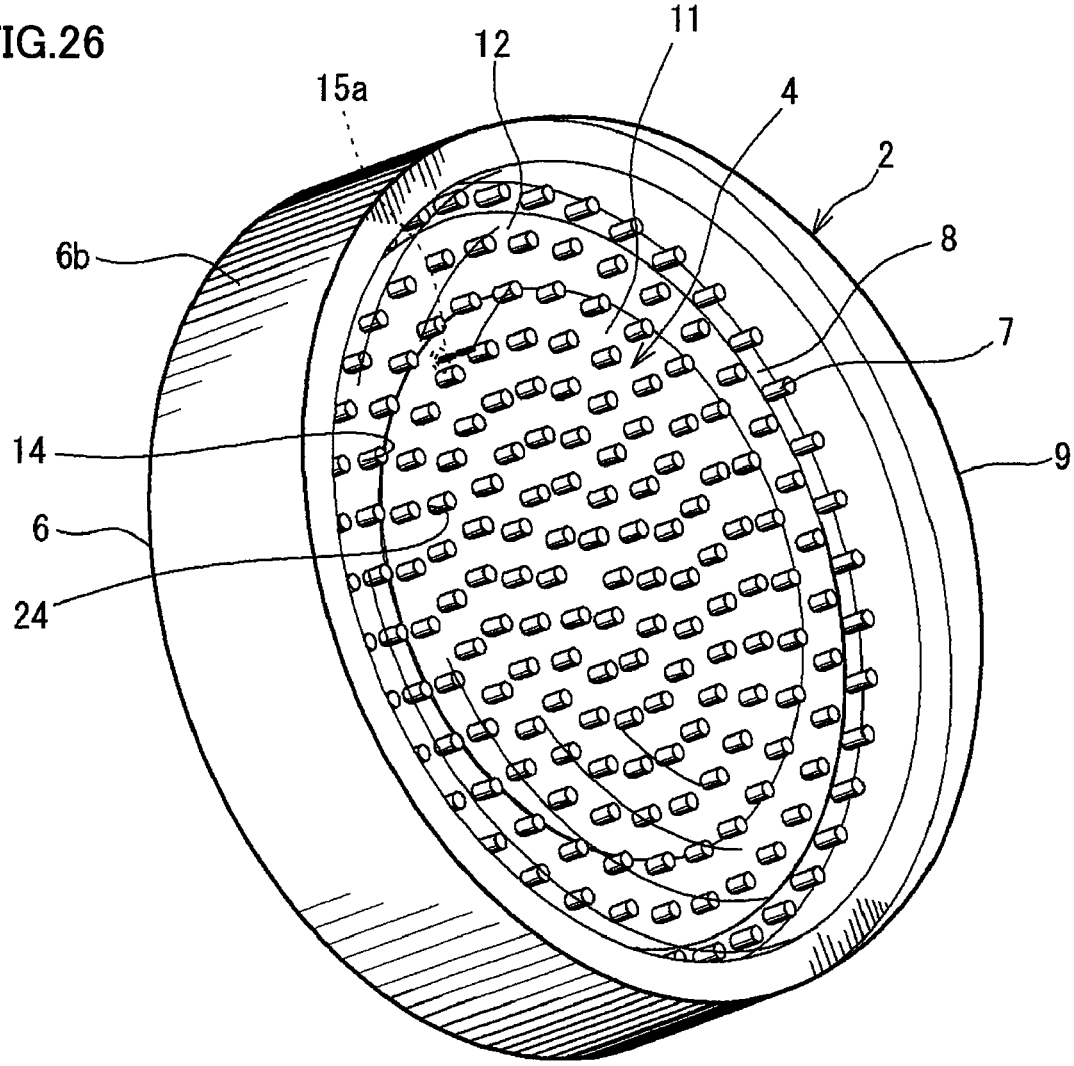
FIG. 26 is a perspective view of an optical unit.
Figure 27:
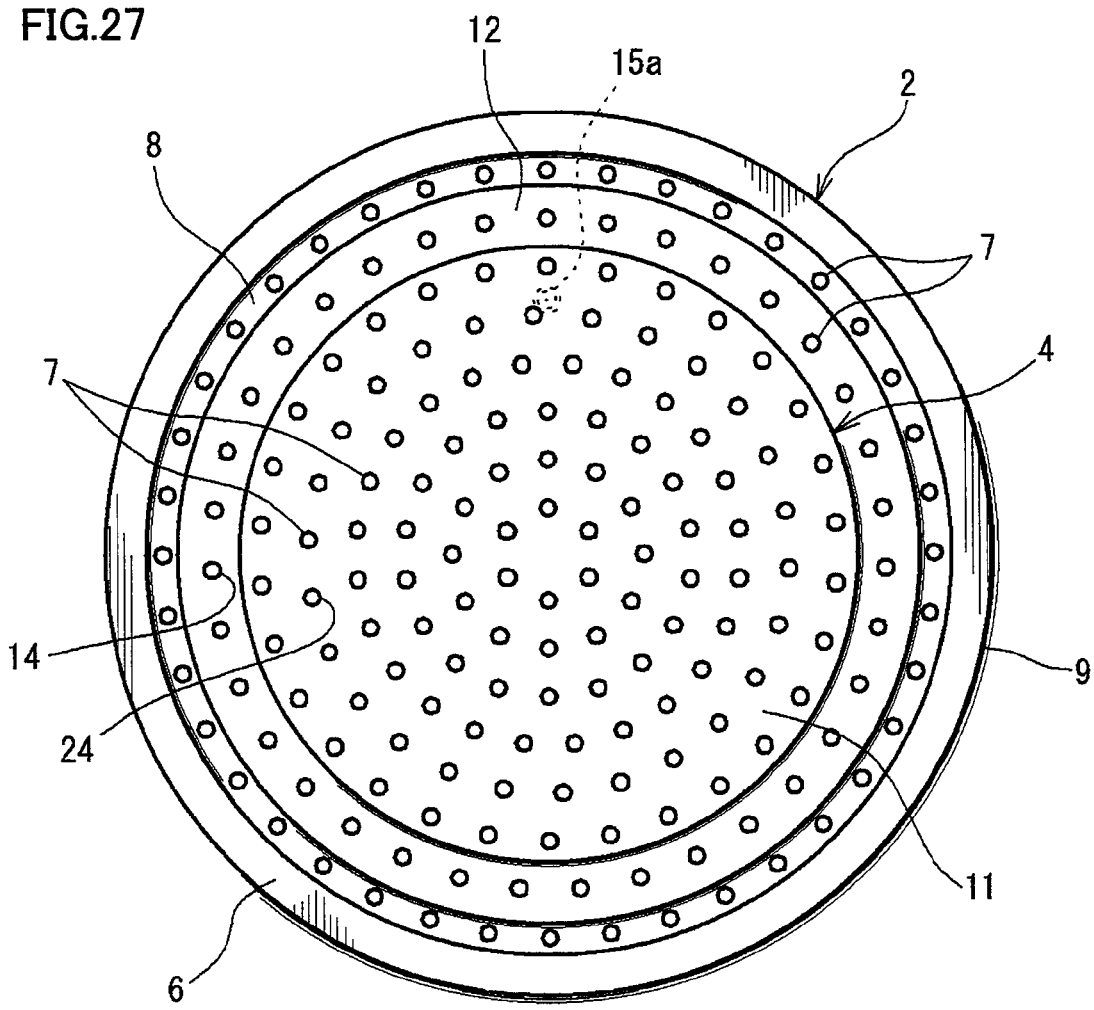
FIG. 27 is a front view of the optical unit.
Figure 28:
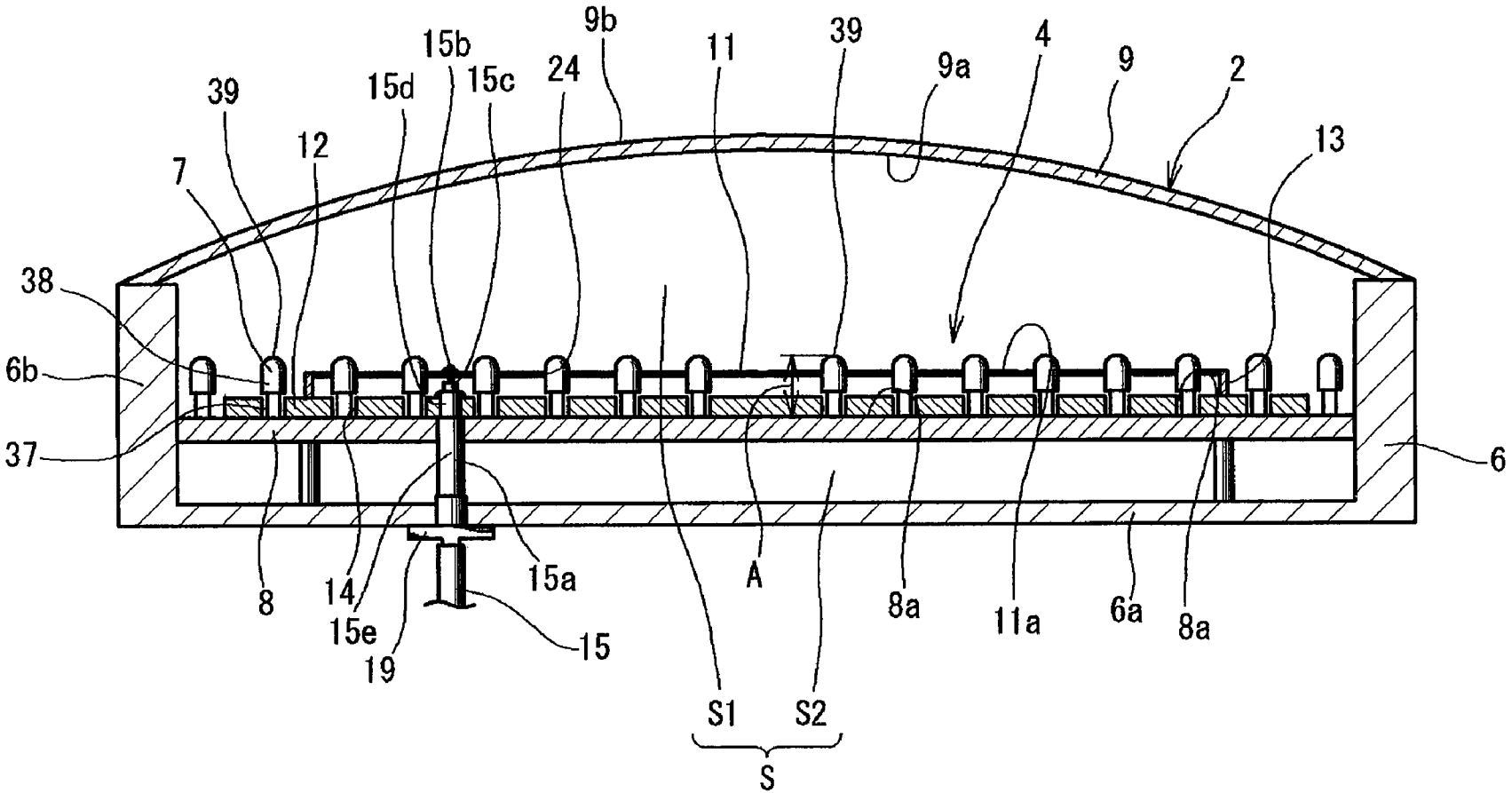
FIG. 28 is a sectional view of the optical unit.

FIGS. 26, 27 and 28 are a perspective view, front view, and cross sectional view, respectively, of one optical unit 2 (Twelfth Embodiment). Optical unit 2 includes a light emitting diode 7 (hereinafter, LED) as the light emitter, a substrate 8 having a plurality of LEDs 7 mounted on a front face 8*a*, a storage member 6, and a cover member 9. Substrate 8 has a wiring pattern formed at the back side, and is connected to a terminal 37 of LED 7. A plurality of LEDs 7 are arranged on substrate 8, spread in planar manner.

LED 7 includes a lens unit 38 in which an LED element (not shown) is provided.

Storage member 6 is dish-shaped, and opened facing the front side, including a bottom (bottom wall) 6*a*, and a side (sidewall) 6*b* upright from the circumferential edge of bottom 6*a*. Cover member 9 is attached at the front of storage member 6 corresponding to the opening side. A storage cavity S is defined between storage member 6 and cover member 9. LED 7 and substrate 8 are accommodated in storage cavity S. Substrate 8 is secured to storage member 6. In storage cavity S, the section at the front of substrate 8 is a front cavity S, and the section at the rear of substrate 8 is a rear cavity S2.

Cover member 9 has visible-light transmittance (transparent to visible light), and covers a plurality of LEDs 7 at the front side. In optical unit 2, the front side is the light projecting side (the side corresponding to cover member 9), and the rear side is the bottom 6*a* side of storage member 6.

In FIG. 28, cover member 9 has a rear face (back face) 9*a* corresponding to a concave-curved plane and a front face 9*b* corresponding to a convex-curved plane. Although cover member 9 is represented having concave and convex curved faces, cover member 9 may be planar if signal lamp apparatus 1 is an LED lamp apparatus.

Antenna 4 is incorporated in optical unit 2. Antenna 4 is a patch antenna, including a patch element 11 and a ground element 12. FIG. 28 shows that patch element 11 and ground element 12 are stored in optical unit 2, i.e. in storage cavity S.

Patch element 11 is formed as a circular plane, supported by and secured to a support member 13 standing upright from substrate 8 towards the front side. Support member 13 is formed of an insulation member. Patch element 11 is provided apart from and ahead of substrate 8, and located at the rear side of leading end 39 of LED 7 (leading end 39 of lens unit 38). The outline of patch element 11 may be a rectangle instead of a circle (refer to FIG. 29).

Ground element 12 is formed in a circular flat shape (sheet shape), and is attached to substrate 8 at the front face 8*a* side of substrate 8. Ground element 12 is secured to storage member 6 together with substrate 8 by a screw. Alternatively, ground element 12 may be supported by and secured to support member 13 standing upright from substrate 8. Ground element 12 is located at the rear of patch element 11, and between substrate 8 and leading end 39 of LED 7 in the front-back direction. The outline form of ground element 12 is larger than the outline form of patch element 11.

Ground element 12 and patch element 11 are located in front cavity S1, and in the range A from front face 8*a* of substrate 8 up to leading end 39 of LED 7. Ground element 12 and patch element 11 are arranged facing each other in the front-back direction. The directivity of antenna 4 corresponds to the direction from signal lamp apparatus 1 towards the front side. The light projecting direction by optical unit 2 can be made to substantially match the directivity of antenna 4. Since signal lamp apparatus 1 is installed at a position of good visibility from the vehicle, a favorable communication state can be achieved with the in-vehicle device (not shown) by the directivity of antenna 4.

In order to utilize signal lamp apparatus 1 incorporating antenna 4 in the Intelligent Transport System (ITS) for road-vehicle wireless communication, the distance between ground element 12 and patch element 11 in the front-back direction is set to 10 to 40 mm when the working frequency is set at 715 MHz to 725 MHz. These values apply to the case where there is air between ground element 12 and patch element 11.

The distance between ground element 12 and patch element 11 in the front-back direction is preferably 20 to 30 mm when the diameter of the outer circumference of patch element 11 is 170 mm to 230 mm, and the hole size is 10 mm to 25 mm. When the hole size is 25 to 35 mm, the distance is preferably 25 to 35 mm. In other words, the distance between patch element 11 and ground element 12 is preferably increased and decreased in the front-back direction as the surface area of patch element 11 becomes smaller and larger, respectively.

In the embodiment of FIG. 28, the range A from front face 8*a* of substrate 8 up to leading end 39 of LED 7 must be increased to set the distance between ground element 12 and patch element 11 in the front-back direction at a predetermined value. To this end, LED 7 may have a length of lens unit 38 increased in the front-back direction, or have a long terminal 37.

A resin sheet (not shown) may be provided as an insulation member between ground element 12 and patch element 11. In this case, the surface area of patch element 11 and/or ground element 12 can be reduced although the distance therebetween may become slightly larger than the aforementioned value due to change in the permittivity therebetween. For the insulation member, polyethylene, polyethylene terephthalate, fluorine resin, epoxy glass, FRP, and polyacetal sheet can be cited.

Ground element 12 and patch element 11 may be disposed in parallel. However, for the sake of adjusting the antenna directivity, one or both of patch element 11 and ground element 12 may be disposed inclined with respect to substrate 8.

Signal lamp apparatus 1 is generally installed with substrate 8 per se tilted downwards in view of the visibility for the driver. Therefore, the directivity of antenna 4 will be in the downward direction by attaching patch element 11 and ground element 12 parallel to substrate 8. Further, antenna 4 may be inclined further downwards than substrate 8 for the purpose of restricting the wireless communication area across the road and vehicle and/or increasing communication reliability.

Since patch element 11 and LED 7 are overlapping in position in the front-back direction, a plurality of holes 24 are formed at patch element 11 as the openings into which LEDs 7 are inserted. Further, since ground element 12 and LED 7 are overlapping in position in the front-back direction, a plurality of holes 14 are formed at ground element 12 as the openings into which LEDs 7 (terminal 37 of LED 7) are inserted. The arrangement of holes 24 and holes 14 matches the arrangement of LEDs 7, resulting in patch element 11 and ground element 12 taking a mesh structure.

Therefore, LED 7 can be inserted into hole 24 of patch element 11 and allow patch element 11 to be situated at predetermined position to avoid interference of patch element 11 with LED 7. In addition, LED 7 can be inserted into hole 14 of ground element 12 and allow ground element 12 to be situated at predetermined position to avoid interference of ground element 12 with LED 7.

As illustrated, the openings formed in patch element 11 and ground element 12 include holes 24 and 14. By these holes 24 and 14, LED 7 can be arranged to avoid interference with the element. Alternatively, in the absence of a hole, the conductive body (conductor portion) of the element, for example, may be arranged in a meandering manner (arranging the conductive body as one continuous stroke) to position LED 7 so as to avoid interference with the element.

Patch element 11 and ground element 12 are formed of a metal sheet. Patch element 11 and ground element 12 are preferably formed of a conductive material having high conductivity. For example, copper, a copper alloy such as brass, and aluminium are preferable. Steel, nickel, or other metals may also be employed. Since a current of high frequency flows at the surface, an element formed by metal deposition or applying a metal coat (a gold or silver coat) on sheet member 16 may be employed (not shown).

Storage member 6 of optical unit 2 is formed of a steel sheet, or made of aluminium or resin. Cover member 9 is a lens made of glass or resin.

In the case where signal lamp apparatus 1 is an LED lamp apparatus, cover member 9 may be formed as a flat sheet such as flat glass instead of a lens.

At storage member 6 (bottom 6*a*), a terminal 19 to connect a coaxial cable 15 for antenna 4 is attached. Coaxial cable 15 extending from control device 5 of FIG. 1 is connected to terminal 19. Coaxial cable 15*a* extending from terminal 19 towards rear cavity S2 is connected to antenna 4. Coaxial cable 15*a* includes an inner conductor 15*b*, an insulator 15*c*, an outer conductor 15*d*, and a cover 15*e*. Inner conductor 15*b* of coaxial cable 15*a* is connected to patch element 11. Outer conductor 15*d* is connected to ground element 12. Inner and outer conductors 15*b* and 15*d* can be connected and secured to each of elements 11 and 12 (conductive body of each element) by, but not limited to, solder.

A power supply cable (not shown) for LED 7 extending from control device 5 of FIG. 1 is connected to LED substrate 8 via a terminal (not shown) attached to bottom 6*a* of storage member 6.

According to the embodiment set forth above, patch element 11, ground element 12, and support member (attachment) 13 to situate patch element 11 at the rear side of leading end 39 of LED 7 constitute an antenna unit. This antenna unit is incorporated into signal lamp apparatus 1.

Even if antenna 4 is stored in optical unit 2, the event of patch element 11 and ground element 12 impeding forward light emittance (lighting) by LED 7 can be prevented since patch element 11 and rear-located ground element 12 are situated at the rear side of leading end 39 of LED 7. The provision of patch element 11 and ground element 12 ahead of substrate 8 can prevent the event of substrate 8 impeding the transmission and reception of a electric wave through antenna 4.

In order to prevent patch element 11 and ground element 12 from impeding the forward light emittance (lightening), patch element 11 is situated at the rear side of leading end 39 of LED 7. This "rear side of leading end 39" includes the case where the position of front face 11*a* of patch element 11 and the position of leading end 39 of LED 7 in the front-back direction substantially match each other. This "substantially match" corresponds to the case where the position of leading end 39 of LED 7 is in the range of patch element 11 in the thickness direction.

Figure 29:
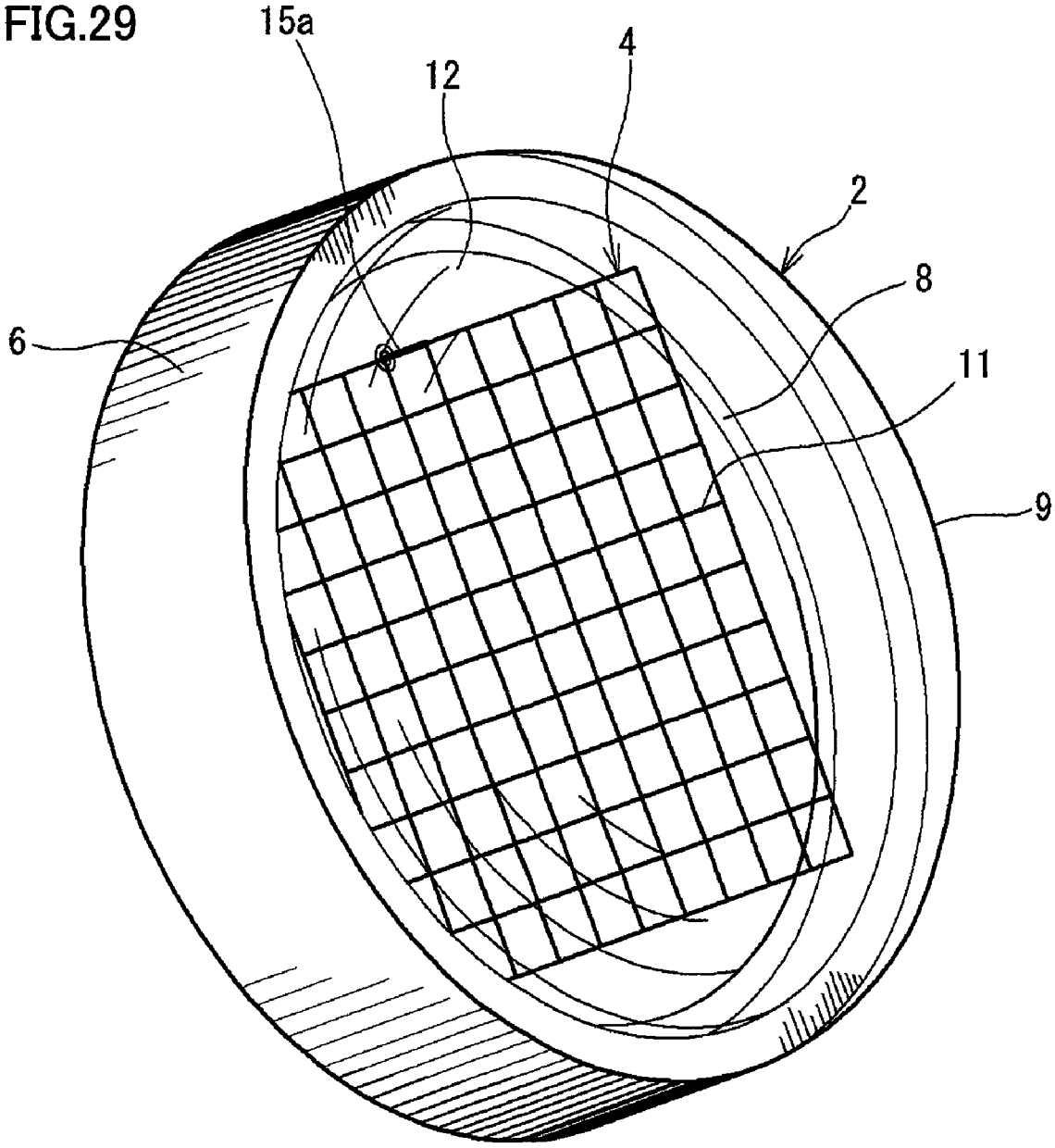
FIG. 29 is a perspective view of an optical unit incorporating an antenna.

FIG. 29 is a perspective view of optical unit 2 incorporating antenna 4. For the sake of simplification, LED 7 is not illustrated. Patch element 11 of antenna 4 has a rectangular outline form, and takes a mesh structure. The mesh structure of patch element 11 is achieved by electrical leads (weaving electrical leads). The spacing between the electrical leads is taken as a hole where LED 7 is to be situated. By virtue of the hole, the event of patch element 11 impeding interference with LED 7 can be prevented.

Although not shown, a plurality of holes to avoid interference with LED 7 may be formed at the sheet member having a metal film (metal membrane) at the surface, in order to achieve a patch element 11 of a mesh structure. This sheet member is attached to support member 13 (refer to FIG. 28). This sheet member is, for example, a transparent resin sheet.

Figure 30:
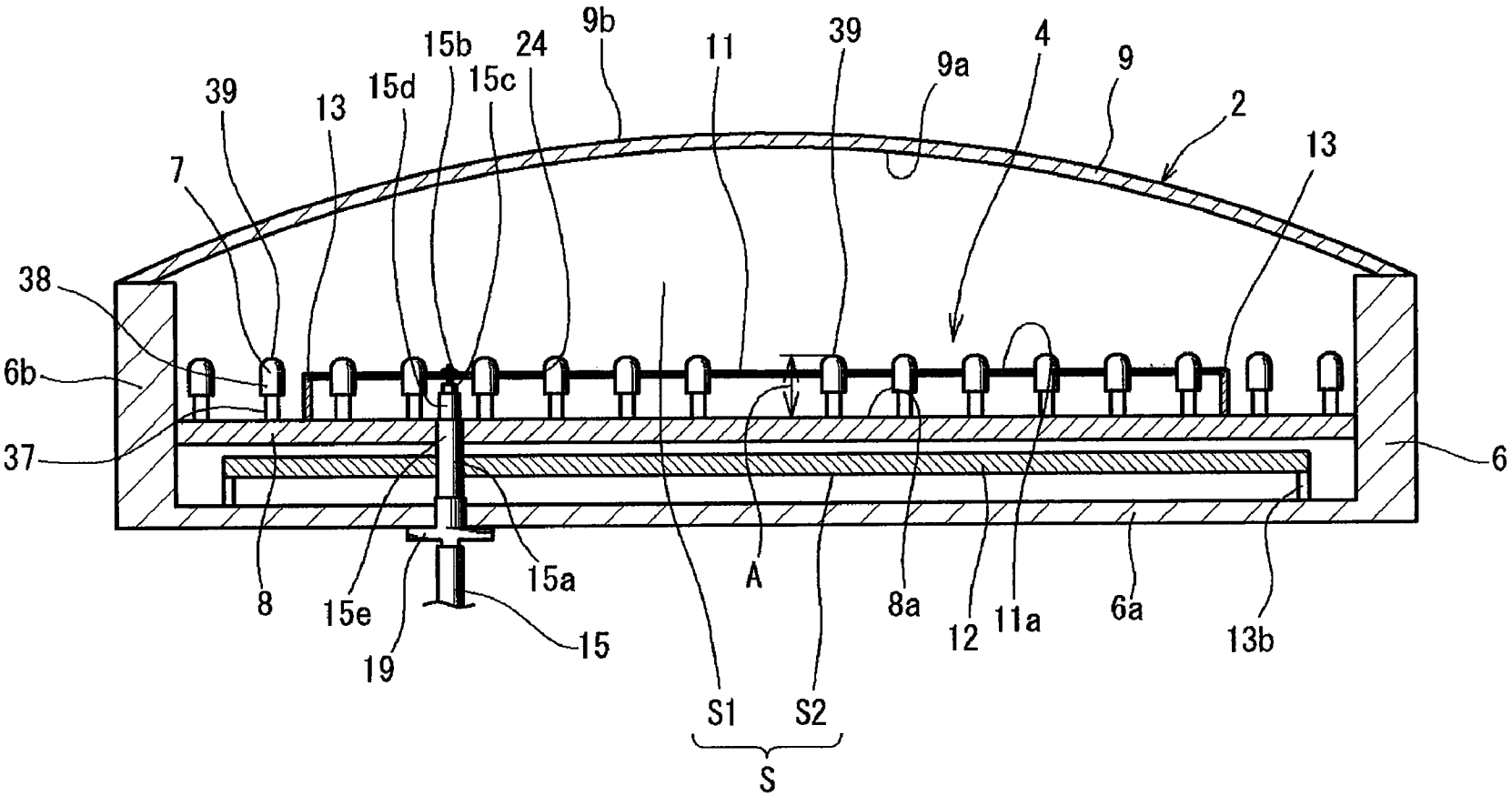
FIG. 30 is a sectional view of an optical unit and antenna in a lamp apparatus according to another embodiment.

Another embodiment (Thirteenth Embodiment) of an antenna-embedded signal lamp apparatus having antenna 4 incorporated in an optical unit 2 will be described. FIG. 30 is a sectional view of optical unit 2 and antenna 4 incorporated in the signal lamp apparatus. Likewise with the previous embodiment, the signal lamp apparatus includes optical unit 2 and antenna 4. Optical unit 2 includes substrate 8 having LEDs 7 mounted at front face 8*a*, and a cover member 9 of visible-light transmittance, spread over LEDs 7 at the front. Antenna 4 includes patch element 11 situated at the rear side of leading end 39 of LED 7, and ground element 12 at the rear of patch element 11. Antenna 4 is stored in optical unit 2.

The difference between the embodiment of FIG. 30 and the previous embodiment of FIG. 28 lies in the position of ground element 12. The remaining configuration is similar. Ground element 12 is provided at the rear of substrate 8. Ground element 12 is supported by and secured to a second support member 13*b* provided at the rear of substrate 8. Patch element 11 is provided in front cavity S1, in a range A from front face 8*a* of substrate 8 up to leading end 39 of LED 7, whereas ground element 12 is provided in rear cavity S2.

The present embodiment is advantageous in that a predetermined wide distance can be provided between patch element 11 and ground element 12 in the front-back direction to achieve patch antenna 4 having the desired performance. In other words, ensuring a distance of a predetermined value (10 to 40 mm) between ground element 12 and patch element 11 in the front-back direction for the purpose of achieving the usable frequency of 715 MHz-725 MHz is facilitated, as described above.

Figure 31:
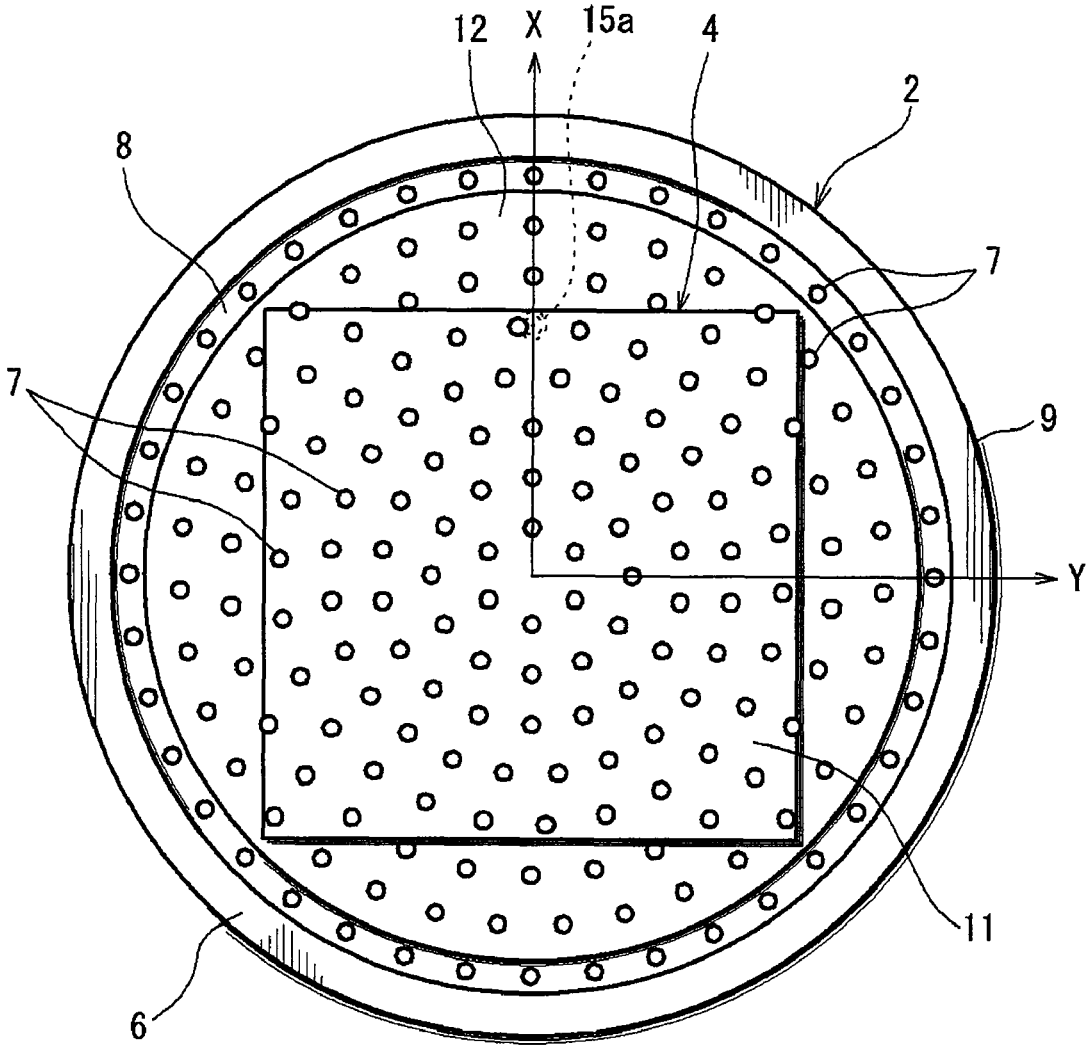
FIG. 31 is a front view of an optical unit and antenna in another lamp apparatus.

FIG. 31 is a front view of optical unit 2 and antenna 4 incorporated in another antenna-embedded signal lamp apparatus (Fourteenth Embodiment). FIG. 31 shows patch element 11 taking a rectangular outline form. Patch element 11 has one pair of opposite sides corresponding to the horizontal direction and the other pair of opposite sides corresponding to the vertical direction. Since the feeding point towards antenna 4 (patch element 11) through coaxial cable 15*a* is located at the center region in the horizontal direction at the top edge of antenna 4 (or at the center region in the horizontal direction at the bottom edge: on the X axis), the electric field plane is set as vertical polarization (polarization in the X-axis direction). Although not shown, the electric field plane can be set as horizontal polarization (polarization in the Y axis direction) by situating the feeding point of antenna 4 (patch element 11) through coaxial cable 15*a* at the right side edge (or left side edge) at the center region in the vertical direction (on the Y axis).

Figure 32:
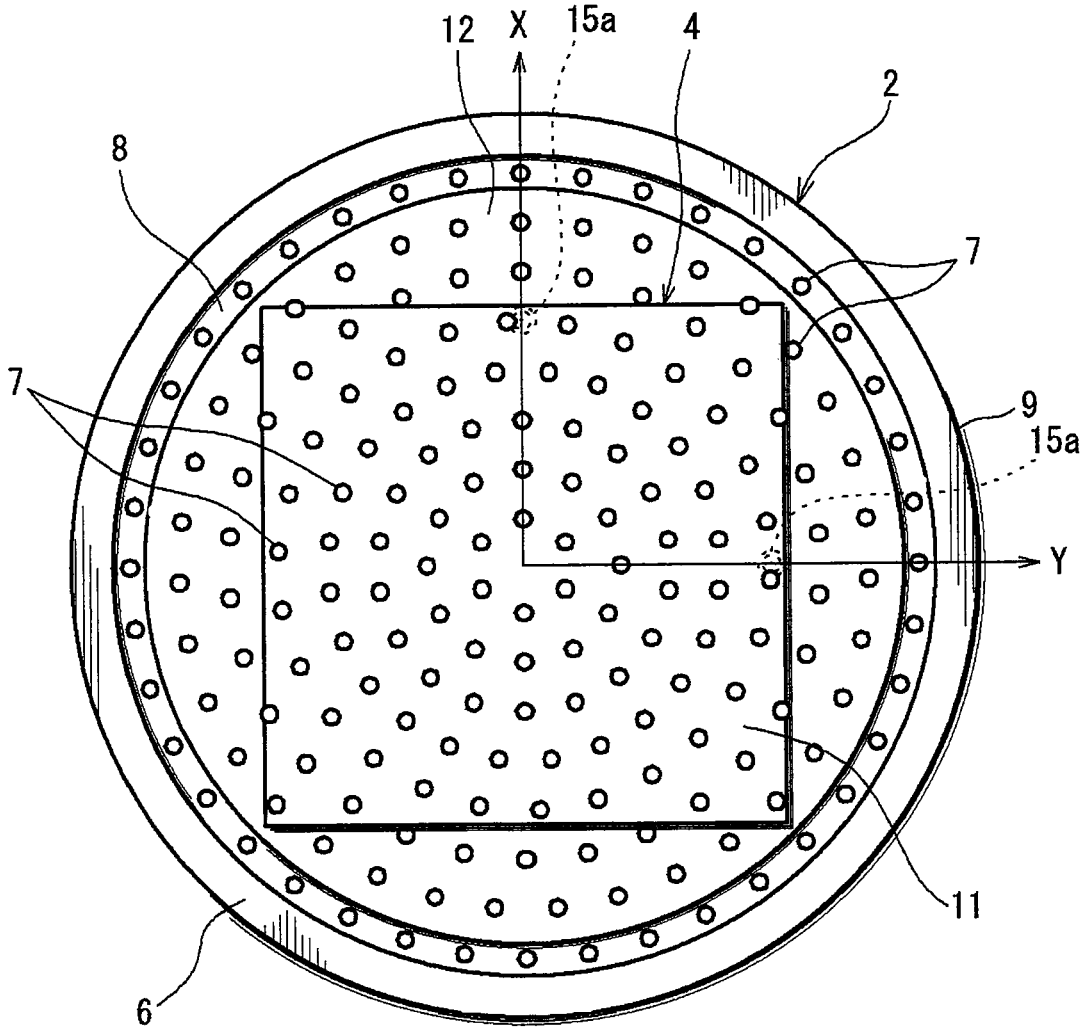
FIG. 32 is a front view of an optical unit and antenna according to still another embodiment.

FIG. 32 is a front view of another embodiment (Fifteenth Embodiment). Antenna 4 has a patch element 11 of a rectangular outline form, and includes two feeding points (coaxial cable 15*a*) on the X axis and Y axis. In this case, a dual polarization patch antenna of vertical polarization and horizontal polarization is established. Further, a circular polarized antenna can be established by applying a signal of equal amplitude and 90 degrees out of phase towards the two coaxial cables 15*a*. Alternatively, a configuration of dynamically switching between these antennas by a switch or the like may be employed.

Figure 33:
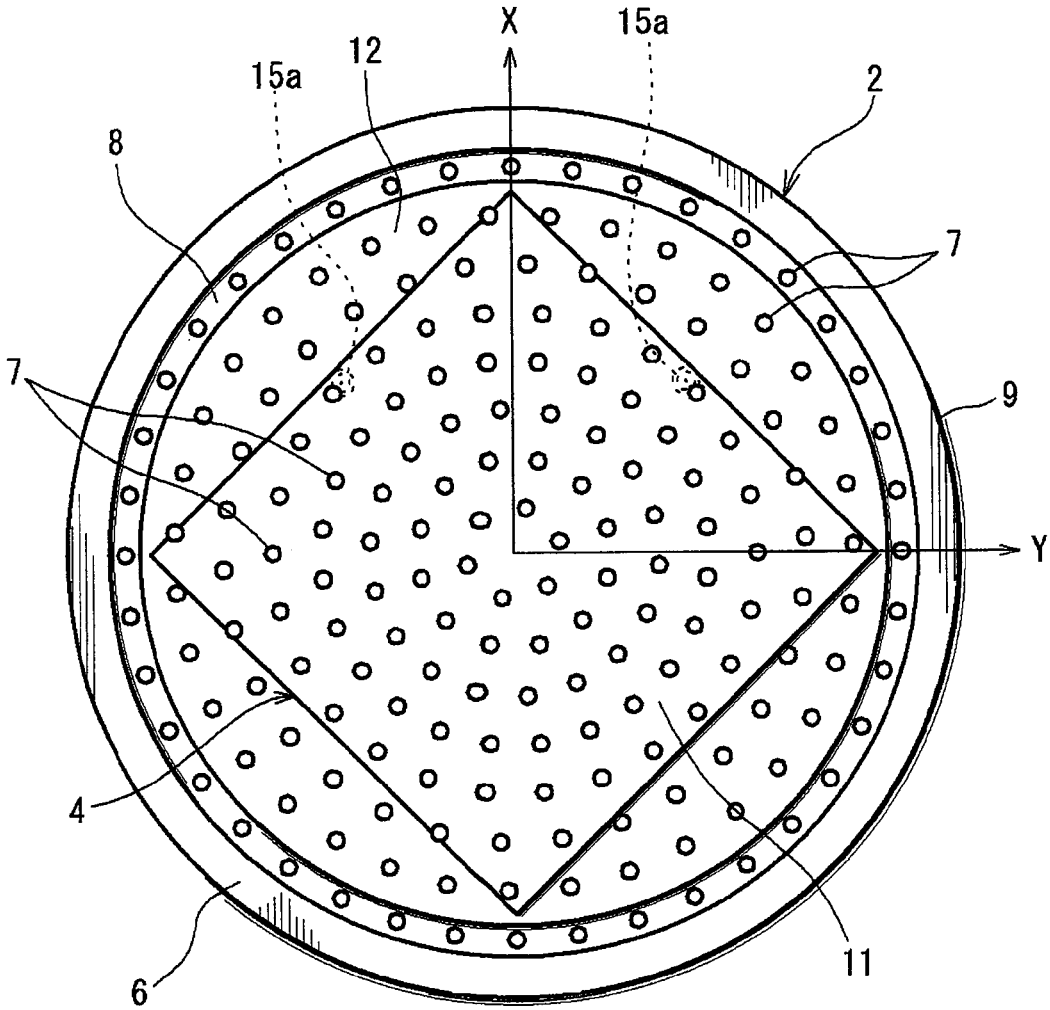
FIG. 33 is a front view of an optical unit and antenna according to still another embodiment.

FIG. 33 is a front view of still another embodiment (Sixteenth Embodiment). Antenna 4 has a patch element 11 of a rectangular outline form. Patch element 11 is provided with one pair of opposite sides and the other pair of opposite sides being inclined. A feeding point (coaxial cable 15*a*) is located at each center region of two adjacent sides. In this case, a dual polarization patch antenna of +45° polarization and −45° polarization is established. By applying a signal of equal amplitude and 90 degrees out of phase towards the two coaxial cables 15 in the present embodiment, a circular polarized antenna is established.

Figure 34:
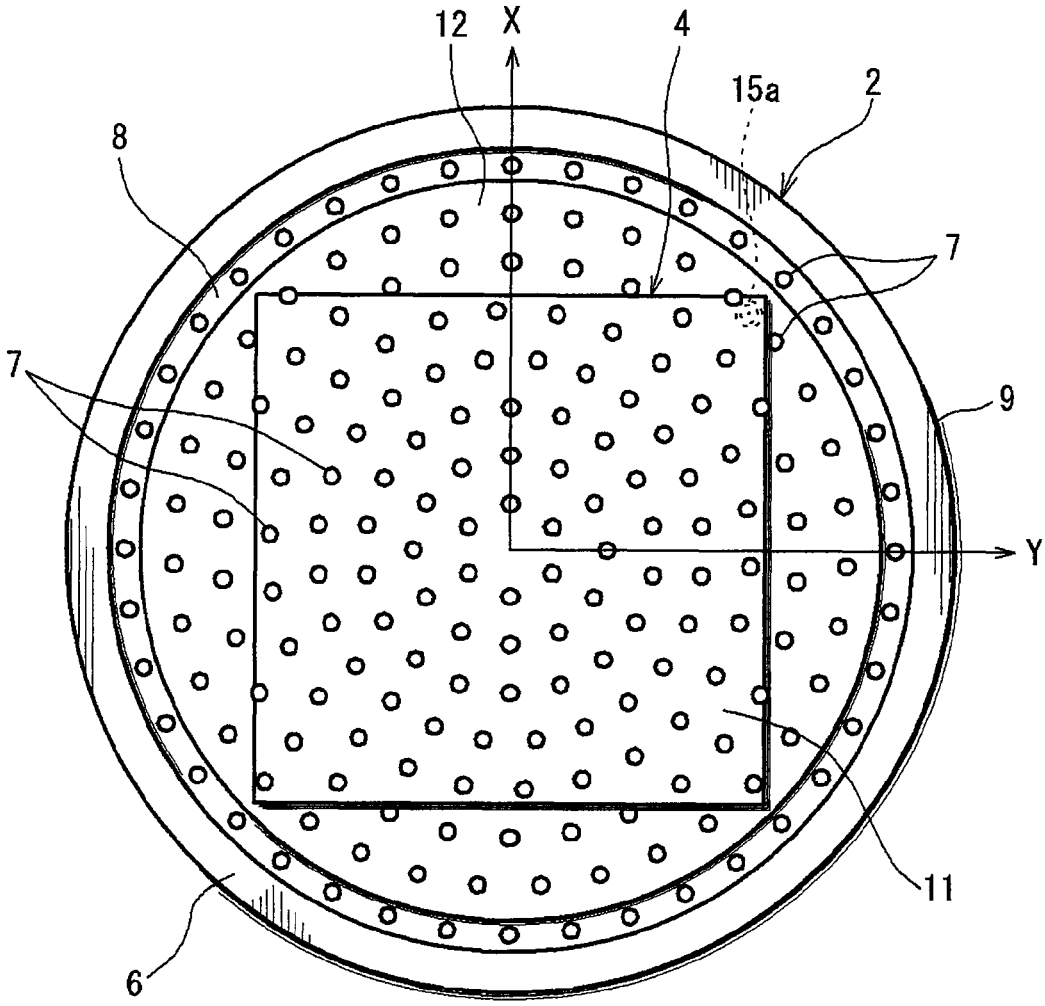
FIG. 34 is a front view of an optical unit and antenna according to still another embodiment.

FIG. 34 is a front view of still another embodiment (Seventeenth Embodiment). Patch element 11 of antenna 4 taking a rectangular outline form has one pair of opposite sides corresponding to the horizontal direction and the other pair of opposite sides corresponding to the vertical direction. One feeding point (coaxial cable 15*a*) is located at the corner of patch element 11 (on the diagonal). In this case, a circular polarized antenna is established.

Figure 35:
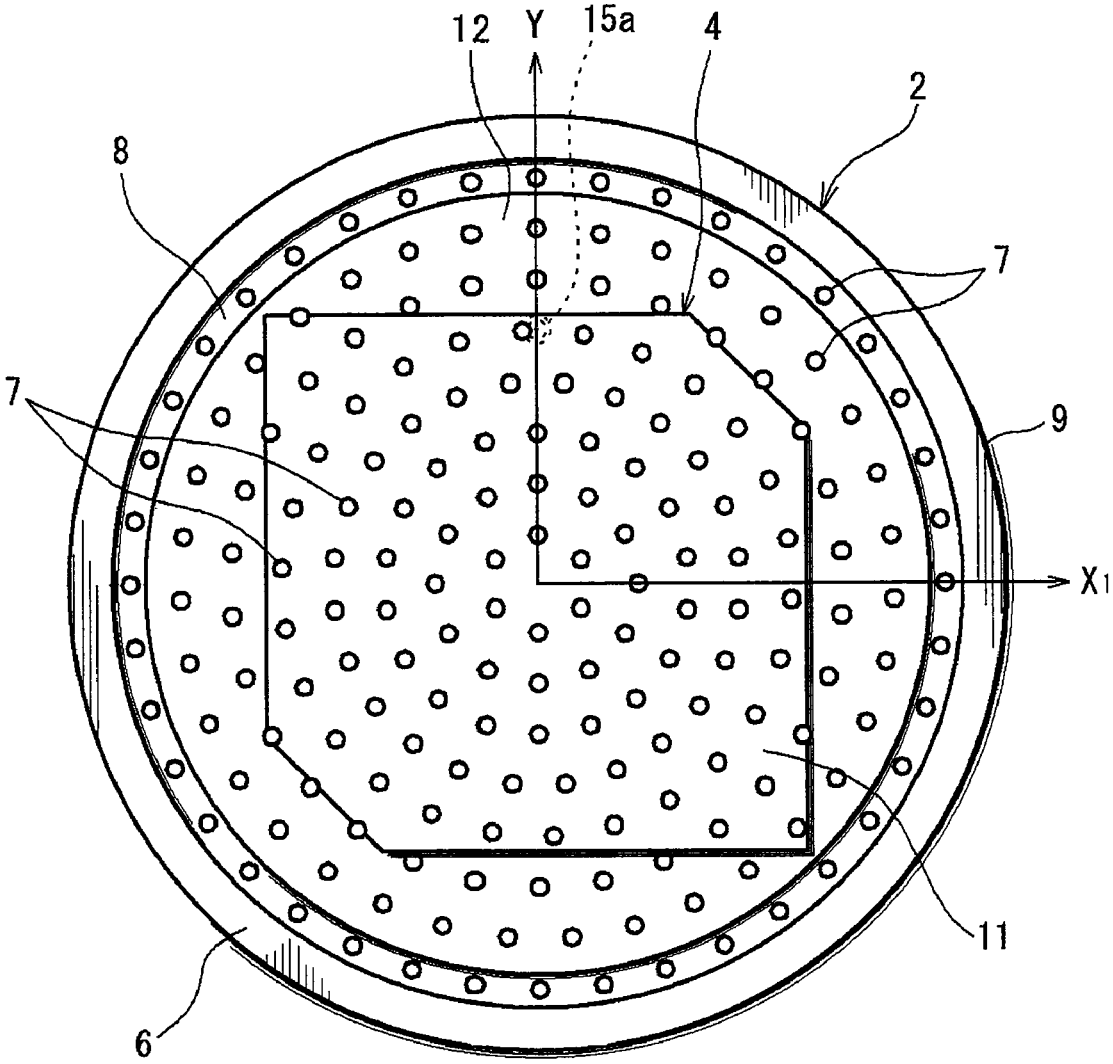
FIG. 35 is a front view of an optical unit and antenna according to still another embodiment.

FIG. 35 is a front view of still another embodiment (Eighteenth Embodiment). The outline form of patch element 11 in antenna 4 corresponds to a rectangular having a pair of diagonal corners cut away linearly (in a hexagonal shape). The feeding point towards patch element 11 through coaxial cable 15 is located on the Y axis. Accordingly, a circular polarized antenna is established.

As another embodiment, the circuit wiring (line pattern) formed at LED substrate 8 may also be used (commonly shared) as the ground element.

According to each of the embodiments set forth above, antenna 4 including patch element 11 and ground element 12 are incorporated in optical unit 2. Signal lamp apparatus 1 of FIG. 1 includes three optical units 2. Each optical unit 2 has an antenna 4 incorporated. Accordingly, antenna 4 can be installed in signal lamp apparatus 1 inconspicuously to avoid spoiling the aesthetic view of the street.

Further, since antenna 4 is incorporated in optical unit 2 of signal lamp apparatus 1, a pole dedicated to installing an antenna is dispensable. Further, since patch element 11 and ground element 12 are at the rear side of leading end 39 of LED 7, the event of impeding forward light emittance (lightening) by LED 7 can be prevented.

Further, since antenna 4 is not exposed (protruding), the expected wind load on antenna 4 does not have to be taken into account in the design of pole 40 and arm 41 (FIG. 1) for the installation of signal lamp apparatus 1. Further, anti-rust and anti-dust measures for antenna 4 do not have to be taken into account.

Further, since traffic signal lamp apparatus 1 is installed on the road in consideration of the visibility by the driver of a vehicle, a favorable line of sight state for wireless communication between antenna 4 and an in-vehicle device can be obtained inherently by installing the signal lamp apparatus of each embodiment at a predetermined position on the road. Thus, antenna 4 incorporated in optical unit 2 of signal lamp apparatus 1 can be utilized in the Intelligent Transport System (ITS) for road-vehicle wireless communication. Accordingly, a favorable communication state can be achieved.

A control device 5 (traffic signal controller) controlling traffic signal lamp apparatus 1 according to each of the embodiments set forth above can provide via antenna 4 signal information related to the current and future display of traffic signal lamp apparatus 1 towards a vehicle running along or close to the road where traffic signal lamp apparatus 1 is installed.

Signal information refers to information related to the current or future signal light colors displayed by traffic signal lamp apparatus 1, and includes the planned continuous display period, the display sequence, and the like of each signal lamp color.

For example, information set forth below may be presented in a predetermined format. The current light color displayed by signal lamp apparatus 1 is blue and the planned continuous period thereof is 5 seconds. The next light color to be displayed is the yellow signal having the planned continuous period of 8 seconds. The next light color to be displayed is a right-turn blue arrow sign having a planned continuous period of 5 to 10 seconds. The signal information to be presented may be just the current displayed light color and its continuous time, or the information of one cycle together. In addition to such information, parametric information related to spot-actuated control, at geometric spots where such control is implemented, as well as the time zone for executing control may be included.

The in-vehicle computer at the vehicle receiving such signal information can estimate the time before arriving at the halt line from the distance to the halt line, the running speed of the vehicle, acceleration and the like, and then estimate the signal light color that will be displayed at the elapse of the estimated time. For example, in the case where the signal light color is expected to be red at the time of arriving at the halt line even if a green signal is displayed at the current point of time, the in-vehicle computer should execute drive control so as to safely stop before the halt line. In the case where determination is made that the vehicle can cross the intersection safely if the speed is not lowered, control is executed to maintain the speed.

The in-vehicle computer may execute control, governed mainly by the in-vehicle device, and also assisting the driving operation of the driver such as "brake assist".

The in-vehicle computer may notify a passenger in the vehicle about the result of the above-described determination through voice and/or image information. For example, a voice message of "Stop the vehicle since the signal will soon change" can be issued towards the driver, or an appropriate text or graphic image can be displayed on the screen of the head-up display or navigation device.

The lamp apparatus of the present invention is not limited to that set forth in the above embodiments. For example, the signal lamp apparatus may be directed to a pedestrian other than to a vehicle. Further, the light emitter in the signal lamp apparatus may be a lamp bulb instead of an LED. Furthermore, although a circular ground element 12 is employed in each of the embodiments set forth above, a rectangle ground element 12 may be employed instead. Moreover, the present invention is applicable to a lighting lamp for illumination of a road in addition to a signal lamp apparatus. In this case, the light emitter includes a mercury lamp or sodium lamp.

Figure 36:
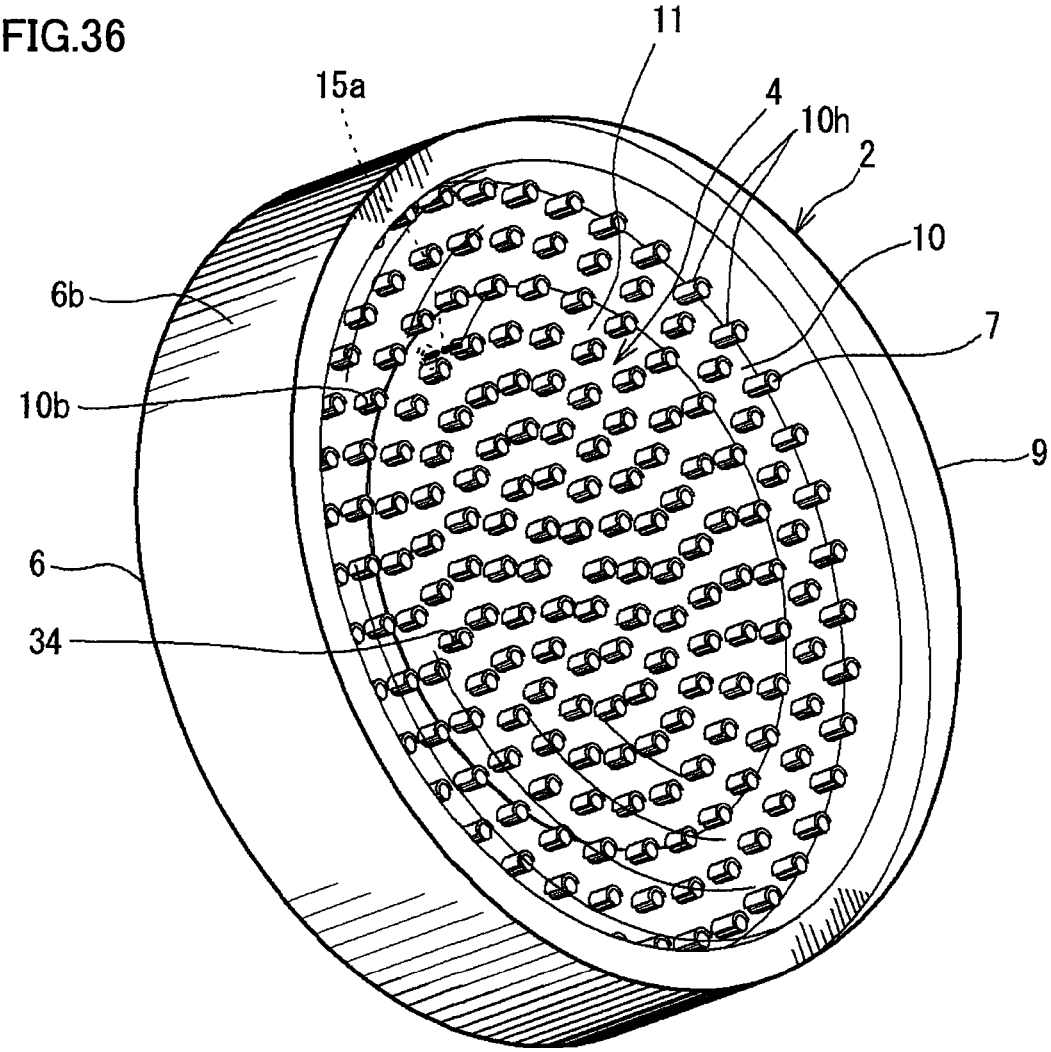
FIG. 36 is a perspective view of an optical unit including an anti-reflection member.
Figure 37:
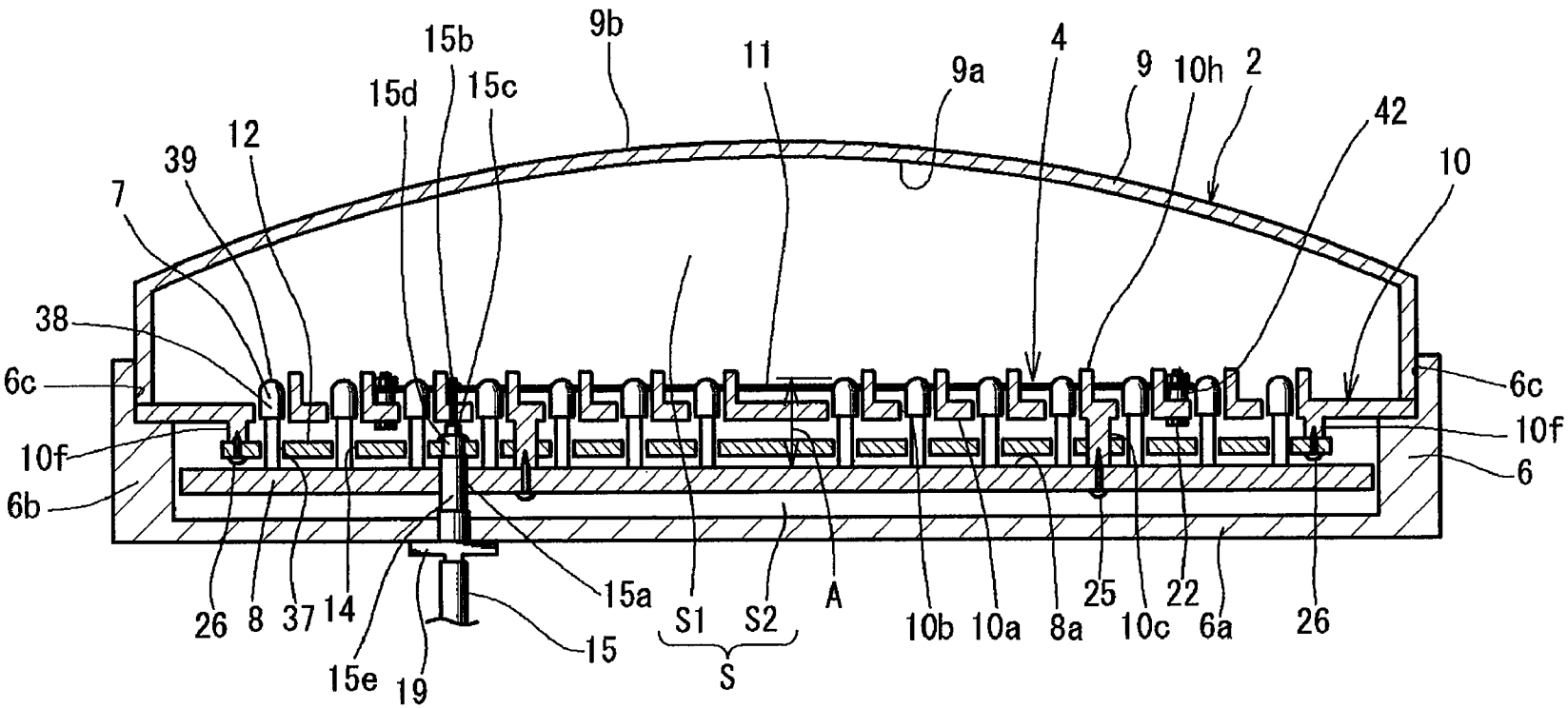
FIG. 37 is a sectional view of an optical unit including an anti-reflection member.

In each of the embodiments of the second lamp apparatus, the lamp apparatus may include an anti-reflection member. The anti-reflection member functions to prevent the externally incident light (sunlight) to optical unit 2 from being reflected by at least one of substrate 8 and LED 7. In the embodiment set forth above, the lamp apparatus includes support member 13, which supports one or both of patch element 11 and ground element 12. In this context, support member 13 may function as the anti-reflection member. FIGS. 36 and 37 are a perspective view and cross sectional view, respectively, of an optical unit 2 including an anti-reflection member 10. Referring to FIG. 37, anti-reflection member 10 supports ground element 12 at the rear side, and supports patch element 11 at the front side via spacer 42.

In the case where the above-described lamp apparatus is employed as a traffic signal lamp apparatus, the west sunlight or morning sunlight striking substrate 8 and/or LED 7 may be reflected towards the ground, and reflected light therefrom may render the light of the lamp apparatus imperceptible, or cause "pseudo lighting" giving a false appearance of being lit.

By causing support member 13 to include the function of preventing incident light directed from a predetermined direction external to optical unit 2 (oblique incident light from above such as the west sunlight or morning light) from being reflected by substrate 8 and/or LED 7, the event of the lamp apparatus being imperceptible or causing pseudo lighting can be prevented. By supporting patch element 11 with a member that prevents light reflection, the configuration can be simplified and the fabrication cost reduced by the common usage of the component.

Anti-reflection member 10 is formed of a synthetic resin material that is an insulation member, and is arranged frontward of substrate 8. Anti-reflection member 10 includes a sheet portion 10*a* formed as a circular sheet (planar). Sheet portion 10*a* is arranged at the rear side of leading end 39 of LED 7. Sheet portion 10*a* has a plurality of through holes 10*b* formed corresponding to the arrangement of LEDs 7 for the purpose of inserting LEDs 7.

Sheet portion 10*a* prevents the sunlight from directly striking substrate 8. Anti-reflection member 10 is formed of a black synthetic resin material, or at least the front face of sheet portion 10*a* is painted black to prevent reflection of sunlight. Anti-reflection member 10 is secured to storage member 6 by fitting the outer circumferential portion of sheet portion 10*a* with a step 6*c* of storage member 6, and engaging a claw not shown formed at step portion 6*c* with sheet portion 10*a*.

A boss 10*c* is formed protruding rearwards at the back face of sheet portion 10*a*. Substrate 8 is secured to sheet portion 10*a* by a screw 25 threaded with the screw hole formed at boss 10*c*. Front face 8*a* of substrate 8 abuts against the leading face of boss 10*c*. There is a distance between sheet portion 10*a* and substrate 8 corresponding to the height of boss 10*c*.

An eave 10*h* is formed protruding frontward at the upper end of through hole 10*b* of anti-reflection member 10. Eave 10*h* serves to prevent the sunlight directed obliquely from above such as the west sunlight or morning sunlight from entering the mirror reflector of LED 7. Thus, the sunlight can be prevented from being reflected by mirror reflector. The leading end of eave 10*h* protrudes outwards ahead of the leading end of LED 7. Anti-reflection member 10 may function only to prevent the sunlight from being reflected off substrate 8, or to only prevent the sunlight from being reflected off LED 7. Particularly in the case where anti-reflection member 10 is provided to prevent the incident light (sunlight) from being reflected at LED 7, direct irradiation of LED 7 with sunlight can be circumvented by virtue of anti-reflection member 10. Temperature increase at LED 7 can be suppressed to prevent reduction in the lifetime of LED 7.

[Third Lamp Apparatus]

Figure 38:
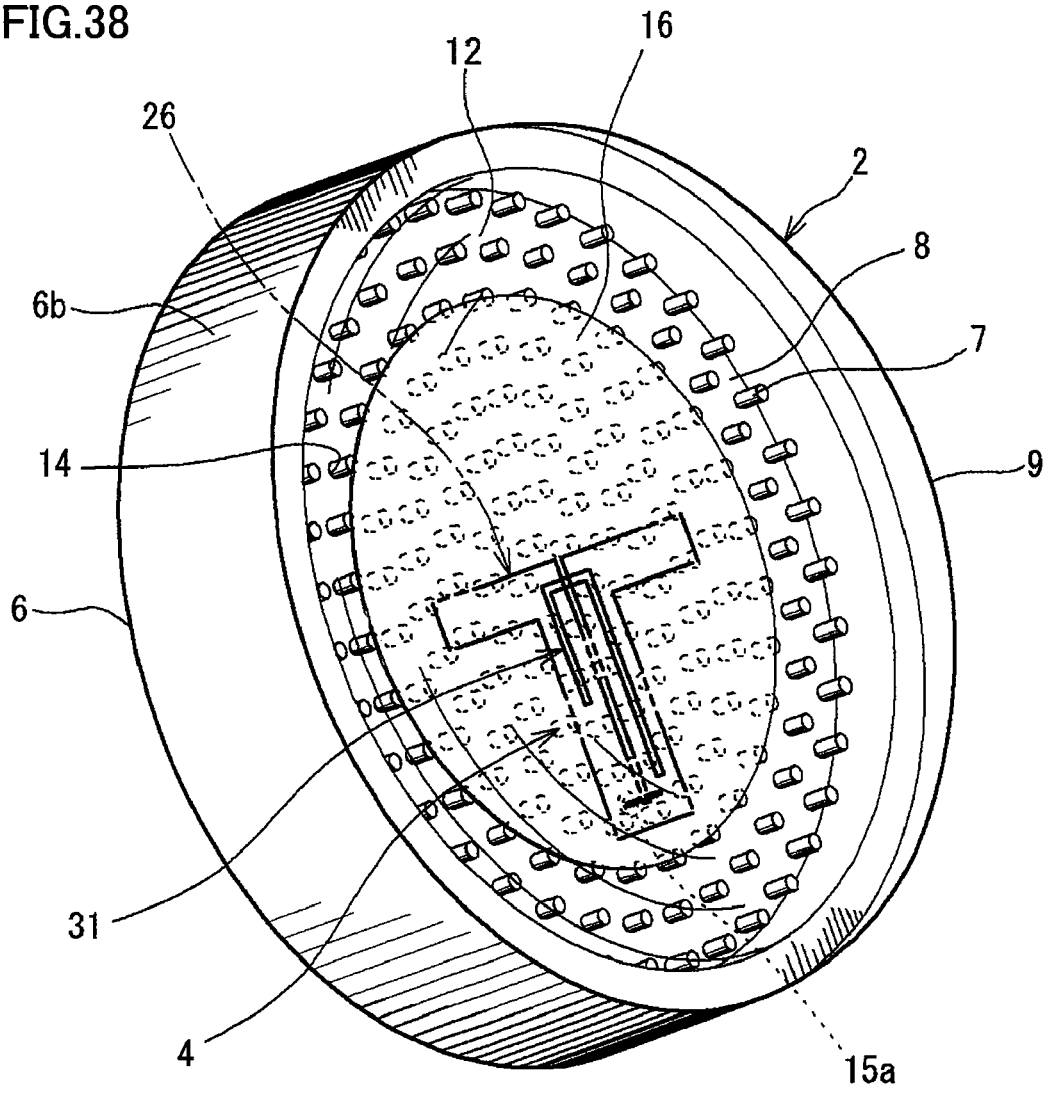
FIG. 38 is a perspective view of an optical unit.

A third lamp apparatus of the present invention will now be described. Referring to FIG. 38, this lamp apparatus (traffic signal lamp apparatus) 1 includes an optical unit 2 having a light emitter (LED) 7, and a balanced type antenna 4 incorporated in optical unit 2. By incorporating antenna 4 into optical unit 2 of lamp apparatus 1, antenna 4 can be rendered inconspicuous. Further, incorporation of antenna 4 into optical unit 2 of lamp apparatus 1 eliminates the need of a pole dedicated to installing an antenna.

Optical unit 2 includes a cover member 9 of visible-light transmittance, spread over light emitter 7 at the front. Antenna 4 is preferably situated in the range from cover member 9 up to the leading end of light emitter 7, and has visible-light transmittance.

Accordingly, antenna 4 can be incorporated into optical unit 2 of lamp apparatus 1, situated in the range from cover member 9 up to the leading end of light emitter 7. Thus, antenna 4 can be rendered inconspicuous. Although antenna 4 is situated frontward of light emitter 7, the event of impeding forward light emittance (lightening) by light emitter 7 can be prevented since antenna 4 has light transmittance.

Lamp apparatus 1 includes substrate 16 for an antenna, having visible-light transmittance, and provided between cover member 9 and the leading end of light emitter 7. Antenna 4 is constituted of patterned lines formed on antenna substrate 16. Thus, antenna 4 can be readily formed in a predetermined shape since it is provided as patterned lines on antenna substrate 16.

In this case, the line is preferably formed of a conductor in mesh structure. Alternatively, the line is preferably formed of a conductor membrane having visible-light transmittance. Accordingly, the antenna exhibits visible-light transmittance.

Alternatively, antenna 4 is constituted of patterned lines formed on cover member 9, in lamp apparatus 1. Thus, antenna 4 can be readily formed in a predetermined shape since it is provided as patterned lines on cover member 9. Moreover, this eliminates the need of another additional member for formation of antenna 4.

Lamp apparatus 1 is a traffic signal lamp. The traffic signal lamp is installed on the road in consideration of the visibility by the vehicle driver. By installing the signal lamp at a predetermined position of the road, a favorable line of sight state is obtained for executing wireless communication between the antenna and the in-vehicle device of a vehicle.

The present invention is directed to a traffic signal controller (control device 5), connected to the traffic signal lamp apparatus, for turning on and off the traffic signal lamp apparatus. The traffic signal controller is configured to transmit, through antenna 4, signal information related to display of current and future traffic signal lights for vehicles running on a road on which the traffic signal lamp apparatus is installed.

The present invention is directed to an antenna unit for a lamp apparatus incorporated into an optical unit 2 including a light emitter 7 and a cover member 9 having visible-light transmittance, and spread over light emitter 7. The antenna unit includes a balanced type antenna 4 having visible-light transmittance to allow situation in the range from cover member 9 up to the leading end of light emitter 7.

Accordingly, the antenna unit including balanced type antenna 4 can be incorporated into optical unit 2 to render antenna 4 inconspicuous. Further, since antenna 4 is incorporated in optical unit 2 of lamp apparatus 1, a pole dedicated to installing an antenna can be dispensed with. Furthermore, although antenna 4 is situated ahead of the leading end of light emitter 7 when incorporated in optical unit 2, the event of impeding forward light emittance (lightening) by light emitter 7 can be prevented since antenna 4 has visible-light transmittance.

An embodiment corresponding to a third lamp apparatus will be described hereinafter.

The front view of the third lamp apparatus of the present invention is similar to the front view of the first and second lamp apparatuses (refer to FIG. 1). The lamp apparatus is for a vehicle, specifically a traffic signal lamp apparatus 1 installed at a road (hereinafter, also simply referred to as signal lamp apparatus 1 or lamp apparatus 1).

A pole 40 is installed at the side of the road such as on a sidewalk. An arm 41 extends towards the roadway from pole 40. Signal lamp apparatus 1 is attached to arm 41.

Signal lamp apparatus 1 includes a plurality of optical units 2 (three in the drawing), and an enclosure 3 incorporating optical units 2. The three optical units 2 include red, yellow, and blue lightening colors. A visor (not shown) is attached to each optical unit 2.

A control device 5 controlling signal lamp apparatus 1 is attached to pole 40. The configuration of installation of signal lamp apparatus 1 is arbitrary, and may be other than that shown in the drawings. For example, although not shown, the form of pole 40 and arm 41 may differ. Alternatively, signal lamp apparatus 1 may be installed at a pedestrian bridge. Further, control device 5 may be provided in enclosure 3 of signal lamp apparatus 1.

Control device 5 controlling the lighting of signal lamp apparatus 1 can conduct wireless communication control through antenna 4 that will be described afterwards. Alternatively, control device 5 controlling the lighting or the like and the control device for wireless communication through antenna 4 may be different units. In the case where control devices are provided individually, the control devices can be incorporated into one same enclosure 3. Alternatively, the control device for wireless communication can be installed in the proximity (same pole 40) of the control device that controls the lighting or the like of signal lamp apparatus 1.

Figure 39:
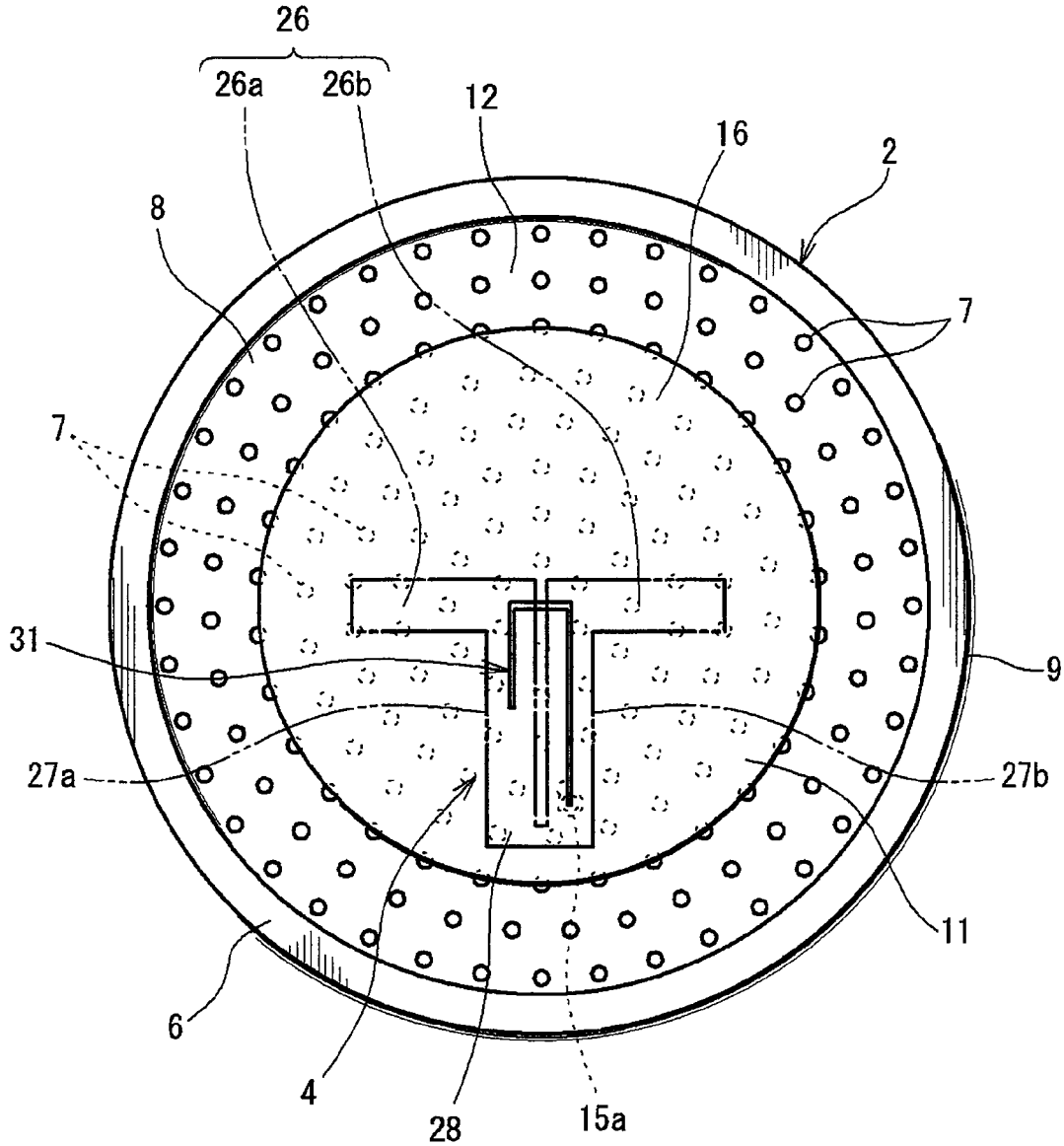
FIG. 39 is a front view of the optical unit.
Figure 40:
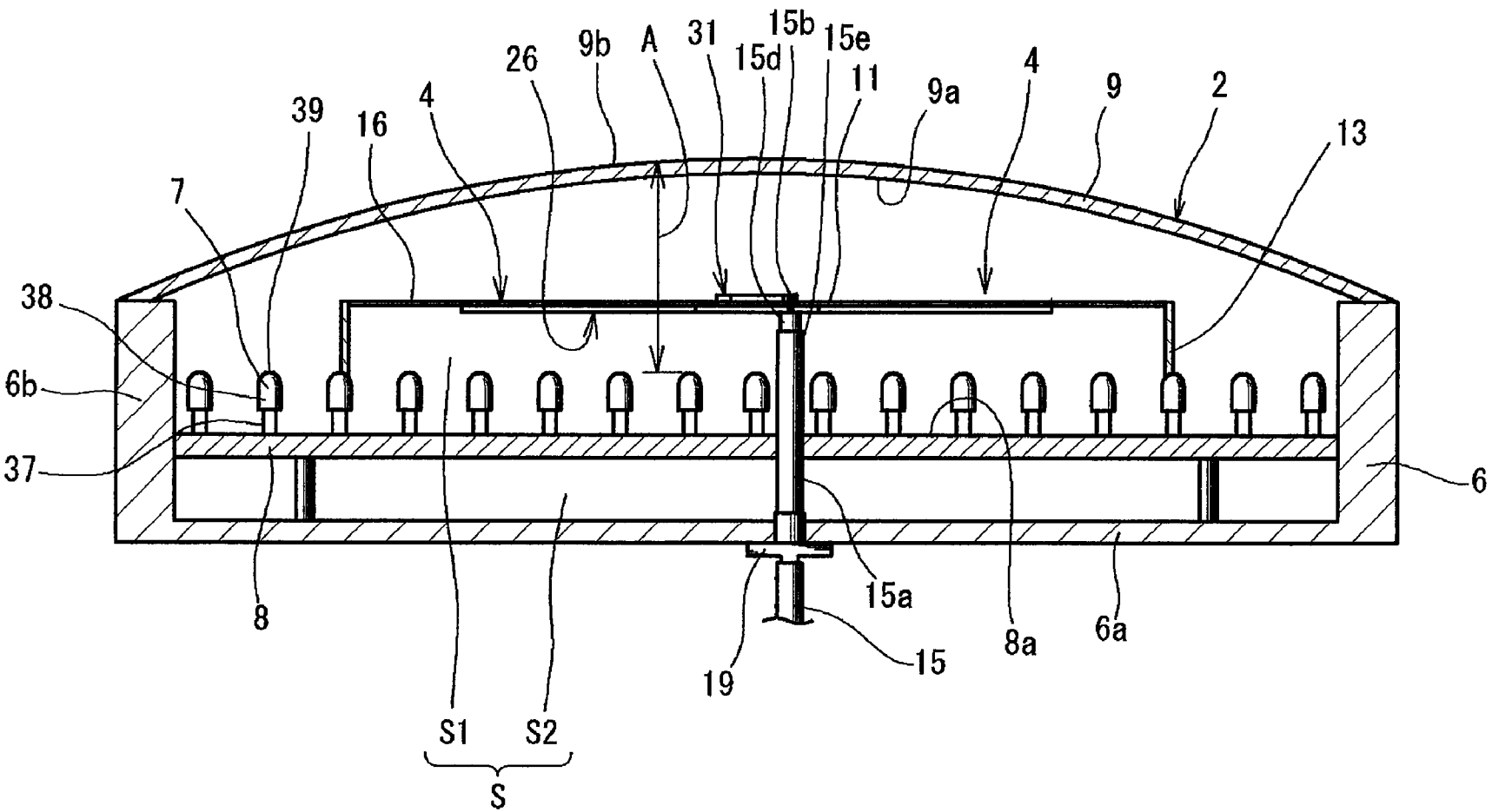
FIG. 40 is a sectional view of the optical unit.

FIGS. 38, 39 and 40 are a perspective view, front view, and cross sectional view, respectively, of one optical unit 2 (Nineteenth Embodiment). Optical unit 2 includes a light emitting diode 7 (hereinafter, LED) as the light emitter, a substrate 8 having a plurality of LEDs 7 mounted on a front face 8*a*, a storage member 6, and a cover member 9. Substrate 8 has a wiring pattern formed at the back side, and is connected to a terminal 37 of LED 7. A plurality of LEDs 7 are arranged on substrate 8, spread in planar manner. LED 7 includes a lens unit 38 in which an LED element (not shown) is provided.

Storage member 6 is dish-shaped, and opened facing the front side, including a bottom (bottom wall) 6*a*, and a side (sidewall) 6*b* upright from the circumferential edge of bottom 6*a*. Cover member 9 is attached at the front of storage member 6 corresponding to the opening side. A storage cavity S is defined between storage member 6 and cover member 9. LED 7 and substrate 8 are accommodated in storage cavity S. Substrate 8 is secured to storage member 6. In storage cavity S, the section at the front of substrate 8 is a front cavity S, and the section at the rear of substrate 8 is a rear cavity S2.

Cover member 9 has visible-light transmittance (transparent to visible light), and covers a plurality of LEDs 7 at the front side. In optical unit 2, the front side is the light projecting side (the side corresponding to cover member 9), and the rear side is the bottom 6*a* side of storage member 6.

Antenna 4 is incorporated in optical unit 2. Specifically, a substrate 16 for an antenna is provided between cover member 9 and leading end 39 of LED 7 in storage cavity S, and antenna 4 is formed on antenna substrate 16. A strip line 31 is formed at antenna substrate 16. Strip line 31 is incorporated in optical unit 2.

In the illustrated form, antenna 4 and strip line 31 are incorporated in optical unit 2 situated at the range A from cover member 9 up to leading end 39 of LED 7 (as will be described in detail afterwards). Antenna 4 and strip line 31 are accommodated (stored) in optical unit 2, i.e. in storage cavity S.

Antenna 4 is of the balanced type. The illustrated one is a dipole antenna fed with two balanced lines. Antenna 4 is constituted of a patterned line formed as a conductor membrane at one side (rear face) of antenna substrate 16. As shown in FIG. 39, antenna 4 includes a dipole 26, balanced feed lines 27*a* and 27*b*, and a portion 28 for short-circuiting the balanced feed lines. Dipole 26 includes a pair of antenna elements 26*a* and 26*b*, one at the left and one at the right. Balanced feed lines 27*a* and 27*b*, and portion 28 also serve as the ground of the strip lines.

Strip line 31 is constituted of a patterned line as a conductor membrane at the other side (front face side) of antenna substrate 16. Strip line 31 is formed extending linearly at the other face side of antenna substrate 16, corresponding to the back side of feed line 27*b*, turns its direction in a U shape at the center between antenna elements 26*a* and 26*b* of dipole 26, and then extends linearly at the other face side of antenna substrate 16, corresponding to the back side of feed line 27*a*. Strip line 31, balanced feed lines 27*a* and 27*b*, and portion 28 constitute a balun (balanced-unbalanced transformer). Antenna 4 of the present embodiment is a balun-unified type antenna having dipole antenna 4 and a balun formed at one antenna substrate 16.

At storage member 6 (bottom 6*a*), a terminal 19 to connect a coaxial cable 15 for antenna 4 is attached. Coaxial cable 15 extending from control device 5 of FIG. 1 is connected to terminal 19. Coaxial cable 15*a* extending from terminal 19 towards rear cavity S2 is connected to antenna 4. Coaxial cable 15*a* includes an inner conductor (center conductor) 15*b*, an insulator (not shown), an outer conductor 15*d*, and a cover 15*e*. Center conductor 15*b* of coaxial cable 15 is connected to strip line 31. Outer conductor 15*d* is connected to the ground (feed line 27*b*). (Refer to FIG. 40; FIG. 40 represents a cross section viewed from the bottom of FIG. 39.) Inner and outer conductors 15*b* and 15*d* can be connected and secured to each element by, but not limited to, solder.

A power supply cable (not shown) for LED 7 extending from control device 5 of FIG. 1 is connected to LED substrate 8 via a terminal (not shown) attached to bottom 6*a* of storage member 6.

Antenna substrate 16 is constituted of a circular flat sheet, supported and secured, frontward of leading end 39 of LED 7, by means of support member 13 (refer to FIG. 40) provided upright towards the front from LED substrate 8. Support member 13 is constituted of an insulation member. Antenna substrate 16 is arranged at the front, facing LED substrate 8.

Antenna substrate 16 is a dielectric substrate, formed of a material having visible-light transmittance. Specific examples of the material include glass, polycarbonate, acryl, and polyethylene terephthalate. Antenna substrate 16 has a thickness of approximately 1 mm.

Since antenna substrate 16 is provided frontward of leading end 39 of LED 7, antenna 4 and strip line 31 patterned on antenna substrate 16 are located in the range A from cover member 9 up to leading end 39 of LED 7.

In FIG. 40, cover member 9 has a concave-curved rear face (back face) 9*a* and a convex-curved front face 9*b*. Antenna substrate 16 is provided at the rear of and apart from rear face 9*a* of cover member 9. The outline of antenna substrate 16 may be a rectangle instead of a circle, although not shown. Although cover member 9 is set with concave and convex curved faces, a flat cover member 9 may be employed if signal lamp apparatus 1 is an LED lamp.

In accordance with the configuration set forth above, antenna 4 and a support member (attachment) 13 to situate antenna 4 (antenna substrate 16 having antenna 4 and strip line 31 formed) in the range from cover member 9 up to leading end 39 of LED 7 constitute an antenna unit. This antenna unit is incorporated in signal lamp apparatus 1.

Since antenna 4 and strip line 31 are provided frontward of leading end 39 of LED 7 in signal lamp apparatus 1, antenna 4 and strip line 31 are configured having visible-light transmittance in the direction from one face to the other face of antenna substrate 16 (front-back direction) in order to avoid impeding forward light projection of LED 7. Antenna substrate 16 where antenna 4 and strip line 31 are formed have visible-light transmittance (transparent to visible light) in the thickness direction (front-back direction) across the entire face.

Specifically, antenna substrate 16 is transparent as set forth above, and has visible-light transmittance itself. Therefore, by the mesh structure of antenna 4 and strip line 31 on antenna substrate 16, antenna substrate 16 having antenna 4 and strip line 31 formed exhibits visible-light transmittance.

A mesh based on a metal film (metal membrane) is formed at one face and the other face of antenna substrate 16 to establish the mesh structure for antenna 4 and strip line 31. As a specific example of antenna 4 and strip line 31 of the metal film mesh, a fine mesh constituted of a conductor having, for example, a line width of 10 μm and a pitch (mesh distance) of 100 μm is formed at the plane of antenna substrate 16. In the case where a fine mesh is formed at antenna substrate 16, the line width is preferably at least 1 μm and not more than 50 μm and the pitch is preferably at least 50 μm and not more than 1000 μm. Further preferably, the line width is at least 5 μm and not more than 50 μm, and the pitch is at least 100 μm and not more than 1000 μm.

The mesh shape is not limited to a quadrilateral, and may be a triangle, or take an honeycomb shape. Alternatively, the form of radials (the shape of a spider web) or the like may be employed as a whole.

Antenna 4 and strip line 31 can be formed from a conductor membrane (metal membrane) having visible-light transmittance to exhibit visible-light transmittance. Formation of this conductor membrane at antenna substrate 16 allows antenna 4 and strip line 31 to be formed thin and in a predetermined shape. In this case, the thickness of the conductor membrane is preferably set to at least 1 μm and not more than 100 μm. Accordingly, antenna 4 and strip line 31 can exhibit visible-light transmittance.

There are many methods to form antenna 4 and strip line 31 at antenna substrate 16, as set forth below. Antenna 4 and strip line 31 may be formed individually, each which is attached to antenna substrate 16. In this case, antenna 4 and strip line 31 are attached to antenna substrate 16 by an adhesive member (an adhesive tape). Alternatively, antenna 4 and strip line 31 may be formed by applying metal deposition to antenna substrate 16. Alternatively, antenna 4 and strip line 31 may be formed by printing onto antenna substrate 16. Further alternatively, a metal coat may be applied on antenna substrate 16 to form antenna 4 and strip line 31.

Antenna 4 and strip line 31 are preferably formed of a conductive material having high conductivity. For example, a metal foil such as of copper, a copper alloy including brass, and aluminium are preferable. A metal foil such as of steel, nickel, or other metals may also be employed.

Storage member 6 of optical unit 2 is formed of a steel sheet, or made of aluminium or resin. Cover member 9 is a lens made of glass or resin. Although cover member 9 is formed of a concave and convex curved plane in the present embodiment, cover member 9 may be formed as a flat sheet such as flat glass instead of a lens if signal lamp apparatus 1 is an LED lamp apparatus.

Figure 41:
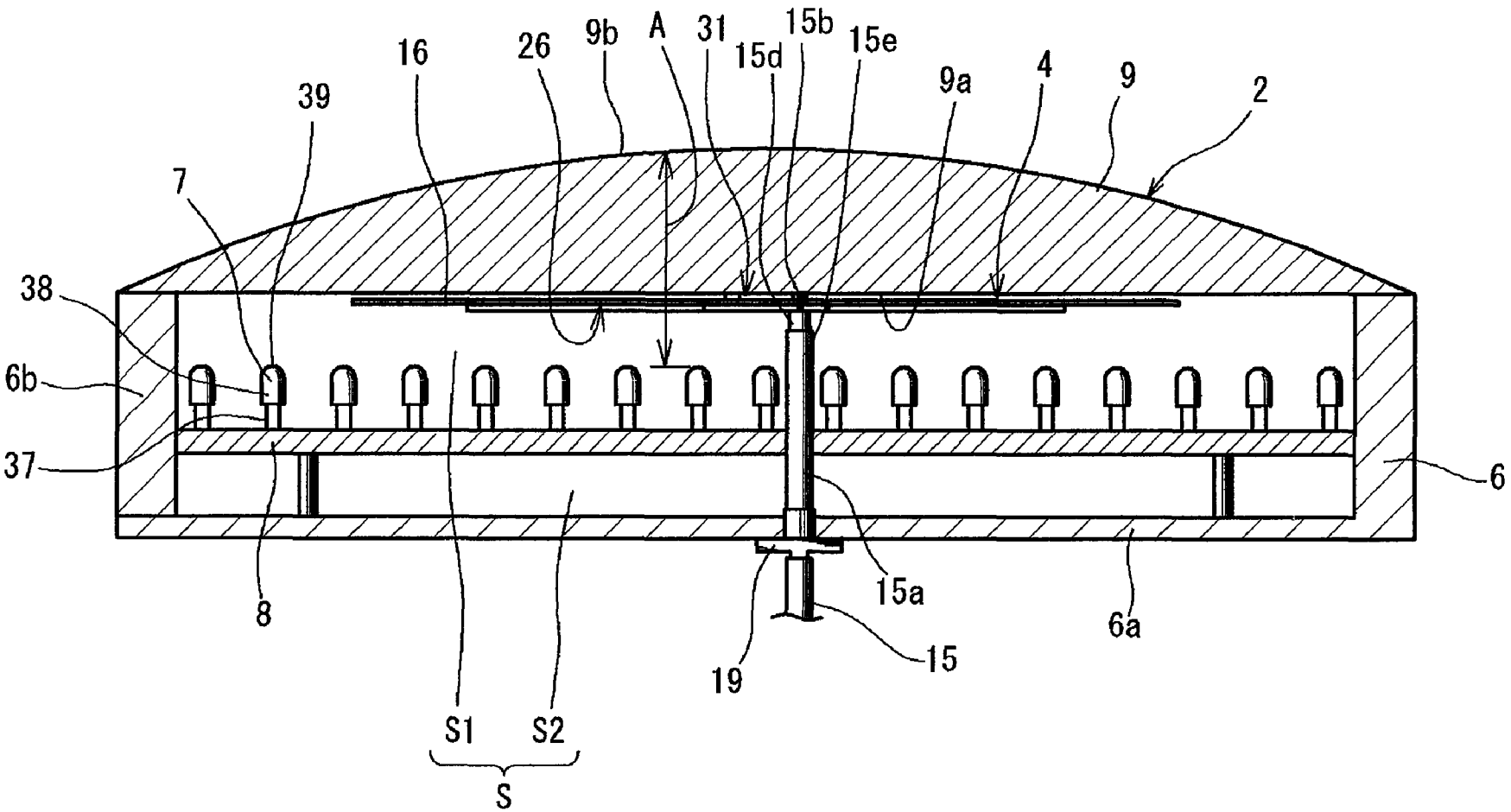
FIG. 41 is a sectional view of an optical unit and antenna in a lamp apparatus according to another embodiment.

Another embodiment (Twentieth Embodiment) of an antenna-embedded signal lamp apparatus having antenna 4 incorporated in optical unit 2 will be described. FIG. 41 is a sectional view of optical unit 2 and antenna 4 incorporated in the signal lamp apparatus. Likewise with the previous embodiment, the signal lamp apparatus includes optical unit 2 and antenna 4 incorporated in optical unit 2. Optical unit 2 includes an LED substrate 8 having LEDs 7 mounted, and a cover member 9 of visible-light transmittance, spread over LEDs 7 at the front. Antenna 4 and strip line 31 are situated in a range A from cover member 9 up to leading end 39 of LED 7, and have visible-light transmittance.

The difference between the embodiment of FIG. 41 and the previous embodiment of FIG. 40 lies in the form of cover member 9, and the attachment of antenna substrate 16 where antenna 4 and strip line 31 are formed. The remaining configuration is similar.

Referring to FIG. 41, cover member 9 has a convex-curved front face 9*b* and a flat rear face 9*a*. To this rear face 9*a* of cover member 9 is attached antenna substrate 16 having antenna 4 and strip line 31 formed at each plane. This attachment can be effected by, for example, adhesion.

As a modification of the attachment of antenna substrate 16 to cover member 9, antenna substrate 16 on which antenna 4 and strip line 31 are formed may be attached to concave-curved rear face 9*a* of cover member 9 shown in FIG. 40. In this case, antenna 4, strip line 31, and antenna substrate 16 all take a curved shape along the concave-curved plane of cover member 9.

Figure 42:
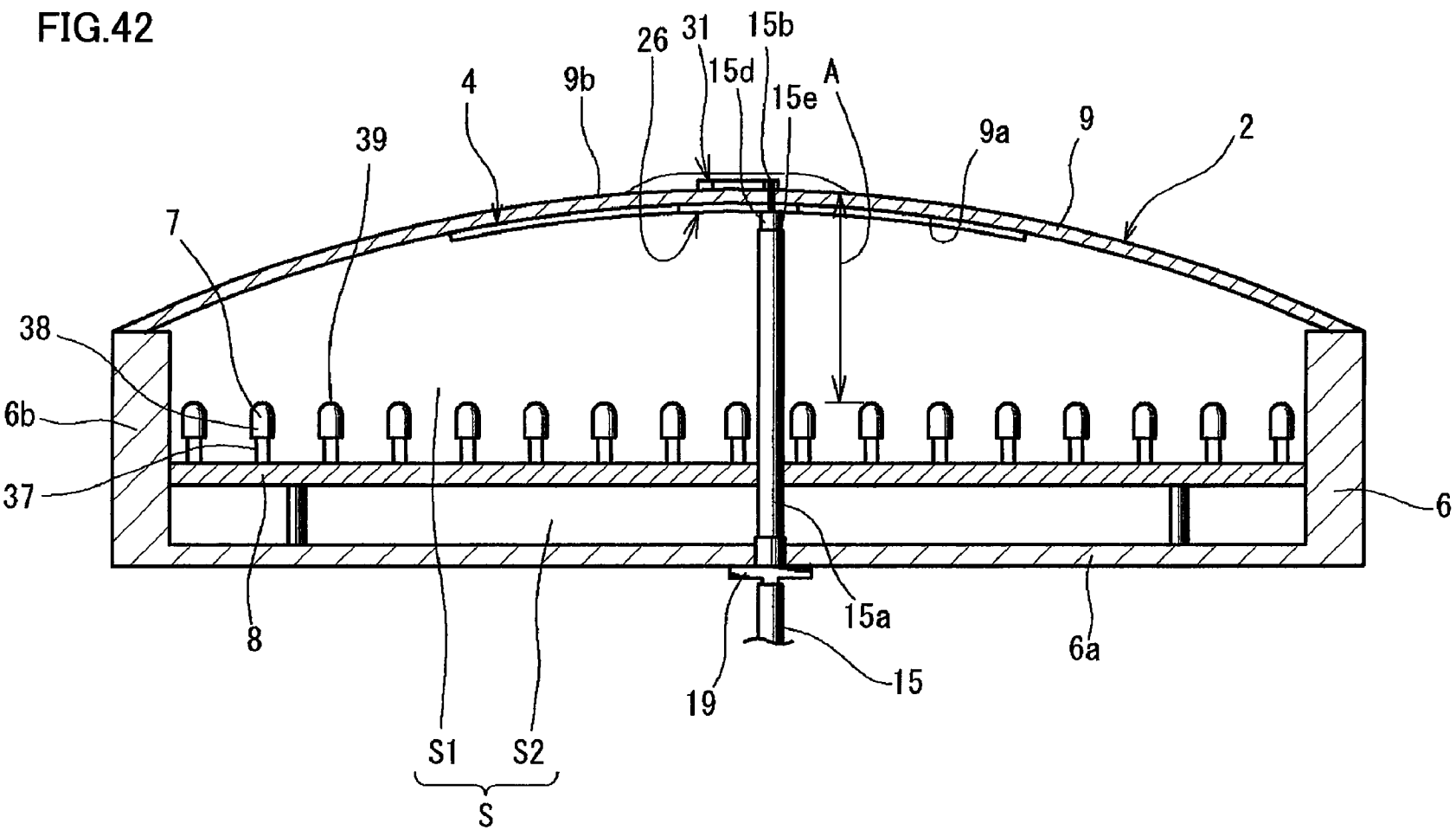
FIG. 42 is a sectional view of an optical unit and antenna in a lamp apparatus according to still another embodiment.

Still another embodiment (Twenty-First Embodiment) of an antenna-embedded signal lamp apparatus will be described. FIG. 42 is a sectional view of optical unit 2 and antenna 4 incorporated in the signal lamp apparatus.

The difference between the embodiment of FIG. 42 and the previous embodiment (FIG. 40) lies in the member where antenna 4 and strip line 31 are formed. The remaining configuration is similar. Referring to FIG. 42, antenna 4 is constituted of a patterned line at cover member 9. Cover member 9 serves as antenna substrate 16, as well as a member to protect LED 7 and the like. Antenna 4 is formed at rear face 9*a* of cover member 9. Strip line 31 is formed at front face 9*b*.

Similarly in this case, antenna 4 and strip line 31 can be set as lines of mesh structure patterned at rear face 9*a* and front face 9*b* of cover member 9. Alternatively, they can be set as lines of patterned conductor membrane. Thus, antenna 4 and strip line 31 exhibit visible-light transmittance in the front-back direction.

In this case, a cover sheet for protection is preferably provided on strip line 31 formed at surface 9*b*. This cover sheet has visible-light transmittance.

Figure 43:
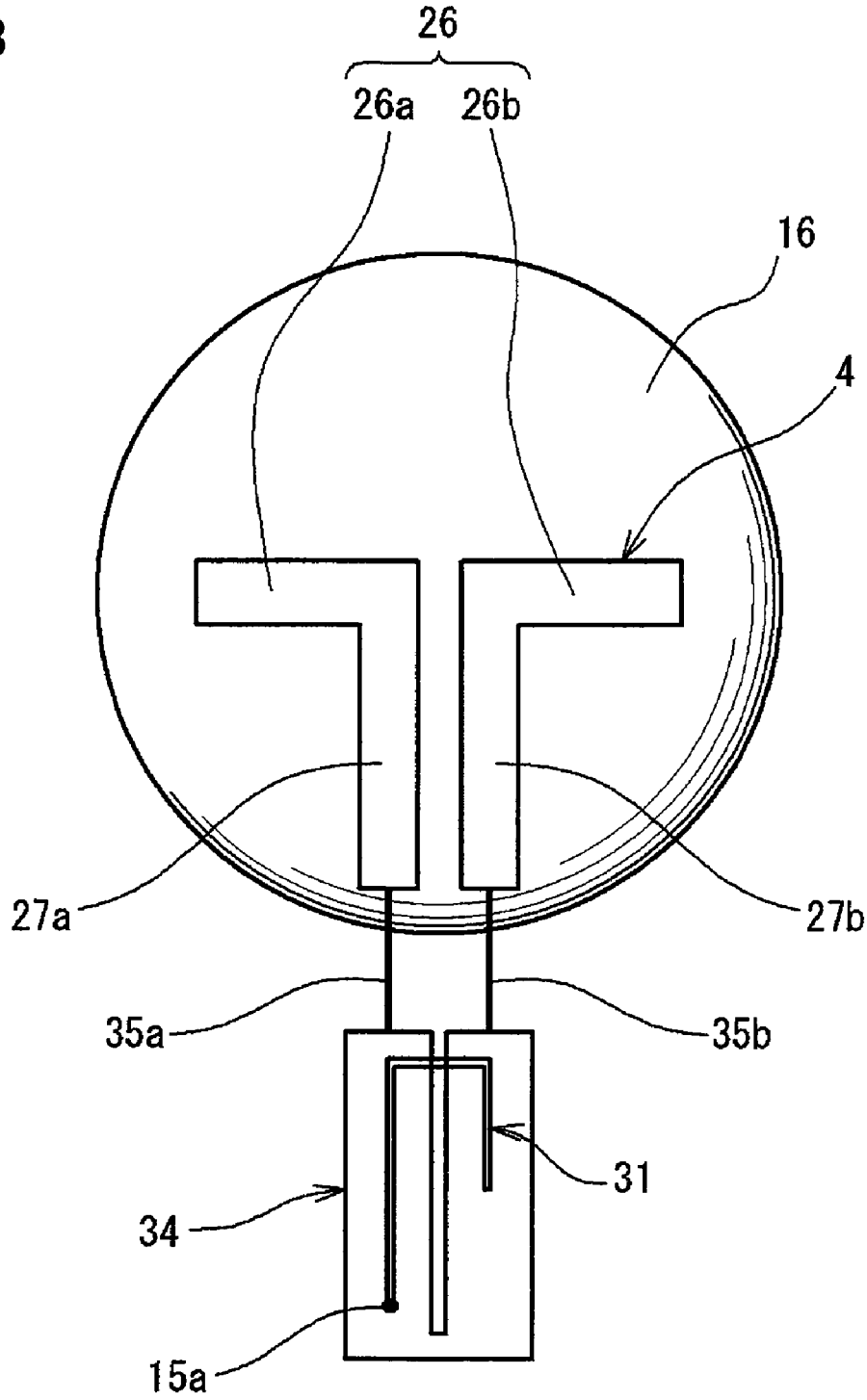
FIG. 43 is a diagram to describe an antenna in a lamp apparatus according to still another embodiment.

Still another embodiment (Twenty-Second Embodiment) of an antenna-embedded signal lamp apparatus will be described. Likewise with the previous embodiments (FIGS. 39 and 40), the signal lamp apparatus has antenna substrate 16 stored in optical unit 2. FIG. 43 is a diagram to describe the antenna of the antenna-embedded signal lamp apparatus. Antenna 4 is formed at one face of antenna substrate 16, likewise with the embodiment of FIG. 39, whereas balun 34 is provided separately from antenna substrate 16. The antenna of the present embodiment is of a balun individual type.

Balun 34 is provided at the rear of antenna substrate 16, for example, and connected to coaxial cable 15*a*. Balun 34 and antenna 4 are connected through two cables 35*a* and 35*b*.

Antenna 4 is patterned on one face of antenna substrate 16. Antenna substrate 16 (antenna 4) is situated in the range from cover member 9 up to leading end 39 of LED 7. Accordingly, antenna 4 has visible-light transmittance in the direction from one face to the other face of antenna substrate 16 to avoid impeding forward light projection of LED 7. Likewise with the previous embodiments (FIGS. 39 and 40), antenna substrate 16 is transparent and exhibits visible-light transmittance per se. Antenna 4 on antenna substrate 16 exhibits visible-light transmittance by taking a mesh structure/conductor membrane.

According to each of the embodiments set forth above, antenna 4 is incorporated in optical unit 2 of signal lamp apparatus 1. Signal lamp apparatus 1 of FIG. 1 includes three optical units 2. Each optical unit 2 has an antenna 4 incorporated. Accordingly, antenna 4 can be installed in signal lamp apparatus 1 inconspicuously to avoid spoiling the aesthetic view of the street.

Since antenna 4 is incorporated in optical unit 2 of signal lamp apparatus 1, a pole dedicated to installing an antenna is dispensable. Further, although antenna 4 and strip line 31 are situated frontward of LED 7, the event of impeding forward light emittance (lightening) by LED 7 can be prevented since antenna 4 and strip line 31 have visible-light transmittance.

Further, since antenna 4 is not exposed (protruding), the expected wind load on antenna 4 does not have to be taken into account in the design of pole 40 and arm 41 (FIG. 1) for the installation of signal lamp apparatus 1. Further, anti-rust and anti-dust measures for antenna 4 do not have to be taken into account.

Further, since traffic signal lamp apparatus 1 is installed on the road in consideration of the visibility by the driver of a vehicle, a favorable line of sight state for wireless communication between antenna 4 and an in-vehicle device can be obtained inherently by installing the signal lamp apparatus of each embodiment at a predetermined position. According to each embodiment, the light projecting direction by light projecting unit 2 can be made to substantially match the directivity of antenna 4 as the front side from signal lamp apparatus 1. Thus, antenna 4 incorporated in optical unit 2 can be utilized in the Intelligent Transport System (ITS) for road-vehicle wireless communication. Accordingly, a favorable communication state can be achieved.

A control device 5 (traffic signal controller) controlling traffic signal lamp apparatus 1 according to the present embodiments can provide via antenna 4 signal information related to the current and future display of traffic signal lamp apparatus 1 towards a vehicle running along or close to the road where traffic signal lamp apparatus 1 is installed.

Signal information refers to information related to the current or future signal light colors displayed by traffic signal lamp apparatus 1, and includes the planned continuous display period, the display sequence, and the like of each signal lamp color.

For example, information set forth below is presented in a predetermined format. The current light color displayed by signal lamp apparatus 1 is blue and the planned continuous period thereof is 5 seconds. The next light color to be displayed is the yellow signal having the planned continuous period of 8 seconds. The next light color to be displayed is a right-turn blue arrow sign having a planned continuous period of 5 to 10 seconds. The signal information to be presented may be just the current displayed light color and its continuous time, or the information of one cycle together. In addition to such information, parametric information related to spot-actuated control, at geometric spots where such control is implemented, as well as the time zone for executing control may be included.

The in-vehicle computer at the vehicle receiving such signal information can estimate the time before arriving at the halt line from the distance to the halt line, the running speed of the vehicle, acceleration and the like, and then estimate the signal light color that will be displayed at the elapse of the estimated time. For example, in the case where the signal light color is expected to be red at the time of arriving at the halt line even if a green signal is displayed at the current point of time, the in-vehicle computer should execute drive control so as to safely stop before the halt line. In the case where determination is made that the vehicle can cross the intersection safely if the speed is not lowered, control is executed to maintain the speed.

The in-vehicle computer may execute control, governed mainly by the in-vehicle device, and also assisting the driving operation of the driver such as "brake assist".

The in-vehicle computer may notify a passenger in the vehicle about the result of the above-described determination through voice and/or image information. For example, a voice message of "Stop the vehicle since the signal will soon change" can be issued towards the driver, or an appropriate text or graphic image can be displayed on the screen of the head-up display or navigation device.

The lamp apparatus of the present invention is not limited to that set forth in the above embodiments. For example, the signal lamp apparatus may be directed to a pedestrian other than to a vehicle. Further, the light emitter in the signal lamp apparatus may be a lamp bulb instead of an LED. Furthermore, the balanced type antenna is not limited to the aforementioned dipole antenna, and may be a loop antenna. Moreover, the present invention is applicable to a lighting lamp for illumination of a road in addition to a signal lamp apparatus. In this case, the light emitter includes a mercury lamp or sodium lamp.

In each of the embodiments of the third lamp apparatus, the lamp apparatus may include an anti-reflection member 10. Likewise with the first and second apparatuses, the configuration of anti-reflection member is similar to those in the first and second apparatuses.

[Overall Configuration of Communication System and Traffic Signal Lamp Apparatus]

FIG. 1 is a front view representing an embodiment of a communication system including traffic signal lamp apparatus 1. The communication system includes a traffic signal lamp apparatus 1 (hereinafter, also simply referred to as signal lamp apparatus 1 or lamp apparatus 1), an antenna 4 provided at this signal lamp apparatus 1, and a control device 5 for controlling wireless communication through antenna 4. Signal lamp apparatus 1 shown in FIG. 1 is installed on the road, and is for a vehicle.

A pole 40 is installed at the side of the road such as on a sidewalk. An arm 41 extends towards the roadway from pole 40. Signal lamp apparatus 1 is attached to arm 41.

Signal lamp apparatus 1 includes a plurality of optical units 2 (three in the drawing), and an enclosure 3 incorporating optical units 2. The three optical units 2 include red, yellow, and blue lightening colors. A visor (not shown) is attached to each optical unit 2.

A control device 5 for controlling the lighting of signal lamp apparatus 1 and for controlling wireless communication that will be described afterwards is attached to pole 40.

The configuration of installation of signal lamp apparatus 1 is arbitrary, and may be other than that shown in the drawings. For example, although not shown, the form of pole 40 and arm 41 may differ. Alternatively, signal lamp apparatus 1 may be installed at a pedestrian bridge. Further, control device 5 may be provided in enclosure 3 of signal lamp apparatus 1.

Control device 5 controlling the lighting of signal lamp apparatus 1 can conduct wireless communication control through antenna 4 that will be described afterwards. Alternatively, control device 5 controlling the lighting or the like and the control device for wireless communication through antenna 4 may be different units. In the case where control devices are provided individually, the control devices can be incorporated into one same enclosure 3. Alternatively, the control device for wireless communication can be installed in the proximity (same pole 40) of the control device that controls the lighting or the like of signal lamp apparatus 1.

FIGS. 2, 3 and 4 are a perspective view, front view, and cross sectional view, respectively, of one optical unit 2 in traffic signal lamp apparatus 1 of the communication system. Optical unit 2 includes a light emitting diode 7 (hereinafter, LED) as the light emitter, a substrate 8 having a plurality of LEDs 7 mounted on a front face 8*a*, a storage member 6, and a cover member 9. Substrate 8 has a line pattern formed at the front side or back side, and connected to a terminal 37 of LED 7. A plurality of LEDs 7 are arranged on substrate 8, spread in planar manner. LED 7 includes a lens unit 38 in which an LED element (not shown) is provided.

Storage member 6 is dish-shaped, and opened facing the front side, including a bottom (bottom wall) 6*a*, and a side (sidewall) 6*b* upright from the circumferential edge of bottom 6*a*. Cover member 9 is attached at the front of storage member 6 corresponding to the opening side. A storage cavity S is defined between storage member 6 and cover member 9. LED 7 and substrate 8 are accommodated in storage cavity S. Substrate 8 is secured to storage member 6. In storage cavity S, the section at the front of substrate 8 is a front cavity S, and the section at the rear of substrate 8 is a rear cavity S2.

Cover member 9 has visible-light transmittance (transparent to visible light), and covers a plurality of LEDs 7 at the front side. In optical unit 2, the front side is the light projecting side (the side corresponding to cover member 9), and the rear side is the bottom 6*a* side of storage member 6.

Antenna 4 is incorporated in optical unit 2. Signal lamp apparatus 1 includes a plurality of optical units 2 and antenna 4 incorporated in optical unit 2. In the present embodiment, antenna 4 is a patch antenna, including a patch element 11 and a ground element 12. Patch element 11 and ground element 12 are stored in optical unit 2, i.e. in storage cavity S.

Figure 44:
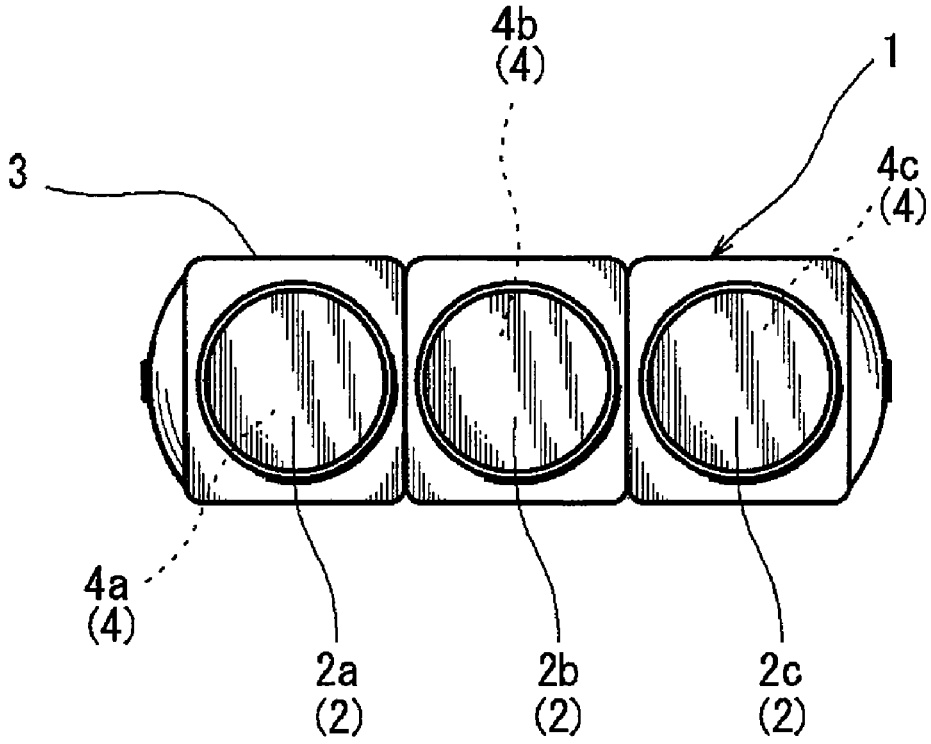
FIG. 44 is a front view of a signal lamp apparatus.

FIG. 44 is a front view of signal lamp apparatus 1. In this drawing, signal lamp apparatus 1 includes three optical units 2*a*, 2*b* and 2*c*. In the illustrated embodiment, a plurality of antennas 4*a*, 4*b* and 4*c* identical in number to those of optical unit 2 (three in the drawing) are provided at signal lamp apparatus 1. Antennas 4*a*, 4*b* and 4*c* are selectively incorporated in optical units 2*a*, 2*b* and 2*c*, respectively. Specifically, a first antenna 4*a* is incorporated into first optical unit 2*a* located at the left side. Second antenna 4*b* is incorporated in second optical unit 2*b* located at the middle. Third antenna 4*c* is incorporated in third optical unit 2*c* located at the right side.

Thus, one antenna 4 is incorporated in one optical unit 2. Since another antenna 4 is incorporated in another optical unit 2, antennas 4*a*, 4*b* and 4*c* are located at signal lamp apparatus 1 with mutual distance.

In a signal lamp apparatus for a vehicle, the distance between the centers of optical units 2 takes a predetermined value (generally, approximately 40 cm). Therefore, the plurality of antennas 4*a*, 4*b* and 4*c* are installed distant from each other in a state of an antenna distance (substantially) identical to the distance between the centers. The plurality of antennas 4*a*, 4*b* and 4*c* constitute a set of antenna unit. One set of antenna unit is provided for one signal lamp apparatus 1. The communication system of the present invention is based on a multi-antenna system. The form and attachment of each antenna 4 is similar to that of the first, second and third lamp apparatuses set forth above.

Figure 45:
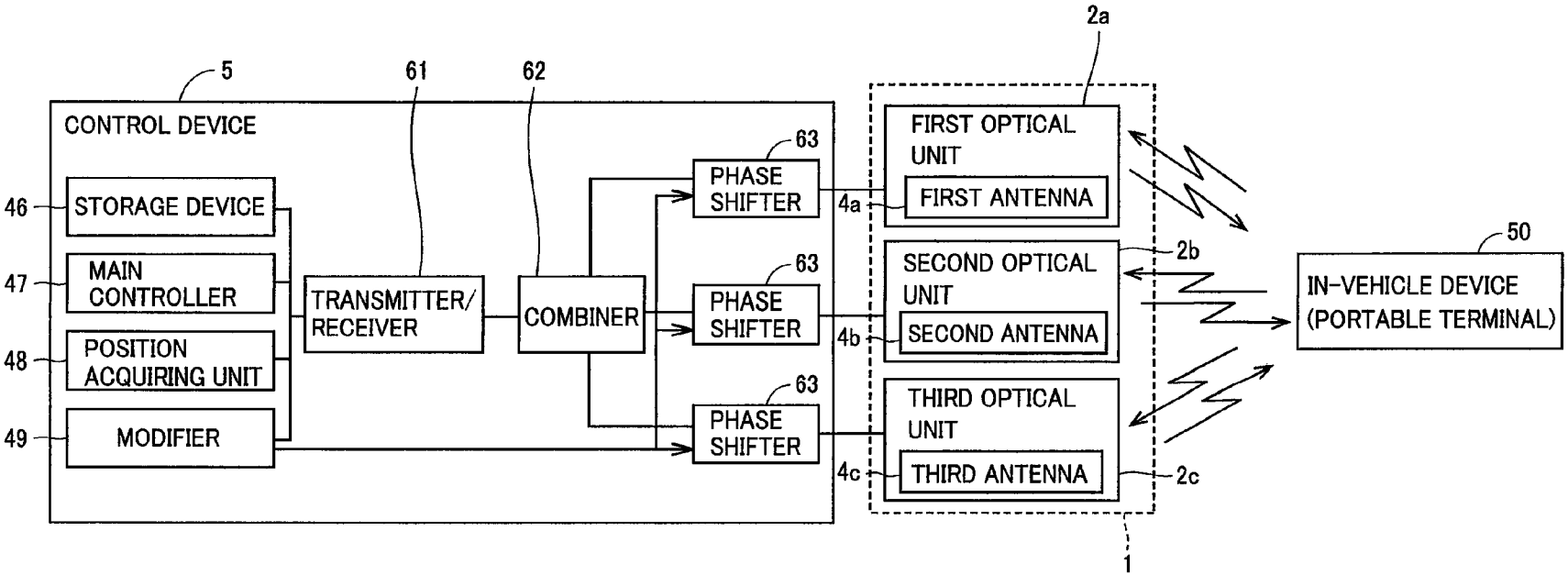
FIG. 45 is a block diagram of a communication system.

FIG. 45 is a block diagram of a communication system of the present invention.

Control device 5 is based on a programmable microcomputer including a CPU and a storage device 46 to control the lighting of optical units 2*a*, 2*b* and 2*c* as well as to control the operation of wireless communication through antennas 4*a*, 4*b* and 4*c*. Specifically, by a virtue of the incorporation of a plurality of antennas 4*a*, 4*b* and 4*c* in optical units 2*a*, 2*b* and 2*c*, control device 5 can implement control at a multi-antenna system, for example diversity control, through these plurality of antennas 4*a*, 4*b* and 4*c*.

Control device 5 includes storage device 46 storing a program for execution of respective functions, as well as a main controller 47, a position acquiring unit 48 and a modifier 49, as the function units executing the program. These functional units of control device 5 will be described afterwards.

FIG. 45 corresponds to a communication system based on an adaptive array antenna system and combined diversity system. Control device 5 of such a case includes a transmitter/receiver 61 for transmitting and receiving information, a combiner 62, and a shifter 63.

The communication party of the communication system includes an in-vehicle device 50 of a vehicle or car running on a road where signal lamp apparatus 1 is installed. Road-vehicle communication is allowed. Another communication party includes another signal lamp apparatus 1 installed close to the location of signal lamp apparatus 1 (at the same intersection), i.e. an antenna 4 (and control device 5) provided at another signal lamp apparatus 1 or another lamp apparatus (not shown) located at a nearby intersection. In this case, communication between signal lamp apparatuses 1 and 1, i.e. road-road communication, is allowed. A further another communication party is a portable terminal (cellular phone) carried by a pedestrian walking along the sideway of the road where signal lamp apparatus 1 is installed.

[Function of Control Device 5]

Signal lamp apparatus 1 includes a plurality of antennas 4*a*, 4*b* and 4*c*. Since these antennas 4*a*, 4*b* and 4*c* are aligned with a predetermined distance therebetween, main controller 47 of control device 5 can implement spatial diversity. Specifically, main controller 47 selects an antenna having an electric wave of high intensity among the plurality of antennas for communication.

In addition, main controller 47 can employ the maximal ratio combining scheme other than the antenna selection scheme.

Figure 50:
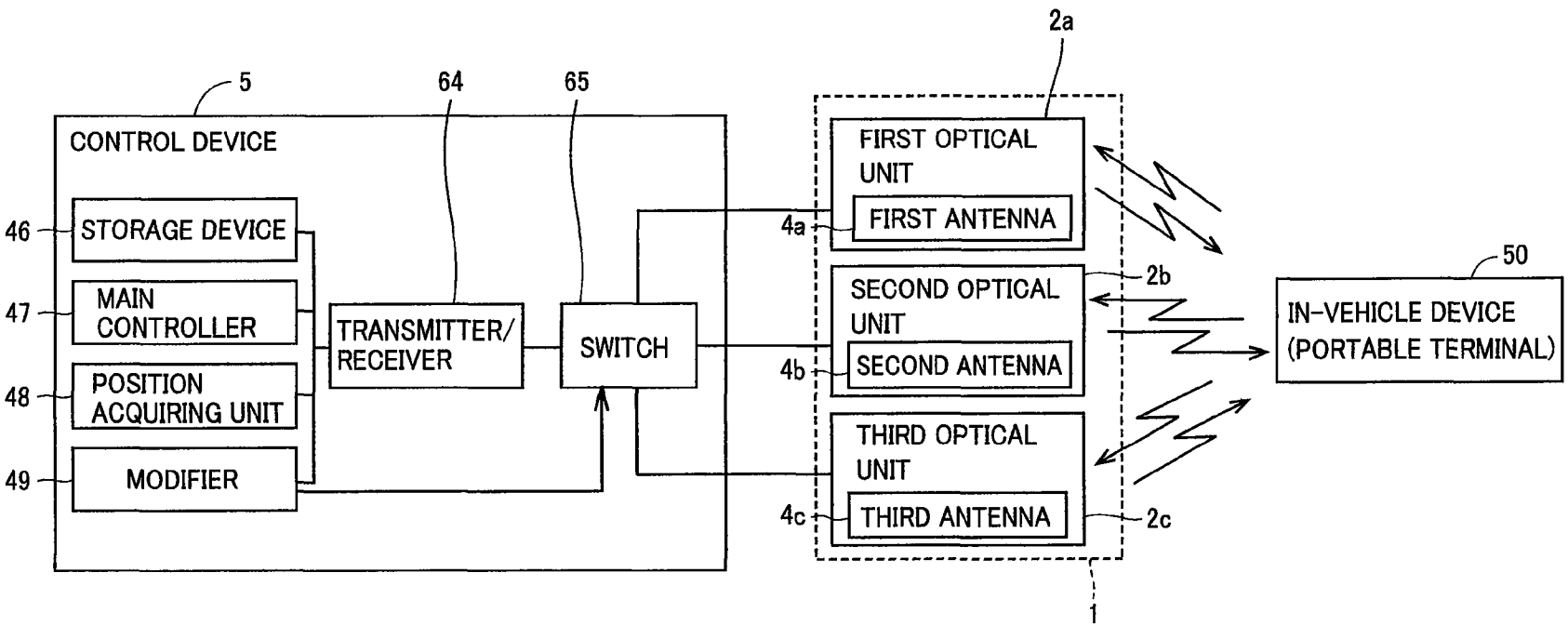
FIG. 50 is a block diagram of a communication system.

Control device 5 based on selective diversity includes a transmitter/receiver 64 for transmission and reception of information and a switch 65 for selection, as shown in the block diagram of FIG. 50.

The communication system may be configured as an adaptive array antenna system. Accordingly, antennas 4*a*, 4*b* and 4*c* are arranged in an array as an adaptive array antenna. Main controller 47 can control the weight of each antenna adaptively according to a change in the wave environment (carrier environment) and/or usage application to modify the directivity electrically. The operation of the communication system to carry out wireless communication with a vehicle running on a road according to the function of control device 5 will be described hereinafter.

Figure 47:
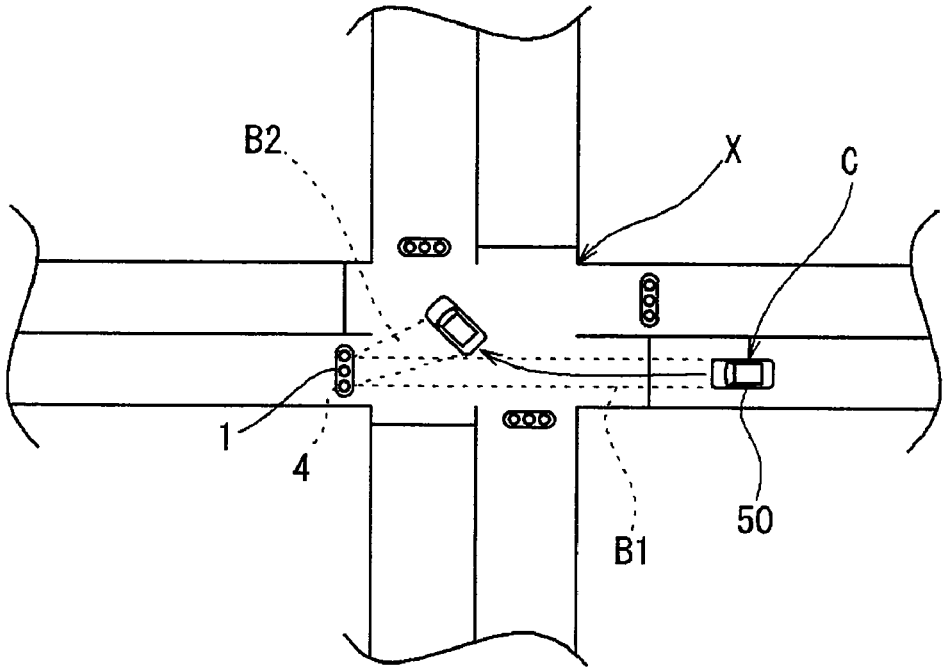
FIG. 47 is a plan view of a road where a communication system is provided.

FIG. 47 is a plan view of a road where the communication system of the present invention is provided (intersection X). Signal lamp apparatus 1 is installed at intersection X, and antenna 4 is provided in signal lamp apparatus 1. A vehicle C running towards intersection X is mounted with an in-vehicle device 50 for communication.

The in-vehicle computer of in-vehicle device 50 is capable of identifying its own location to obtain position information by a GPS function or the like. In-vehicle device 50 can obtain the position information about the location of vehicle C. The position information includes one or both of coordinate information on the longitude and latitude, and lane information of the running lane. In the case where the accuracy of the coordinate information is high, the lane information is dispensable since the lane can also be identified.

In-vehicle device 50 transmits the position information towards antenna 4 of signal lamp apparatus 1 from the vehicle-mounted antenna (not shown) of in-vehicle device 50. In-vehicle device 50 also transmits running information including the speed information about the running speed of vehicle C. In the case where vehicle C is to change the lane, lane-change information about the planned lane change may be included in the running information. Information related to the forwarding direction may also be included in the case where the vehicle is to turn left or right at an intersection. Further, information related to the traveling time from a certain location to another location, probe information related to the vehicular swept path of a vehicle, and the like may be included.

The position information and running information are received by antenna 4 of signal lamp apparatus 1. Position acquiring unit 48 (refer to FIG. 45) of control device 5 obtains the position information and running information.

Position acquiring unit 48 can identify the location of vehicle C based on the information of position information and running information after obtaining the same. Modifier 49 of control device 5 (refer to FIG. 45) dynamically modifies the directivity of antenna 4 from B1 to B2 according to the position information and running information, as shown in FIG. 47. Modifier 49 implements control to direct the directivity towards vehicle C by controlling the phase and amplitude of the signal from plurality of antennas 4.

Position acquiring unit 48 uses the position information and running information received from vehicle C to estimate the position of vehicle C after reception of the position information and running information. Modifier 49 modifies the antenna directivity so as to follow vehicle C that is currently running.

Control device 5 can repeatedly carry out transmission and reception of position information with respect to in-vehicle device 50 and the control through position acquiring unit 48 and modifier 49 several times. In this case, control device 5 can modify the antenna directivity so as to follow the running vehicle C based on position information even without having to receive the running information.

Thus, control device 5 can shift the antenna directivity in the direction with horizontal direction component in accordance with vehicle C. For example, even if vehicle C changes its lane to the right side in order to make a right turn, control device 5 can shift the antenna directivity following the change to the horizontal direction (right side lane). Then, control device 5 can modify the antenna directivity facing the road located in the front of antenna 4 to the directivity towards the center area of intersection X. As a result, predetermined information can be transmitted between the road and vehicle to improve the gain of road-vehicle communication, as will be described afterwards.

Modifier 49 causes the null point to face the direction of the interference wave in order to improve the communication quality.

Although modification of the antenna directivity by control device 5 may be carried out dynamically so as to continuously follow the running vehicle C, the antenna directivity may be switched statistically in the case where continuous followability is not required (when not required to follow). For example, the antenna directivity may be switched according to the time zone.

Alternatively, modifier 49 can determine whether the antenna directivity is to be modified dynamically or statistically depending upon the number of vehicles C control device 5 has conducted carrier sensing with an in-vehicle device 50, and then execute the modification. For example, the directivity may be modified dynamically so as to follow the vehicle, when the communication party is one vehicle, and modify the directivity statistically when the communication party is a plurality of vehicles.

Further, the directivity may be modified in cooperation with the display of traffic signal lamp apparatus 1. For example, when the right-of-way is assigned only to right-turning vehicles at an intersection where an arrow transit signal is provided, the directivity can be selectively narrowed down to right-turning lanes. When at a blue signal, the directivity can be established about a side farther away from the intersection. When at a red signal, the directivity can be established centered about the proximity of the intersection.

The above embodiments have been described corresponding to the case of a signal lamp apparatus 1 installed laterally as shown in FIG. 1, i.e. a plurality of antennas 4 arranged horizontally at signal lamp apparatus 1 in which optical units 2 are aligned horizontally. In addition, an arrow sign optical unit (not shown) may be provided below the optical units 2 of red, blue and yellow of signal lamp apparatus 1 of FIG. 1, with an antenna incorporated in the arrow sign optical unit. Furthermore, an antenna can be incorporated into an optical unit such as a traffic information bulletin.

The configuration will be based on a plurality of antennas arranged vertically, and control device 5 will be able to shift the antenna directivity up or down (vertical direction) taking advantage of the antennas disposed in the vertical direction.

In this case, position acquiring unit 48 determines whether vehicle C is located far away or in the proximity by comparison with its own antenna position, and modifier 49 can modify the antenna directivity in the vertical direction according to the determination result. In other words, modifier 49 can modify the antenna directivity in the approaching or away direction from antenna 4 up to vehicle C.

Although not shown, in the case where signal lamp apparatus 1 is mounted such that its longer length is in the vertical direction, optical units 2 will be aligned in the vertical direction. By incorporating an antenna 4 in each of optical units 2, control device 5 can shift the antenna directivity in the approaching or away direction (vertical direction). An example of a vertically-mounted signal lamp apparatus 1 is a signal lamp apparatus 1 installed at snowy districts.

In the case where the directivity is modified in the perspective direction, control device 5 preferably carries out control of increasing and decreasing the transmission output towards a distant site and a close site, respectively.

The information that can be transmitted from control device 5 to in-vehicle device 50 will be described. Such information can be transmitted to a vehicle with the antenna directivity modified so as to follow the running vehicle according to the above-described function of control device 5.

Control device 5 (traffic signal controller) can provide via antenna 4 signal information related to the current and future display of traffic signal lamp apparatus 1 towards a vehicle running along or close to the road where traffic signal lamp apparatus 1 is installed.

Signal information refers to information related to the current or future signal light colors displayed by traffic signal lamp apparatus 1, and includes the planned continuous display period, the display sequence, and the like of each signal lamp color.

For example, information set forth below is presented in a predetermined format. The current light color displayed by signal lamp apparatus 1 is blue and the planned continuous period thereof is 5 seconds. The next light color to be displayed is the yellow signal having the planned continuous period of 8 seconds. The next light color to be displayed is a right-turn blue arrow sign having a planned continuous period of 5 to 10 seconds. The signal information to be presented may be just the current displayed light color and its continuous time, or the information of one cycle together. In addition to such information, parametric information related to spot-actuated control, at geometric spots where such control is implemented, as well as the time zone for executing control may be included.

The in-vehicle computer at the vehicle receiving such signal information can estimate the time before arriving at the halt line from the distance to the halt line, the running speed of the vehicle, acceleration and the like, and then estimate the signal light color that will be displayed at the elapse of the estimated time. For example, in the case where the signal light color is expected to be red at the time of arriving at the halt line even if a green signal is displayed at the current point of time, the in-vehicle computer should execute drive control so as to safely stop before the halt line. In the case where determination is made that the vehicle can cross the intersection safely if the speed is not lowered, control is executed to maintain the speed.

The in-vehicle computer may execute control, governed mainly by the in-vehicle device, and also assisting the driving operation of the driver such as "brake assist".

The in-vehicle computer may notify a passenger in the vehicle about the result of the above-described determination through voice and/or image information. For example, a voice message of "Stop the vehicle since the signal will soon change" can be issued towards the driver, or an appropriate text or graphic image can be displayed on the screen of the head-up display or navigation device.

Figure 48:
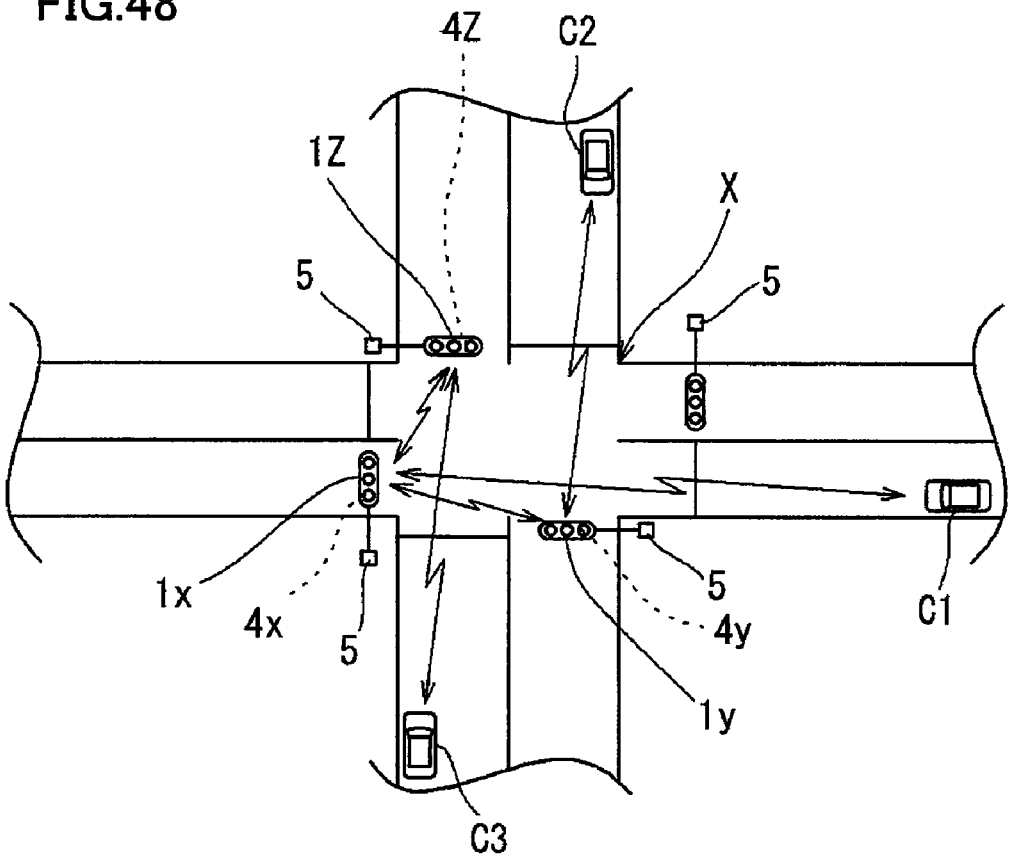
FIG. 48 is a diagram to describe another feature of the communication system.

FIG. 48 is a diagram to describe another feature of the communication system. The communication system includes a plurality of traffic signal lamp apparatuses 1 installed at an intersection X, an antenna unit formed of a plurality of antennas 4 incorporated in respective traffic signal lamp apparatuses 1. Although a plurality of control devices 5 may be provided (embodiment of FIG. 48) so that one control device 5 controls one antenna unit (one signal lamp apparatus 1), a plurality of antenna units (plurality of signal lamp apparatuses 1) may be under control of one control device 5 (not shown). In the case where a plurality of control devices 5 are provided, these control devices 5 may control the operation cooperatively. Alternatively, any one of control devices 5 may control the operation, representatively.

In FIG. 48, one set of antenna unit provided in one signal lamp apparatus 1 is configured to have antenna directivity in the traverse direction inclined in the horizontal direction with respect to the front side. Specifically, an antenna unit provided at one lamp apparatus 1 includes, in addition to the antenna directivity towards the forward side so as to allow communication with a vehicles at the front side, the directivity in the horizontal direction towards antenna 4 in another lamp apparatus 1 installed at the same intersection X.

By a virtue of the above-described configuration, control device 5 can modify the directivity taking advantage of a plurality of antennas 4 constituting a set of antenna unit. Thus, a configuration having horizontal directivity can be achieved. Alternatively, the directivity of one of the plurality of antennas 4 can be fixed and set in advance in the horizontal direction, and the directivity of another antenna 4 can be set in the forward direction.

A communication system configured as set forth above functions as a relay communication unit for communication between a vehicle C1 and a vehicle C2 (vehicle-vehicle communication) running on separate roads leading to intersection X. Specifically, the in-vehicle device (not shown) of a first vehicle C1 running on a road carries out wireless communication with an antenna 4*x* of a first signal lamp apparatus 1*x* located frontward in the running direction. Accordingly, information transmitted from vehicle C1 can be received at antenna 4*x*. Control device 5 transmits the received information to an antenna 4*y* of a second signal lamp apparatus 1 from antenna 4*x*. In this event, the capability of antenna directivity in the horizontal direction can be utilized. Then, control device 5 transmits the information from antenna 4*y* to the in-vehicle device of vehicle C2 running ahead (another road).

Accordingly, mutual communication can be established by connection through vehicle-road-road-vehicle by causing the communication system provided at intersection X to function as a relay communication unit, even if the line of sight between vehicles C1 and C2 is poor. Accordingly, the presence of the other vehicle can be notified in advance to the drivers at both of vehicles C1 and C2 to avoid head-on collision accidents at intersection X.

Although the above-described embodiment includes communication with a vehicle (in-vehicle device) in the communication system, the communication system may be used only for the communication between roads. In other words, the communication system may be operated only for the communication between an antenna 4x of a first signal lamp apparatus 1x and an antenna 4y of a second signal lamp apparatus 1y.

Another function of the communication system will be described.

Figure 49:
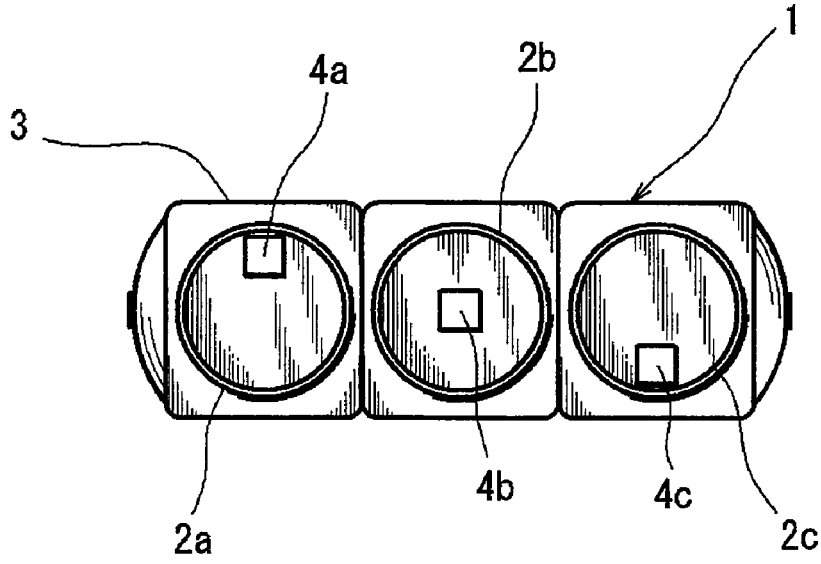
FIG. 49 is a front view representing another embodiment of a signal lamp apparatus in which an antenna is incorporated.

FIG. 49 is a front view of another embodiment of signal lamp apparatus 1 in which antenna 4 is incorporated. In the present embodiment, a plurality of antennas 4 are set at respective positions differing in the height direction, incorporated into an optical unit 2 of traffic signal lamp apparatus 1. In other words, a plurality of antennas 4 are deviated in position in both the horizontal direction and vertical direction.

Specifically, first antenna 4a is incorporated at the middle in the horizontal direction and at the upper region in the vertical direction of first optical unit 2a located at the left side. Second antenna 4b is incorporated at the middle in the horizontal direction and at the middle in the vertical direction of second optical unit 2b. Third antenna 4c is incorporated at the middle in the horizontal direction and at the lower region in the vertical direction of third optical unit 2c. In this case, control device 5 can modify the antenna directivity concurrently in the horizontal direction and vertical direction. This configuration can be readily employed particularly in the case where signal lamp apparatus 1 (optical unit 2) is large.

Figure 46:
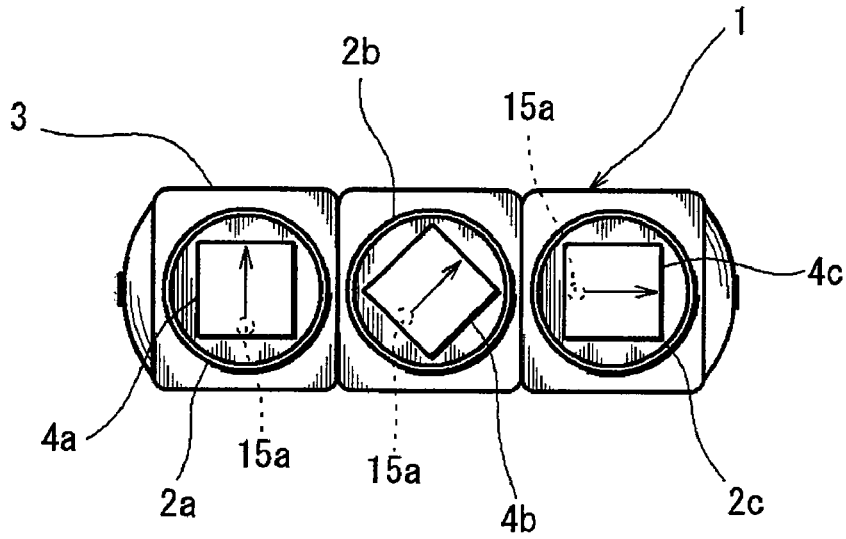
FIG. 46 is a front view of a signal lamp apparatus.

Since a plurality of antennas are provided at signal lamp apparatus 1, a configuration in which at least one of the plurality of antennas is set to have polarization different from that of another antenna can be provided. FIG. 46 is a front view of signal lamp apparatus 1. In FIG. 46, each of plurality of antennas 4a, 4b and 4c is set to have polarization different from that of the remaining antennas. Specifically, first antenna 4a has vertical polarization. Second antenna 4b has a 45° oblique polarization. Third antenna 4c has horizontal polarization. Furthermore, although not shown, one of antennas 4a, 4b and 4c may be set to have circular polarization.

By differentiating the polarization in one set of antenna unit, main controller 47 can implement polarization diversity. Accordingly, the polarization can be switched for usage in a set of antenna unit (plurality of antennas 4a, 4b and 4c) incorporated in one signal lamp apparatus 1. For example, main controller 47 can switch to an antenna having an electric wave of high intensity to conduct communication.

Since a plurality of antennas are provided at signal lamp apparatus 1, at least one of the plurality of antennas may be set to have a directivity different from those of the remaining antennas.

Figure 51:
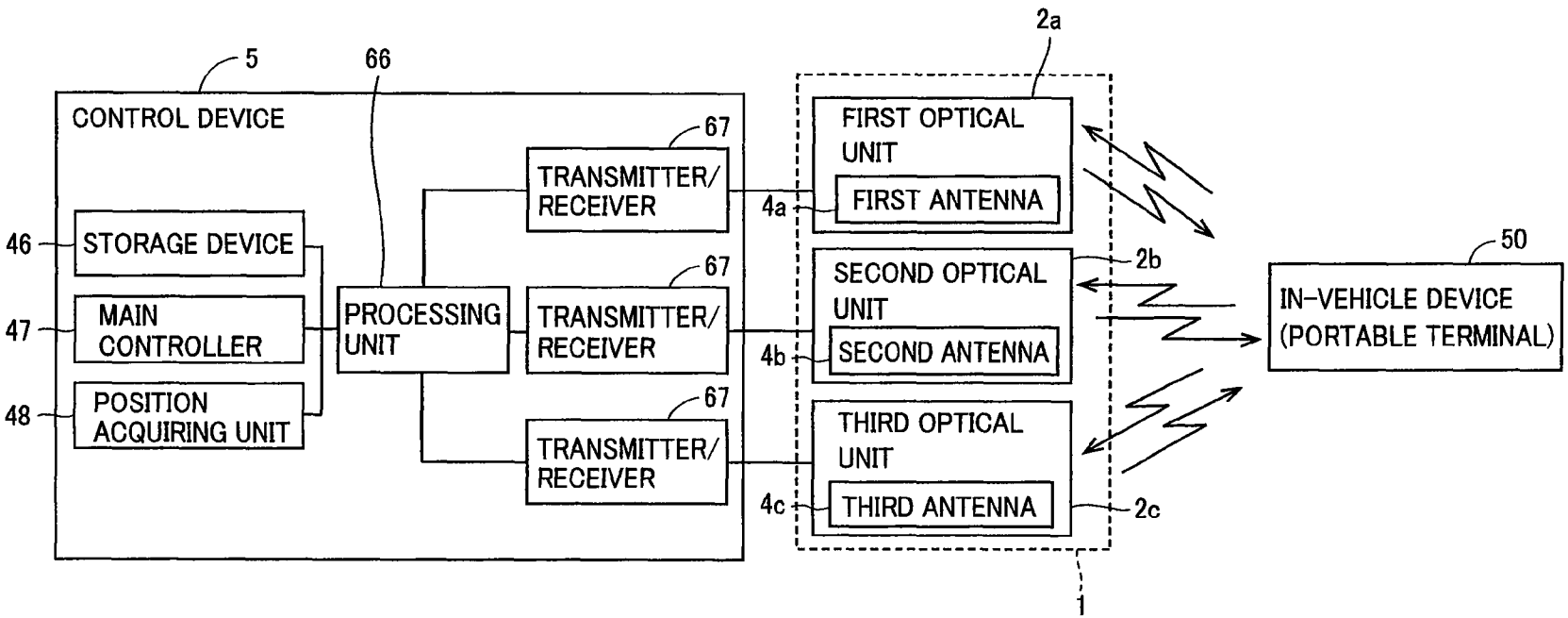
FIG. 51 is a block diagram of a communication system.

As another function of the communication system, main controller 47 can carry out various diversities such as transmission diversity, frequency diversity, directional diversity, and the like utilizing antennas 4a, 4b and 4c. Alternatively, an MIMO system can be configured by control device 5 and a plurality of antennas 4a, 4b and 4c. As shown in the block diagram of FIG. 51, control device 5 corresponding to an MIMO system includes a processing unit 66 and a transmitter/receiver 67 for transmission and reception of information, Thus, by carrying out diversity according to a plurality of antennas 4a, 4b and 4c as well as control device 5 implementing wireless communication control through plurality of antennas 4a, 4b and 4c, the communication quality can be improved. Furthermore, communication narrowed to a specific area is allowed by controlling the antenna directivity. Moreover, the gain can be improved by removing interference waves. In addition, the antenna directivity can be modified over time.

Since antenna 4 is incorporated in optical unit 2, antenna 4 can be rendered inconspicuous.

FIG. 46 has been described based on a configuration in which each of a plurality of antennas 4a, 4b and 4c is set to have polarization differing from those of the remaining antennas. A specific configuration with such various directions of polarization includes the sixth embodiment of FIG. 12, the seventh embodiment of FIG. 13, the eighth embodiment of FIG. 14, the ninth embodiment of FIG. 15, and the tenth embodiment of FIG. 16.

In the above-described communication system of the present invention, the form of the lamp apparatus and antenna 4 may employ those of the first to twenty-second embodiments.

In the communication system of the present invention, the antenna may take a form other than a patch antenna.

Furthermore, since the antenna is reduced in size when directed to a high frequency band, diversity control can be carried out with two or more antenna elements spaced apart and stored in one optical unit.

The lamp apparatus of the present invention also includes the configurations set forth below.

(Additional Statement 1)

A lamp apparatus comprising:

an optical unit including a light emitter and a cover member, said cover member having visible-light transmittance and spread over said light emitter at a front, and a patch antenna stored in said optical unit.

(Additional Statement 2)

The light apparatus according to Additional Statement 1, wherein said patch antenna includes a patch element situated in a range from said cover member up to a leading end of said light emitter, and a ground element located at a rear of the patch element, said patch element has visible-light transmittance.

(Additional Statement 3)

The lamp apparatus according to Additional Statement 2, wherein said ground element is provided at a rear of said patch element and frontward of a leading end of said light emitter, and has visible-light transmittance.

(Additional Statement 4)

The lamp apparatus according to Additional Statement 2, wherein said optical unit includes a substrate having said light emitter mounted at a front face, and said ground element is located at the rear of said patch element, and between said substrate and the leading end of said light emitter in a front-back direction.

(Additional Statement 5)

The lamp apparatus according to Additional Statement 4, wherein said optical unit includes a plurality of said light emitters each constituted of a light emitting diode, said ground element is planar, and has an opening formed for inserting said light emitting diode.

(Additional Statement 6)

The lamp apparatus according to Additional Statement 2, wherein said patch element is constituted of a conductor having an opening formed for visible-light transmittance.

(Additional Statement 7)

The lamp apparatus according to Additional Statement 2, wherein said patch element is constituted of a conductor membrane having visible-light transmittance.

(Additional Statement 8)

The lamp apparatus according to Additional Statement 2, further comprising a sheet member having visible-light transmittance, provided between said cover member and the leading end of said light emitter, wherein said patch element is formed at the sheet member.

(Additional Statement 9)

The lamp apparatus according to Additional Statement 2, wherein said patch element is formed at said cover member.

(Additional Statement 10)

The lamp apparatus according to Additional Statement 1, wherein said patch antenna includes a patch element provided at a rear side of the leading end of said light emitter, and a ground element located at a rear of said patch element, the patch and ground elements are stored in said optical unit.

(Additional Statement 11)

The lamp apparatus according to Additional Statement 10, wherein said optical unit includes a substrate having a light emitter mounted at a front face, said patch element is located frontward of said substrate, and at a rear side of the leading end of said light emitter.

(Additional Statement 12)

The lamp apparatus according to Additional Statement 11, wherein said ground element is located at a rear of said patch element, and frontward of said substrate.

(Additional Statement 13)

The lamp apparatus according to Additional Statement 10, wherein said optical unit further includes a storage member having said cover member attached at a front portion, and storing said light emitter, said patch element and said ground element are stored in a storage cavity defined between said cover member and said storage member, said patch element is provided at a rear side of the leading end of said light emitter, and said ground element is located at a rear of said patch element.

(Additional Statement 14)

The lamp apparatus according to Additional Statement 10, wherein said optical unit includes a plurality of said light emitters each constituted of a light emitting diode, said patch element is planar, and has an opening formed to insert said light emitting diode.

The invention claimed is:

1. A traffic signal lamp apparatus comprising:

an optical unit including:

a plurality of light emitting diodes; and a cover member, the cover member having visible-light transmittance and spread over the light emitting diodes at a front of the traffic signal lamp; and a patch antenna stored in said optical unit, the patch antenna including a patch element situated between the cover member and a leading end of each light emitting diode, the patch element having visible-light transmittance.

2. The traffic signal lamp apparatus according to claim 1, wherein said patch antenna includes a ground element located at a rear of the patch element.

3. The traffic signal lamp apparatus according to claim 2, wherein said ground element is provided at a rear of said patch element and frontward of the leading end of each light emitting diode, and has visible-light transmittance.

4. The traffic signal lamp apparatus according to claim 2, wherein said optical unit includes a substrate having said light emitting diodes mounted at a front face, and said ground element is located at the rear of said patch element, and between said substrate and the leading end of each light emitting diode in a front-back direction.

5. The traffic signal lamp apparatus according to claim 4, wherein said ground element is planar, and has an opening formed for inserting each light emitting diode.

6. The traffic signal lamp apparatus according to claim 2, wherein said patch element is constituted of a conductor having an opening formed for visible-light transmittance.

7. The traffic signal lamp apparatus according to claim 2, wherein said patch element is constituted of a conductor membrane having visible-light transmittance.

8. The traffic signal lamp apparatus according to claim 2, further comprising:

a sheet member having visible-light transmittance, provided between said cover member and the leading end of each light emitter diode, wherein said patch element is formed at the sheet member.

9. The traffic signal lamp apparatus according to claim 2, wherein said patch element is formed at said cover member.

10. A traffic signal controller connected to the traffic signal lamp apparatus according to claim 1, said traffic signal controller turning on and off the traffic signal lamp apparatus, said traffic signal controller configured to transmit, through said antenna, signal information related to display of current and future traffic signal lamp apparatus towards a vehicle running on a road where said traffic signal lamp apparatus is installed.

11. A traffic signal lamp apparatus comprising:

an optical unit including:

a light emitter, and a cover member, the cover member having visible-light transmittance and spread over a light emitter at a front of the traffic signal lamp; and a patch antenna stored in the optical unit, wherein:

said patch antenna includes a patch element provided at a rear side of the leading end of said light emitter, and a ground element located at a rear of said patch element, and the patch and ground elements are stored in said optical unit.

12. The traffic signal lamp apparatus according to claim 11, wherein said optical unit includes a substrate having a light emitter mounted at a front face, and said patch element is located frontward of said substrate, and at a rear side of the leading end of said light emitter.

13. The traffic signal lamp apparatus according to claim 12, wherein said ground element is located at a rear of said patch element, and frontward of said substrate.

14. The traffic signal lamp apparatus according to claim 11, wherein:

said optical unit further includes a storage member having said cover member attached at a front portion, and storing said light emitter, and said patch element and said ground element are stored in a storage cavity defined between said cover member and said storage member, said patch element is provided at a rear side of the leading end of said light emitter, and said ground element is located at a rear of said patch element.

15. The traffic signal lamp apparatus according to claim 11, wherein:

said optical unit includes a plurality of said light emitters each constituted of a light emitting diode, and said patch element is planar, and has an opening formed to insert said light emitting diode.

16. A traffic signal controller connected to the traffic signal lamp apparatus according to claim 11, said traffic signal controller turning on and off the traffic signal lamp apparatus, said traffic signal controller configured to transmit, through said antenna, signal information related to display of current and future traffic signal lamp apparatus towards a vehicle running on a road where said traffic signal lamp apparatus is installed.

17. An antenna unit for a traffic signal lamp apparatus incorporated into an optical unit including a plurality of light emitting diodes and a cover member having visible-light transmittance, spread over each light emitting diode at a front, said antenna unit comprising:

a patch element situated between the cover member and a leading end of each light emitting diode, a ground element located at a rear of the patch element, and said patch element has visible-light transmittance.

18. An antenna unit for a traffic signal lamp apparatus incorporated into an optical unit including a light emitter and a cover member having visible-light transmittance, spread over said light emitter at a front, said antenna unit comprising a patch element provided at a rear side of the leading end of said light emitter, and a ground element located at a rear of said patch element.

* * * * *